US007722339B2

(12) United States Patent
Sato et al.

(10) Patent No.: US 7,722,339 B2
(45) Date of Patent: May 25, 2010

(54) COMPRESSOR INCLUDING ATTACHED COMPRESSOR CONTAINER

(75) Inventors: Koichi Sato, Tokyo (JP); Takeshi Fushiki, Tokyo (JP); Taro Kato, Tokyo (JP); Toshiaki Iwasaki, Tokyo (JP); Masaki Okada, Tokyo (JP); Shoichiro Hara, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 163 days.

(21) Appl. No.: 11/797,753

(22) Filed: May 7, 2007

(65) Prior Publication Data

US 2007/0261238 A1 Nov. 15, 2007

(30) Foreign Application Priority Data

May 11, 2006 (JP) ..... 2006-132539
May 11, 2006 (JP) ..... 2006-132540

(51) Int. Cl.
*F04C 29/00* (2006.01)
*F04B 39/12* (2006.01)

(52) U.S. Cl. ..... 418/3; 418/54; 418/270; 29/888.02; 29/888.025; 29/447

(58) Field of Classification Search ..... 418/3, 418/54, 270; 29/888.02, 888.025, 447
See application file for complete search history.

(56) References Cited

U.S. PATENT DOCUMENTS 2,630,964 A * 3/1953 Scheldorf ..... 29/889.2
3,508,327 A * 4/1970 Pieper et al. ..... 29/596
3,571,921 A * 3/1971 Pieper ..... 29/596
4,281,973 A * 8/1981 Meneghello ..... 417/423.12
4,526,522 A * 7/1985 Onoda ..... 418/63
5,113,103 A * 5/1992 Blum et al. ..... 310/89
5,267,844 A * 12/1993 Grassbaugh et al. ..... 418/55.1

(Continued)

FOREIGN PATENT DOCUMENTS

JP 1-131880 U 9/1989

(Continued)

OTHER PUBLICATIONS

An Office Action from corresponding Chinese application No. 2007101032353, mailed on Nov. 21, 2008.

*Primary Examiner*—Thomas E Denion
*Assistant Examiner*—Mary A Davis
(74) *Attorney, Agent, or Firm*—Buchanan Ingersoll & Rooney PC

(57) ABSTRACT

There is provided a high performance compressor that causes no possibility of mixing foreign materials or of leaking refrigerant, that reduces strain otherwise generated in a compressor mechanism section and that is highly reliable even for a long-term use. The compressor mechanism section in which pairs of prepared holes are formed at a plurality of points on an outer peripheral face thereof is disposed within the closed container. Caulking punches are positioned to positions corresponding to those of the prepared holes and a region including the corresponding positions is heated. Then, when the punches are driven by pressing machines, portions of the container wall of the closed container plastically deform as the convex portions and enter the prepared holes. When the container wall cools down, the pair of convex portions of the container clamps a part between the prepared holes.

11 Claims, 37 Drawing Sheets

U.S. PATENT DOCUMENTS

| | | | | |
|---|---|---|---|---|
| 6,056,523 | A * | 5/2000 | Won et al. | 418/15 |
| 6,193,484 | B1 * | 2/2001 | Hahn et al. | 29/888.022 |
| 6,428,293 | B1 * | 8/2002 | Dewar et al. | 418/55.1 |
| 6,791,230 | B2 * | 9/2004 | Tornquist et al. | 310/214 |
| 6,974,314 | B2 * | 12/2005 | Matsumoto et al. | 418/60 |
| 7,124,490 | B2 * | 10/2006 | Kellermeier | 29/447 |
| 7,195,468 | B2 * | 3/2007 | Um | 29/888.022 |

FOREIGN PATENT DOCUMENTS

| | | | |
|---|---|---|---|
| JP | 06-272677 | A | 9/1994 |
| JP | 6-509408 | A | 10/1994 |
| JP | 3567237 | B2 | 10/1994 |
| JP | 2005-330827 | A | 12/2005 |
| JP | 2005330827 | A * | 12/2005 |
| WO | 93/21440 | A1 | 10/1993 |

* cited by examiner

COMPRESSOR INCLUDING ATTACHED COMPRESSOR CONTAINER

BACKGROUND OF THE INVENTION

1. Field of the Invention

The present invention relates to a compressor and more specifically to a compressor preferably used for a refrigerator, an air-conditioner a hot-water supplier and the like.

2. Description of the Related Art

A conventional compressor has been manufactured by fixing built-in parts such as a compressor mechanism section, i.e., compressor means, to a container by making holes through the container, shrinkage-fitting the compressor mechanism section to the container and casting melt metal from the outside through the holes as disclosed in Japanese Patent Laid-Open No. 1994-272677 gazette for example.

As a method for fixing a compressor mechanism section to a compressor in which no hole is made through a container, there is one disclosed in Japanese Patent-Laid Open No. 1994-509408 gazette (P. 1, FIG. 1) that fixes the compressor mechanism section within the container by positioning the compressor mechanism section, a built-in part, in the container by press-fitting and by pressing position of the container facing to a prepared hole made through an outer peripheral face of the compressor mechanism section inwardly in a radial direction by a pressing jig to "plastic-deform" the wall section of the container toward the inside of the prepared hole.

There is also a method of fixing a compressor mechanism section to a closed container by making a prepared hole through an outer peripheral face of the compressor mechanism section and by "heating caulking" by heating from the outer periphery of the container at the same position with this prepared hole as disclosed in Japanese Utility Model 1989-131880 gazette (P. 1, FIG. 1) for example.

There is also a method of fixing a compressor mechanism section of a built-in part to a container by making a plurality of prepared holes that are in close proximity with an outer peripheral face of the compressor mechanism section, pressing the container facing to those prepared holes inwardly in a radial direction by a pressing jig and clamping portions between the prepared holes of the compressor mechanism section by a plurality of convex portions of the container by thermal contraction caused when the container is cooled down as disclosed in Japanese Patent Laid-Open No. 2005-330827 gazette (P. 1, FIG. 1) for example.

However, those prior art technologies described above have had the following problems.

(i) The compressor in which the prepared hole is made through the container has had a problem that foreign materials such as welding sputters are mixed into the container through the hole during welding, entering the compressor mechanism section, i.e., compressor means, and causing defective compression or leak of refrigerant from the hole of the container due to defective welding.

(ii) Furthermore, when melt metal is flown into the hole portion of the container, the container is heated and the container expands to the outside in the radial direction due to the heat. Then, the melt metal injected between the built-in part such as the compressor mechanism section and the container coagulates in this state. After the coagulation of the melt metal, cooling contraction of the container occurs and thereby the coagulated melt metal receives inward force from the container. Then, it presses the compressor mechanism section in the radial direction, increasing strain generated in the compressor mechanism section.

(iii) The compressor in which no hole is made through the container has had a problem that because the compressor mechanism section is press-fitted into the container, force clamping the compressor mechanism section increases, causing strain in the compressor mechanism section.

(iv) It also has had a problem that stain of the compressor mechanism section increases because force is applied to the compressor mechanism section in pressing and caulking the container facing to the prepared hole of the compressor mechanism section from the outside without heating.

(v) The compressor in which one point of the prepared hole is caulked by heating has had a problem that the compressor mechanism section becomes rickety with respect to the container because the caulking point thermally contracts when the container is cooled down, even though it can reduce the force for pressing the container from the outside in caulking the compressor mechanism section.

(vi) The compressor in which the plurality of neighboring caulking points is formed by heat-caulking and the compressor mechanism section is fixed by clamping by thermal contraction caused when the container is cooled has had problems that clamping may be insufficient, causing dislocation or ricketiness of the compressor mechanism section with respect to the container during when the compressor is used for a long period of time and that it lacks a long term reliability causing troubles such as the increase of noise and vibration.

(vii) Furthermore, although the Japanese Patent Laid-Open No. 2005-330827 describes a manufacturing system and method for fixing the compressor mechanism section to the container, it discloses no concrete system and method for obtaining a practical, highly reliable and high performance compressor.

SUMMARY OF THE INVENTION

Accordingly, the invention aims at solving the above-mentioned problems by providing a highly reliable and high performance compressor or the like that causes no possibility of mixing foreign materials such as welding sputters into the container or of leaking refrigerant, that reduces force to be received by the compressor mechanism section when the compressor mechanism section, i.e., a built-in part, is fixed within the container to reduce strain to be generated in the compressor mechanism section and that causes no trouble such as increase of noise and vibration which are otherwise caused by the rickety compressor mechanism section even when it is used for a long period of time.

(1) According to the invention, a compressor has a container having a cylindrical container wall and a built-in part housed within the container by leaving a predetermined clearance between an inner peripheral face of the container wall and the built-in part, wherein the built-in part is fixed to the container through steps of:

forming pairs of prepared holes at plural points in a circumferential direction on an outer peripheral face of the built-in part, pushing parts of the container wall into each pair of the prepared holes under the condition that a region of the container wall including positions corresponding to positions of the pair of prepared holes is heated so as to form pair of convex portions on the inner peripheral face of the container wall at each of the plural points in the circumferential direction and forming a fixing section constituted by the pair of convex portions clamping a part between the pair of prepared holes when the region cools down.

(2) In the compressor of aspect 1, a distance (L) between centers of the pair of prepared holes is equal to or less than twice an inner diameter (D) of the prepared hole and is equal to or more than 0.6 times ($0.6\times D \leqq L < 2\times D$).

(3) In the compressor of aspect 1 or 2, a length of the convex portion entering the prepared hole is equal to or less than 0.5 times a thickness of the container wall or is about 1 mm.

(4) In the compressor of any one of aspects 1 through 3, the built-in part is any one of components among:

a cylinder that covers a compressing chamber of a compressor mechanism section that effects compression;

a frame that composes the compressing chamber or that rotatably supports the compressor mechanism section; or a bearing-supporting member.

(5) In the compressor of any one of aspects 1 through 4, the fixing sections are provided on the outer peripheral face of the built-in part almost at equal pitches.

(6) In the compressor of any one of aspects 1 through 5, the temperature in the region in the heated condition is in a range between temperature that softens a material forming the container wall and a melting point of the material.

(7) In the compressor of aspect 6, the temperature in the region in the heated condition is in a range of 600° C. to 1500° C.

(8) In the compressor of any one of aspects 1 through 5, the temperature in the region in the heated condition is in a range of 800° C. to 1100° C.

(9) In the compressor of any one of aspects 1 through 8, a ringed or arc groove is formed instead of the prepared hole.

(10) In the compressor of aspect 9, a center radius (R) of the groove is equal to or less than twice a width (W) of the groove and is equal to or more than 0.6 times ($0.6\times W \leqq R < 2\times W$).

(11) In the compressor of any one of aspects 1 through 10, the built-in part is a cylinder that composes compressor means and an inner diameter of the cylinder is equal to or less than 75% of an outer diameter thereof.

(12) In the compressor of any one of aspects 1 through 11, the built-in part is a cylinder that composes compressor means and a width of an outer peripheral face of the cylinder is equal to or more than 5% of an outer diameter.

(13). In the compressor of any one of aspects 1 through 12;

a second built-in part is housed within the container by leaving a predetermined clearance between the inner peripheral face of the container wall and the second built-in part;

pairs of second prepared holes are formed at plural points in a circumferential direction on an outer peripheral face of the second built-in part;

portions of the container wall are pushed into the second prepared holes under the condition that regions of the container wall including positions corresponding to positions of the second prepared holes are heated so as to form pairs of second convex portions on the inner peripheral face of the container wall at plural points in the circumferential direction; and second fixing sections are formed as each of the pairs of second convex portions clamps a part between each of the pair of second prepared holes when the region cools down; wherein a width of the outer peripheral face of the second built-in part is equal to or more than 1% of the outer diameter.

(14) In the compressor of any one of aspects 1 through 13, the built-in part is a stator that composes a revolving electric machine together with a rotator and is composed of a plurality of laminated electromagnetic steel plates, and the prepared holes are provided so as to straddle the plurality of laminated electromagnetic steel plates.

Since the compressor of the invention is configured as described above, it brings about the following effects.

(a) The invention can improve the performance of the compressor because it can reduce strain of the compressor mechanism section and the stator of the revolving electric machine, i.e., the built-in parts, by reducing force received by the built-in part in fixing the compressor mechanism section and the stator of the revolving electric machine to the container.

(b) The invention can fix the built-in part steadily and strongly to the container by generating enough clamping force between the pluralities of neighboring prepared holes of the built-in part.

(c) Accordingly, the invention provides the highly reliable compressor that sustains normal and excessive force generated during operation of the compressor and causes no trouble such as increase of noise and vibration caused by ricketiness of the built-in part.

It is noted that performance of the conventional compressor dropped when strain is generated in the compressor mechanism section in fixing the compressor mechanism section to the container because of increases of leakage loss in which compressed refrigerant gas leaks from the high-pressure side to the low-pressure side and of sliding loss that is generated when a rotator slides against a stator.

For instance, in a conventional rotary compressor, the above-mentioned losses increased when an inner diameter and a vane groove of a cylinder that composes a compressing chamber or a single plane of a frame, a cylinder head and a partition composing the compressing chamber generate strain.

The above-mentioned losses increase also in a conventional scroll compressor when a frame storing an oscillating scroll that forms a compressing chamber and supporting the oscillating scroll a crank-shaft that oscillates the oscillating scroll and a sub-frame supporting the crank-shaft generate strain.

Furthermore, while a stator of a revolving electric machine is fixed to a container in a conventional compressor, its electromagnetic performance dropped and iron loss increased when electromagnetic steel plates generates stress and strain in fixing the stator in which the electromagnetic steel plates are laminated to the container.

BRIEF DESCRIPTION OF THE DRAWINGS

FIGS. 18A and 18B show an upper cylinder part of the compressor shown in FIG. 17, wherein FIG. 18A is a broken plan view of a prepared hole part and FIG. 18B is a longitudinal cross-sectional view;

FIGS. 19A and 19B show a lower cylinder part of the compressor shown in FIG. 17, wherein FIG. 19A is a plan view and FIG. 19B is a longitudinal cross-sectional view;

FIGS. 23A and 23B show a lower cylinder part of the compressor shown in FIG. 22, wherein FIG. 23A is a broken plan view of a prepared hole part and FIG. 23B is a longitudinal cross-sectional view;

FIGS. 25A and 25B show a partition part of the compressor shown in FIG. 24, wherein FIG. 25A is a broken plan view of a prepared hole part and FIG. 25B is a longitudinal cross-sectional view;

FIGS. 28A and 28B show a frame part of the compressor shown in FIG. 27, wherein FIG. 28A is a broken plan view of a prepared hole part and FIG. 28B is a longitudinal cross-sectional view;

FIGS. 30A and 30B show a cylinder part of the compressor shown in FIG. 29, wherein FIG. 30A is a broken plan view of a prepared hole part and FIG. 30B is a longitudinal cross-sectional view;

FIGS. 32A and 32B show a frame part of the compressor shown in FIG. 31, wherein FIG. 32A is a broken plan view of a prepared hole part and FIG. 32B is a longitudinal cross-sectional view;

FIGS. 34A and 34B show an upper cylinder part of the compressor shown in FIG. 33, wherein FIG. 34A is a broken plan view of a prepared hole part and FIG. 34B is a longitudinal cross-sectional view;

FIGS. 38A and 38B show a frame part of the compressor shown in FIG. 37, wherein FIG. 38A is a broken plan view of a prepared hole part and FIG. 38B is a longitudinal cross-sectional view;

FIGS. 40A and 40B show a sub-frame part of the compressor shown in FIG. 39, wherein FIG. 40A is a broken plan view of a prepared hole part and FIG. 40B is a longitudinal cross-sectional view;

DESCRIPTION OF THE PREFERRED EMBODIMENTS

First Embodiment

Figure 1:
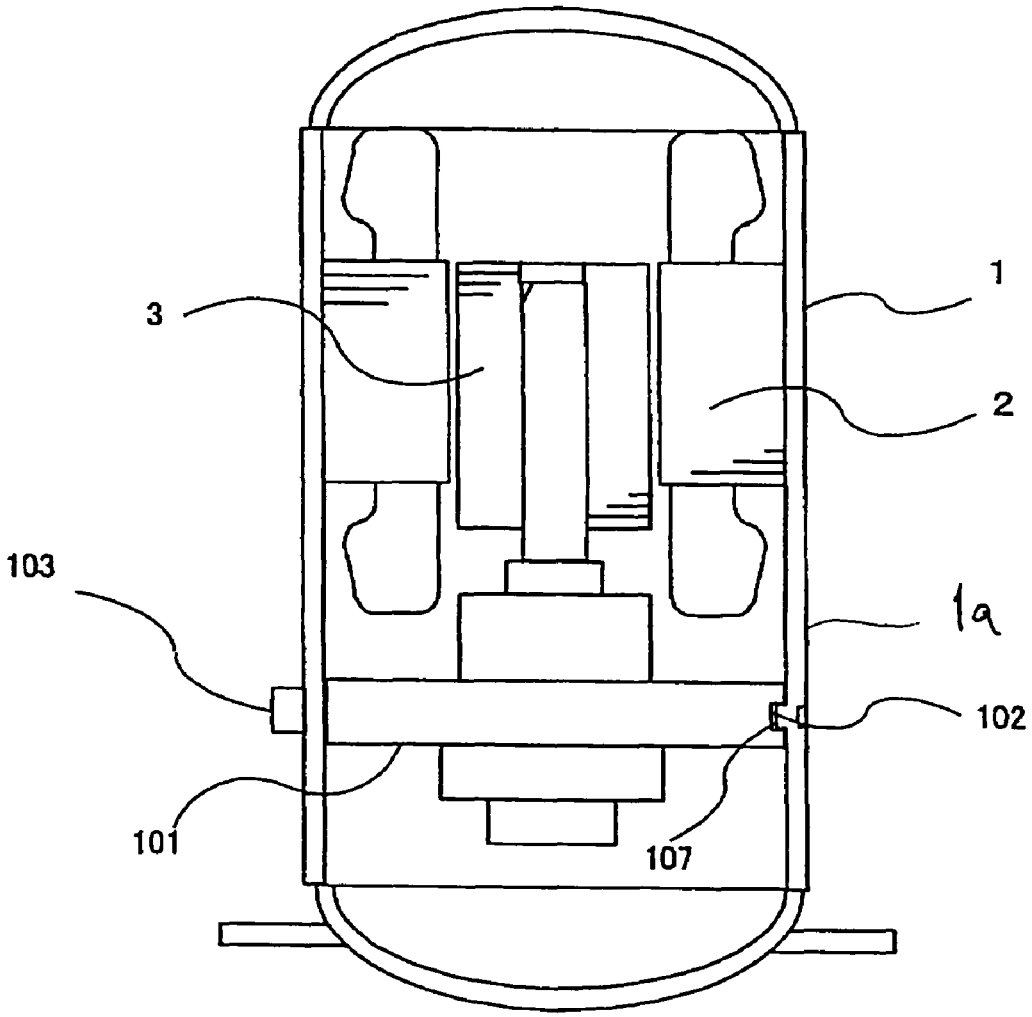
FIG. 1 is a cross-sectional view schematically showing a closed-type compressor according to a first embodiment of the invention.

FIG. 1 is a longitudinal cross-sectional view schematically showing a closed-type compressor according to a first embodiment of the invention. In FIG. 1, a compressor mechanism section 101, i.e., one of built-in parts, is built in a closed container 1 and composes compressor means that is stored within the closed container 1 and covers the periphery of a compressing chamber to effect compression. The closed container 1 is connected with an inlet pipe 103 for supplying gas to be compressed to the compressor mechanism section 101. It is noted that an electric motor that is a rotary machine for supplying driving force to the compressor mechanism section 101 is composed of a stator 2 and a rotor 3. The stator 2 is fixed to the closed container 1 by means of shrink fitting.

Here, a method for fixing the compressor mechanism section 101 to the closed container 1 will be explained.

The compressor mechanism section 101 is in a state of 'clearance fit' with respect to the closed container 1. Here, the term 'clearance fit' means fitting in which an outer diameter of the compressor mechanism section 101 is smaller than an inner diameter of the closed container 1 and no load of the closed container 1 acts on the compressor mechanism section 101 when the compressor mechanism section 101 is disposed within the closed container 1 even when their roundness is taken into account. At this time, the outer diameter and the inner diameter refer mostly to average values of outer diameters and inner diameters measured at two or three points.

FIGS. 2 to 7 are longitudinal cross-sectional views for explaining the compressor mechanism section in the closed-type compressor shown in FIG. 1.

Figure 2:
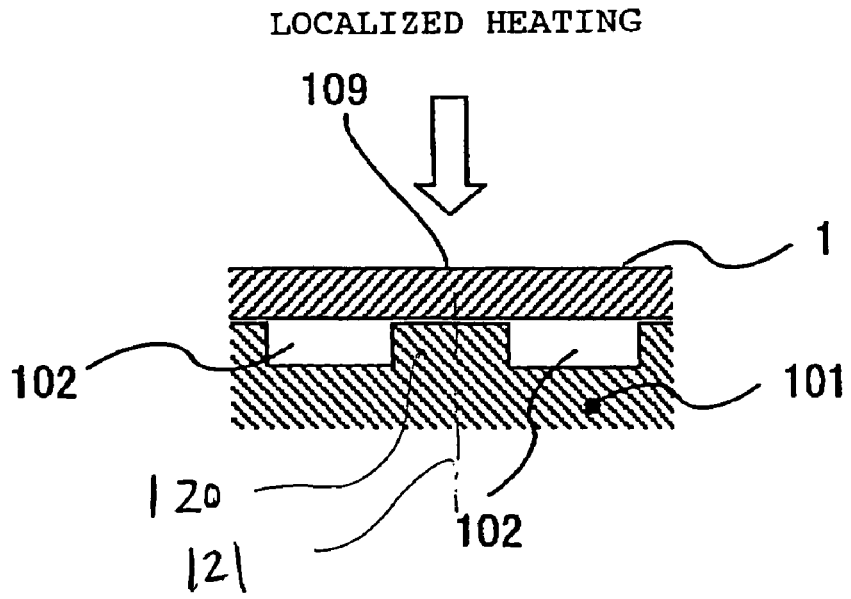
FIG. 2 is a cross-sectional view of a main part showing a structure and a method of a caulking section shown in FIG. 1.

In FIG. 2, prepared holes 102 are formed on an outer peripheral face of the compressor mechanism section 101. Because one set of two prepared holes 102 neighboring in a circumferential direction is provided at three points on the outer peripheral face of the compressor mechanism section 101 at almost equal pitch intervals, a number of prepared hole 102 is six in total. When a region interposed between the set of neighboring prepared holes 102 (a partial region of the outer peripheral face of the compressor mechanism section 101) is called as a 'fixing portion 120', a number of the fixing portions 120 is three in total. It is noted that FIG. 1 shows only one prepared hole 102 because it is a longitudinal cross-sectional view.

Then, as shown in FIG. 2, only a predetermined region (referred sometimes also as a 'heating region' hereinafter) of the closed container 1 at position corresponding to a center 121 of the fixing section 120 (center position between the neighboring prepared holes 102) and containing a center 109 of heating is locally heated from the outside of the closed container 1.

Figure 3:
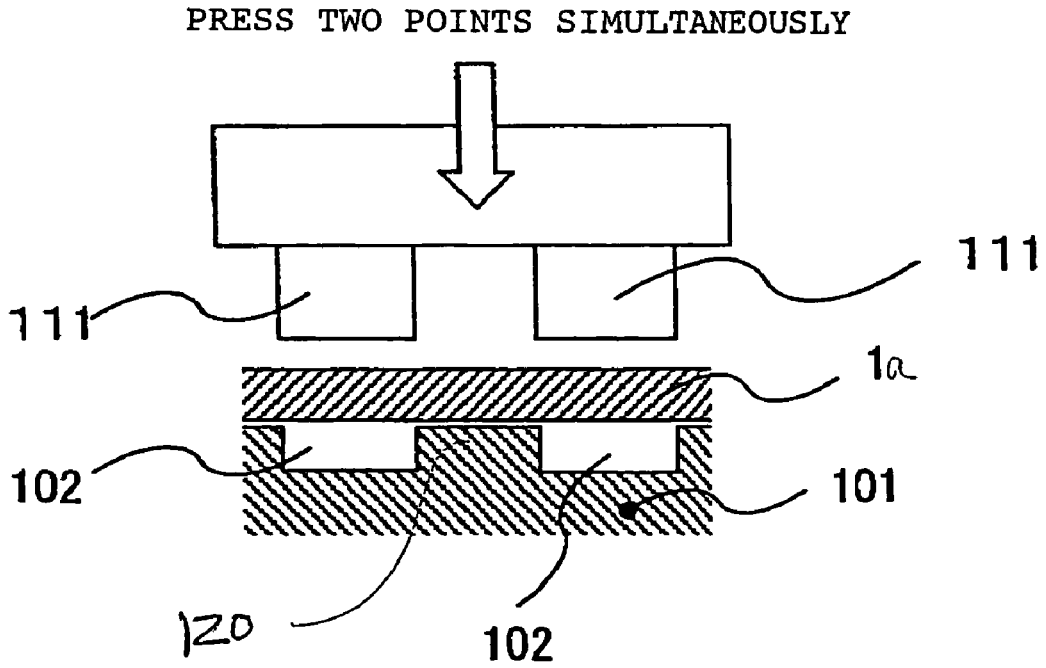
FIG. 3 is a cross-sectional view of the main part showing the structure and the method of the caulking section shown in FIG. 1.

Then, after thermally expanding the closed container 1 by heating, a pressing jig 111 is pressed against the closed container 1 from the outside of the closed container 1 as shown in FIG. 3. At this time, the pressing jig 111 has a columnar shape having an outer diameter that is equal to or slightly smaller than an inner diameter of the prepared hole 102 and has a flat end. Furthermore, two of the pressing jigs 111 compose one set in the same manner as the prepared holes 102 and a gap between the pressing jigs 111 is almost equal to the gap between the neighboring prepared holes 102.

Figure 4:
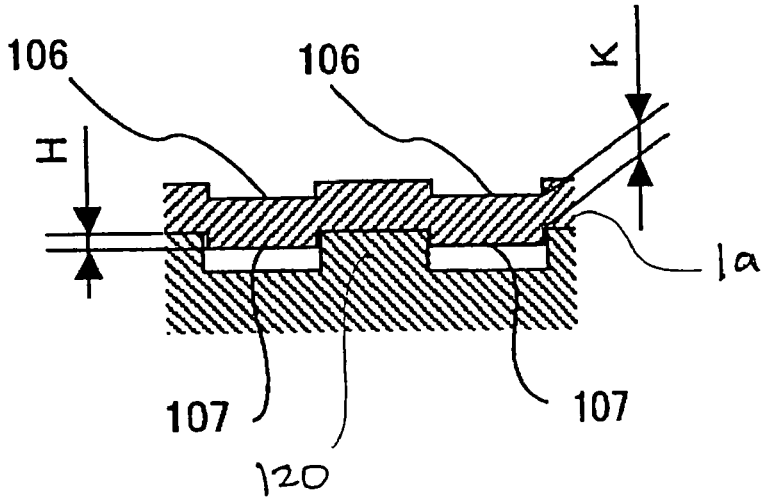
FIG. 4 is a cross-sectional view of the main part showing the structure and the method of the caulking section shown in FIG. 1.

Accordingly, when the two pressing jigs 111 are pressed against the closed container 1 simultaneously from the outside of the closed container 1 as shown in FIG. 4, a container wall 1*a* of the closed container 1 plastically deforms and its inner side enters the prepared holes 102, forming two convex portions (container convex portions) 107, i.e., two 'caulking points'. The plurality of neighboring caulking points (here, two points) will be referred to as 'caulking sections 107) hereinafter.

It is noted that the caulking sections 107 are formed by pressing the pressing jigs against the outer peripheral face of the compressor mechanism section 101 at three points in the circumferential direction thereof almost simultaneously.

Figure 5:
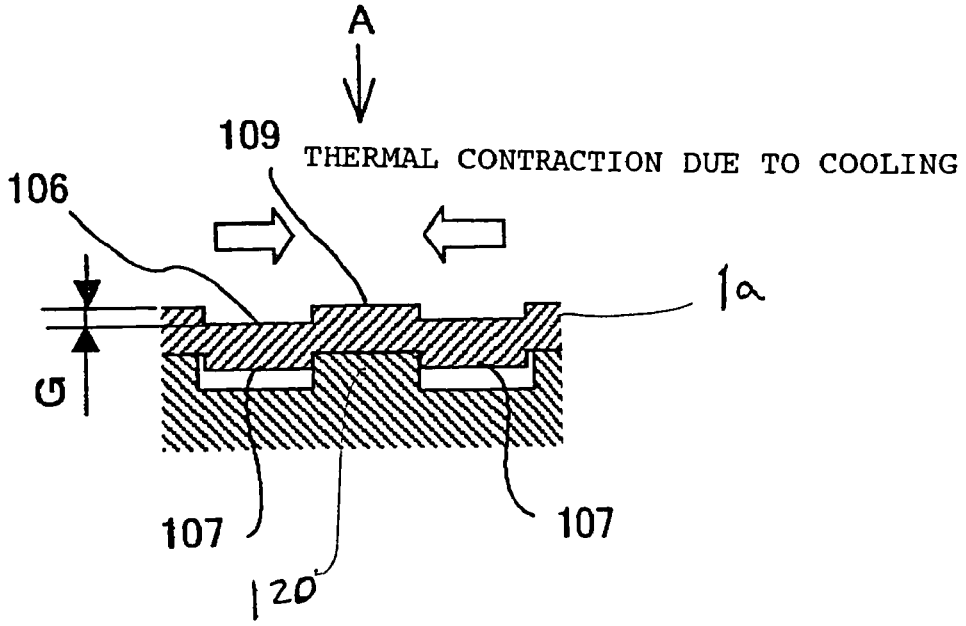
FIG. 5 is a cross-sectional view of the main part showing the structure and the method of the caulking section shown in FIG. 1.

Then, when the closed container 1 that has been thermally expanded is cooled down, the two convex portions 107 of the container wall 1*a* clamp the fixing section 120 of the compressor mechanism section 101 because the caulking sections 107 (two convex portions 107) are drawn to the center of heating 109 due to thermal contraction as shown in FIG. 5.

That is, one set of two neighboring prepared holes 102 that is arranged in the circumferential direction of the outer peripheral face of the compressor mechanism section 101 by the fixing section 120 in this configuration clamps the fixing section 120 in the circumferential direction, so that the compressor mechanism section 101 is fixed to the closed container 1. Accordingly, because the compressor mechanism section 101 is fixed to the closed container 1 not by the force in the radial direction like the conventional methods of welding and press fitting but by the clamping force in the circumferential direction, strain given to the compressor mechanism section 101 is reduced. Furthermore, because no hole is made through the closed container 1, there is no possibility of mixing in foreign materials such as sputters and of leaking refrigerant.

In FIG. 4, the convex portions 107 are formed on the inner peripheral face of the container wall 1*a* of the closed container 1 and concave portions 106 are formed on an outer peripheral face thereof. An inner diameter of the concave portion 106 is equal to the outer diameter of the pressing jig 111.

Figure 6:
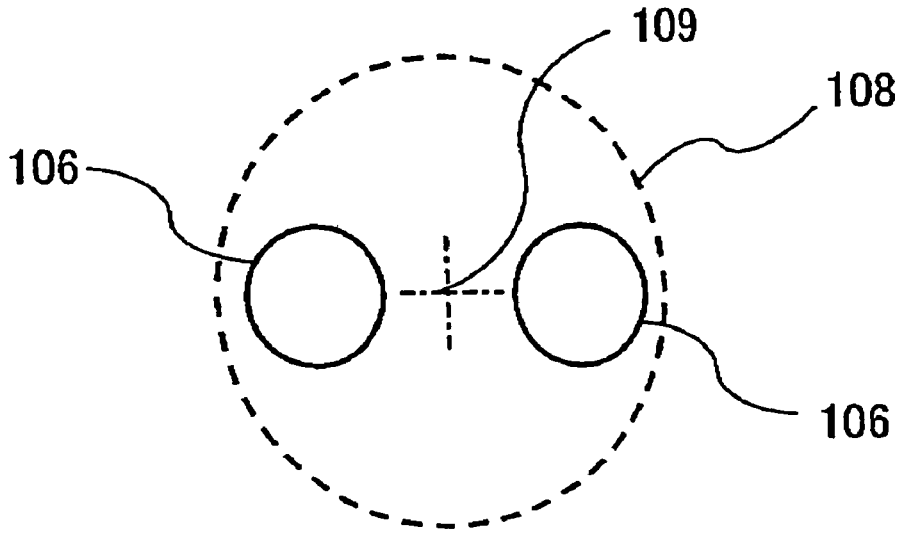
FIG. 6 is a schematic view of the caulking section shown in FIG. 1, seen from the outside of a closed container.

FIG. 6 is a diagrammatic plan view of the container wall 1*a* of the closed container 1 taken in the direction A of an arrow in FIG. 5, i.e., seen from the outside of the closed container 1. The two neighboring concave portions 106 are formed on the outer peripheral face of the container wall 1*a*. They are provided at three points around the circumference. In FIG. 6, a predetermined circular region centering on the center of heating 109 (shown by a dot chain line) is a heating region 108 (shown by a broken line) where heat caused by the local heating affects.

A material forming the closed container 1 is iron (including steel) in general. A yield point of iron sharply drops from around 600° C. Temperature where the yield point begins to sharply drop will be referred to as 'softening temperature' hereinafter. That is, the softening temperature of iron is 600° C. Temperature in pushing is preferable to be more than a material softening temperature and less than a melt point thereof in order to lower rigidity of the closed container 1 and to lower a pushing force for forming the convex portion 107 in pressing the closed container 1 by the pressing jig 111 and to lower the yield point of the material of the closed container 1 to efficiently deform into a predetermined shape.

Because spring-back of the closed container 1 in the radial direction (return of the convex portion 107 in the radial direction in this case) after plastic deformation of the closed container 1 is reduced by lowering the yield point by heating, a predetermined 'pushed amount' is efficiently and steadily assured. Here, the pushed amount is a depth of the convex portion 107 entering the prepared hole 102 (indicated by 'H' in FIG. 4).

The material of the closed container 1 is iron (including steel) as described above and its softening temperature is 600° C. A melting point of iron is around 1560° C. Therefore, the local heating temperature is preferable to be more than 600° C. and less than 1500° C. If a material other than iron is used, the heating temperature changes and is set at temperature more than temperature where the material softens and less than its melting point.

Because the heating region 108 covers all of the concave portions 106 against which the pressing jigs 111 are pressed, the convex portions 107 are steadily formed and the pushing force for forming the convex portions 107 is reduced by using the above-mentioned characteristics of the material of the closed container 1 at high temperature, allowing the strain otherwise generated in the compressor mechanism section 101 during assembly to be reduced.

Still more, because the center of heating 109 of the closed container 1 is set on a center 121 of the two prepared holes 102 (see FIG. 2), the convex portions 107 that have been formed steadily on the closed container 1 thermally contract toward the center of heating 109 as the closed container 1 cools down. Therefore, the fixing section 120 (portion between the neighboring prepared holes 102) of the compressor mechanism section 101 is strongly clamped by the two neighboring convex portions 107.

The compressor mechanism section 101 is fixed to the closed container 1 by thus steadily forming the convex portions 107 on the closed container 1 and clamping the fixing section 120 (between the prepared holes 102) of the compressor mechanism section 101 by the convex portions 107 of the closed container 1.

Therefore, even if the compressor mechanism section 101 is fixed to the closed container 1 by means of the 'clearance fit', it becomes possible to realize the strong fixation (or more correctly, the fixation of the compressor mechanism section 101 to the closed container 1) that can sustain normal and excessive force generated during operation of the compressor and that causes no ricketiness. Then, because the clearance fit allows the force for pressing the compressor mechanism section 101 in the radial direction that has acted in the conventional methods of welding or press fit to be eliminated after completing the fixation, the strain of the compressor mechanism section 101 may be reduced, improving the performance of the compressor.

Figure 7:
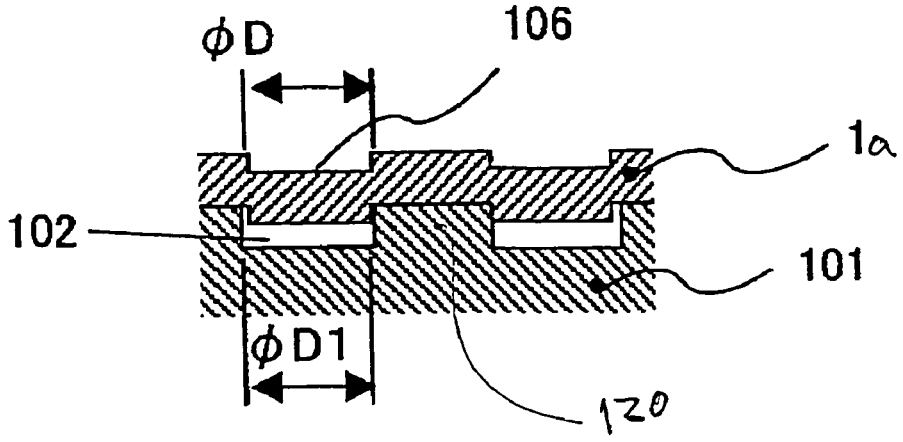
FIG. 7 is a cross-sectional view of the main part showing the structure of the caulking section shown in FIG. 1.

The compressor mechanism section 101 is supported in an axial direction of the compressor not only by the clamping of the convex portions 107 of the closed container 1 but also by rigidity of the convex portion 107 itself. Therefore, a dimension ϕD1 of an inner diameter of the prepared hole 102 of the compressor mechanism section 101 shown in FIG. 7 is a design item to be selected so as to meet with specifications of strength against pull-out in transporting or dropping the compressor in which acceleration in the axial direction occurs.

For example, when a necessary pull-out strength is supposed to be 1500 kgf and when the caulking section composed of the two neighboring caulking points is disposed at three points in the circumferential direction, i.e., when the six caulking points are provided in total, the pull-out strength will be '$\pi\times32/4\times24\times$six points=1018 kgf' when the inner diameter ϕD1 of the prepared hole 102 is ϕ3 mm, where a rupture strength of the closed container 1 is 24 kgf/mm$^2$. Accordingly, it does not meet with the specification of necessary pull-out strength. Then, when the inner diameter ϕD1=ϕ4 mm, the strength becomes '$\pi\times42/4\times24\times$six points=1810 kgf', fully meeting with the specification of the pull-out strength. Thus, the inner diameter ϕD1 of the prepared hole 102 that satisfies the specification of the pull-out strength is set in correspondence to a number of the caulking points.

It is noted that although the case of arranging the two neighboring prepared holes 102 in the circumferential direction of the outer peripheral face of the compressor mechanism section 101 as the fixing section 120 has been described above, an arranging direction is not limited only to the circumferential direction. Because the prepared holes 102 can generate the clamping force even when the arranging direction is the axial direction of the compressor mechanism section 101 (orthogonal to the circumferential direction) or any direction different from that, the prepared holes 102 can strongly fix the compressor mechanism section 101 without increasing its strain. However, it is preferable to arrange the two prepared holes 102 in the circumferential direction because the more the number of convex portions 107 that receive load in the axial direction, the stronger the strength against pull-out becomes as described above.

More specifically, when the caulking section composed of the two neighboring caulking points in the circumferential direction is provided at three points around the circumference, i.e., when the six caulking points are provided, the force in the axial direction caused during transportation is supported by all of the six points. When the caulking section composed of the two neighboring caulking points in the axial direction is provided at three points around the circumference on the other hand, the force in the axial direction is supported substantially by one point in one caulking section, i.e., by three points of the three caulking sections, even though there are six caulking points, because the two caulking points in one caulking section overlap in the axial direction. In such a case, the inner diameter ϕD1 of the prepared hole 102 must be enlarged to be more than that when they are arranged in the circumferential direction in order to satisfy the specification of the pull-out strength.

The number of the neighboring prepared holes 102 on the outer peripheral face of the compressor mechanism section 101 is not also limited to be two. When three or more prepared holes 102 are disposed in proximity, a region surrounded by them is clamped as a fixing section 120. Then, even if the number of the prepared holes 102 is any number, convex portions 106 formed at a plurality of points cool down and contract toward the center of heating 109 if the container wall 1*a* of the closed container 1 corresponding to a center of the plurality of disposed prepared holes 102 is set as the center of heating 109, so that the fixing section 120 (between the prepared holes 102) may be clamped by all of the formed convex portions 107.

Figure 8:
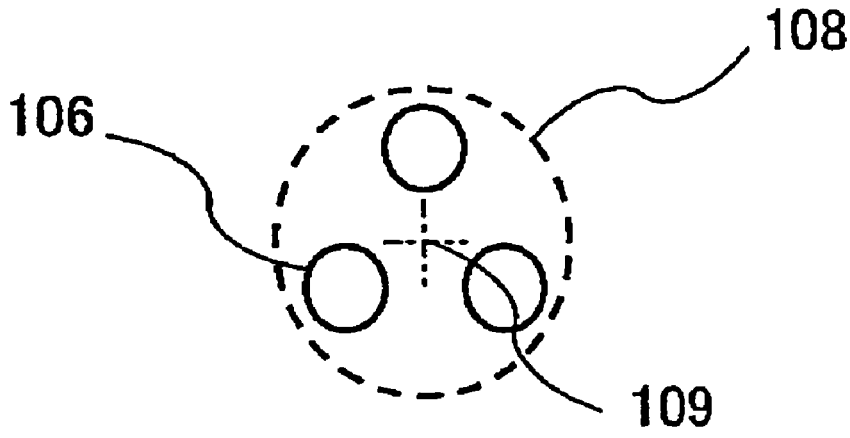
FIG. 8 is a pictorial diagram of an exemplary disposition, seen from the outside of the closed container, when a number of neighboring caulking points is three.

FIG. 8 is a pictorial diagram of the compressor, seen from the outside of the closed container 1 in the radial direction, when the number of neighboring caulking points is three, wherein the three caulking points indicated by concave portions 106 are disposed in triangle and the heating region 108 is formed so as to contain all of the three point by setting their center as the center of heating 109.

Figure 9:
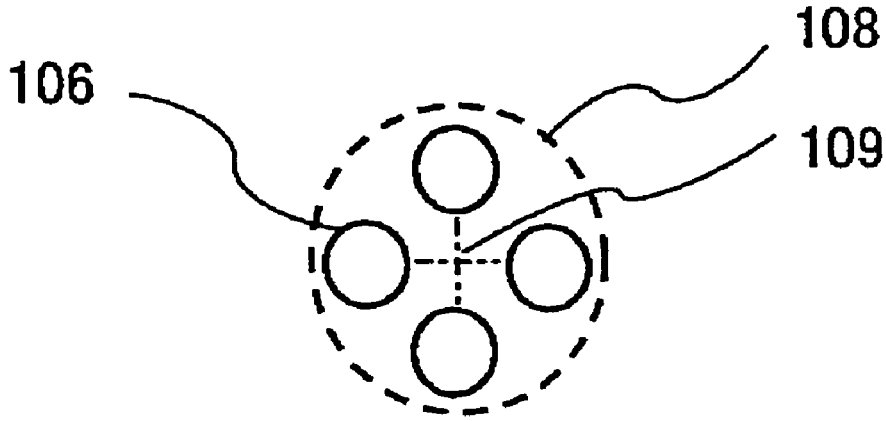
FIG. 9 is a pictorial diagram of an exemplary disposition, seen from the outside of the closed container, when a number of neighboring caulking points is four.

FIG. 9 is a pictorial diagram of the compressor when the number of neighboring caulking points is four, wherein the four caulking points indicated by concave portions 106 are disposed in rectangular.

Although the direction in which two or more concave portions 102 are arranged may be any direction as described above in the case of two points, it is preferable to arrange such that more concave portions 106 receive the load in the axial direction from the point of view of the pull-out strength. In case of a caulking section composed of three points for example, it is preferable to arrange two points on a lower side (or an upper side) in a vertical direction as shown in FIG. 8. In case of a caulking section composed of four points, it is preferable to arrange in a diamond shape as shown in FIG. 9 because a number of support points (convex portions) as against force in the axial direction may be increased as compared to a case of arranging four points in a shape shifted by 45° from the arrangement of FIG. 9.

A number of caulking points in one caulking section may be increased or a number of caulking sections provided around the whole circumference may be increased to satisfy the required specification of the pull-out strength. Although the three caulking sections each composed of the two neighboring caulking points have been provided in the embodiment described above, the caulking sections each composed of the three caulking points arranged in triangle as shown in FIG. 8 may be formed at four points around the whole circumference, i.e., twelve caulking points in total may be formed, if the compressor is a large-scale compressor.

It is noted that the arrangement of the pressing jigs 111 is changed corresponding to the arrangement of the prepared holes 102.

It is preferable to carry out the local heating before caulking in a short time in order not to cause unnecessary thermal strain in the closed container 1 and to improve tact of an assembled apparatus. A heat source that is capable of increasing the temperature of the closed container 1 to necessary temperature in a short time is preferable. Heating power of arc welding such as a TIG welder, a burner, laser and high frequency heating for example may be utilized.

The arc welder such as the TIG welder has merits that its facility cost is inexpensive and that it can heat the closed container 1 locally to high temperature as compared to the arc. However, it tends to generate a blow hole when the temperature of the center of heating 109 becomes too high, putting the closed container 1 into a half-melt state, and when the pressing jig 111 is pressed against the half-melt part.

Although a facility cost of the high frequency heater is expensive, it is very suitable as the heating source of the embodiment because its heating stability and controllability are good and it can heat stably and locally in a short time when its shape of coils and a capacity of power source are adjusted.

Although a facility cost of heating power such as the burner is inexpensive, it is rather effective in heating a wide region, i.e., when the heating region 108 is wide because the diameter ϕD1 of the prepared hole 102 is large or the region between the prepared holes 102 is wide, because it is unable to achieve localized heating.

Because a clearance is provided between the closed container 1 and the compressor mechanism section 101 in the radial direction as the clearance fit of the compressor mechanism section 101 to the closed container 1 in the first embodiment, heat caused by the heating from the outside of the closed container 1 hardly propagates to the compressor mechanism section 101.

However, if the heating time is long, the heat may propagate to the compressor mechanism section 101, i.e., the built-in part, during heating of the closed container 1, heating the compressor mechanism section 101 to high temperature. Because the compressor mechanism section 101 also causes thermal contraction as it cools down together with the closed container 1 that causes thermal contraction when it cools down after forming the convex portions 107, clamping force of the convex portions 107 of the closed container 1 may decrease, causing ricketiness.

Therefore, the heating must be carried out in a short time. Then, the capacity of the power source of the high frequency heater may be determined so as to increase to a predetermined temperature in a short time.

When a thickness of plate of the closed container 1 is 2 mm, the heating temperature is 800 to 1100° C., the heating region 108 is ϕ 12 mm, a device tact until completing caulking of this configuration is 12 seconds and only three seconds is given in a heating process, setting the capacity of the power source at around 10 kw per one caulking section allows the above-mentioned time tact to be satisfied and the compressor mechanism section 101 to be fixed without reducing the clamping force due to the propagation of heat.

When the thickness of plate of the closed container 1 is 2 to 4 mm for example, the heating time is appropriate to be 3 to 4 seconds when the heating temperature is desirable to be 800 to 1100° C., to be 1 to 2 seconds when the temperature is as high as 1100 to 1500° C. and to be 5 to 6 seconds when the temperature is only 600 to 800° C. because of the capacity of the power source or the like. Then, fixation of the compressor mechanism section 101 may be achieved by sufficient and stable clamping force of the convex portions 107 steadily formed.

When the inner diameter of the concave portion 106 is set as ϕD as shown in FIG. 7, this ϕD is equal to the outer diameter of the pressing jig 111. The container wall 1*a* of the closed container 1 may be pushed out to the prepared hole 102 and the convex portion 107 may be formed by plastically deforming the container wall 1*a* by a small pressing force by making the inner diameter ϕD of the concave portion 106 (=Outer diameter of the pressing jig 111) equal to the inner diameter ϕD1 of the prepared hole 102 (ϕD=ϕD1) or less (ϕD<ϕD1).

It is noted that when the outer diameter ϕD of the pressing jig 111 is made larger than the inner diameter ϕD1 of the prepared hole 102, the pressing jig 111 presses the container wall 1*a* also against the outer peripheral face of the compressor mechanism section 101 around the prepared hole 102 in pressing the closed container 1. Therefore, a pressing force necessary for plastically deforming the container wall 1*a* to form the convex portion 107 increases. As a result, strain is generated in the compressor mechanism section 101, lowering the performance of the compressor.

When the outer diameter ϕD of the pressing jig 111 is too small as compared to the inner diameter ϕD1 of the prepared hole 102 in contrary, the convex portion 107 will not be formed correctly. That is, while a support point of the compressor mechanism section 101 against the pressing force is an aperture edge (ϕD1) of the prepared hole 102, the inner side of the closed container 1 turns out to be a convex portion whose shape is close to 'dull globular shape' when ϕD is too small, reducing contact points between the convex portion 107 of the closed container 1 and the inner periphery of the prepared hole 102 of the compressor mechanism section 101. As a result, enough clamping force cannot be obtained, causing 'ricketiness' of the compressor mechanism section 101 to the closed container 1 while using in a long term.

When noise and vibration tests were tried on several compressors in which ϕD1 is fixed and ϕD is changed and test results were consolidated, a noise and vibration problem that is thought be caused by the ricketiness became remarkable when ϕD/ϕD1 is equal to or less than 0.5. Accordingly, the relationship of the dimension of the inner diameter ϕD1 of the prepared hole 102 with that of the outer diameter ϕD of the pressing jig 111 (inner diameter of the concave portion 106) must be what satisfies a relationship of "1≧D/D1'>0.5". It becomes possible to steadily form the convex portion 107 of the closed container 1 and to achieve the strong fixation that sustains to normal and excessive force that are generated during operation of the compressor and that causes no ricketiness during the long term use of the compressor by satisfying this relationship.

Figure 10:
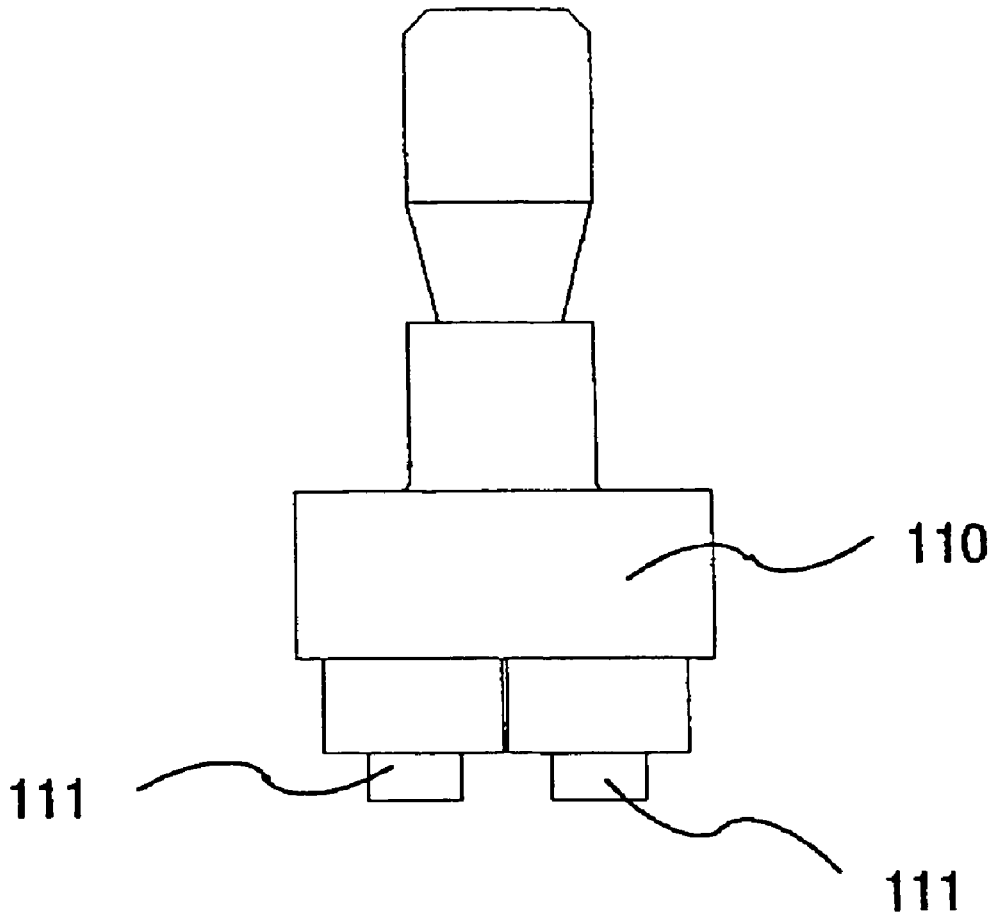
FIG. 10 is a schematic illustration showing a caulking punch for forming a convex portion on the closed container.
Figure 11:
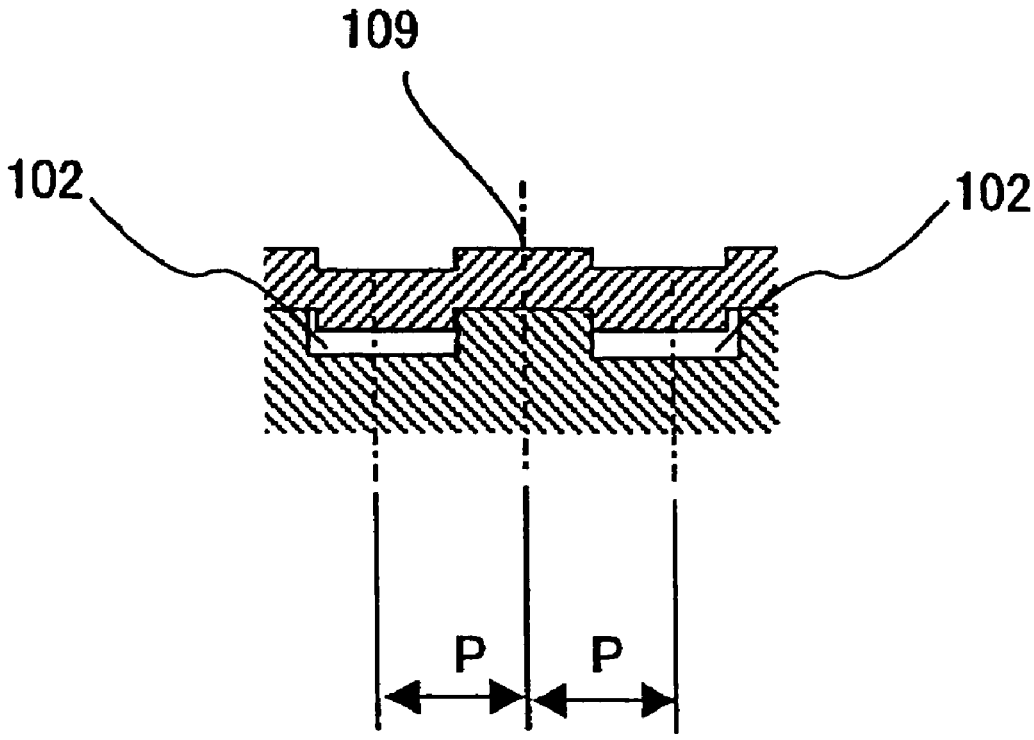
FIG. 11 is a pictorial drawing for explaining a structure of the caulking section shown in FIG. 1.
Figure 12:
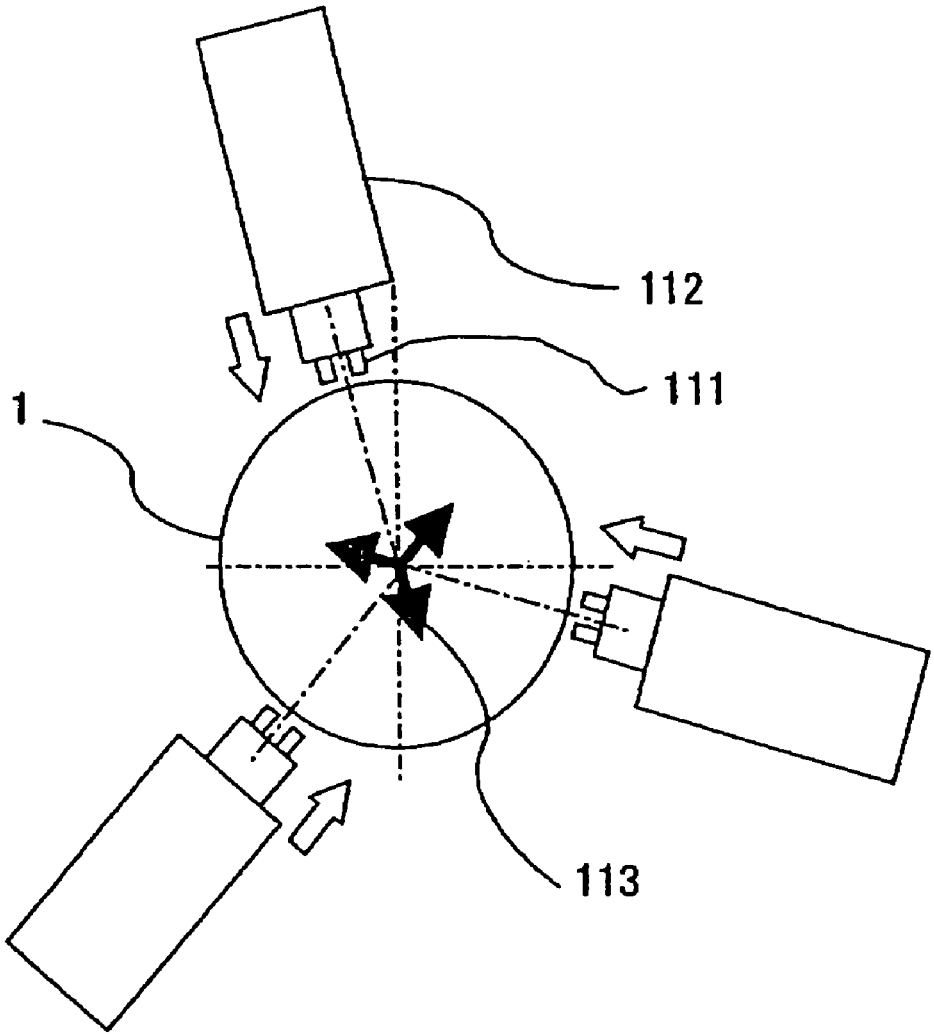
FIG. 12 is a schematic illustration showing devices for forming the caulking sections.
Figure 13:
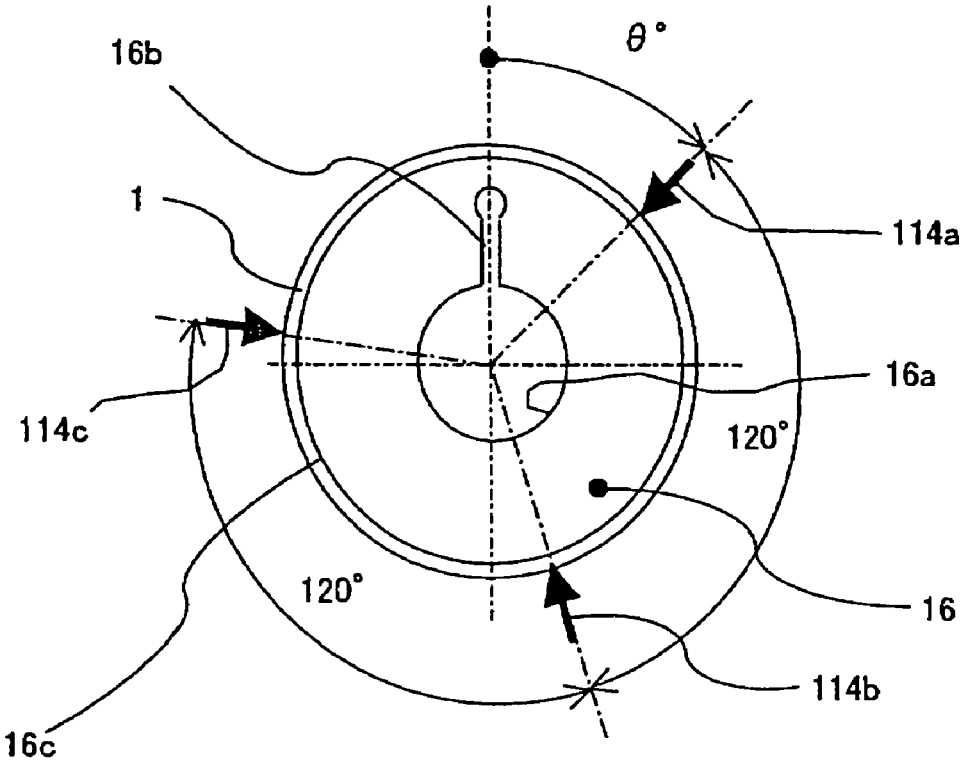
FIG. 13 is a pictorial diagram for explaining phases of a plurality of caulking sections.
Figure 14:
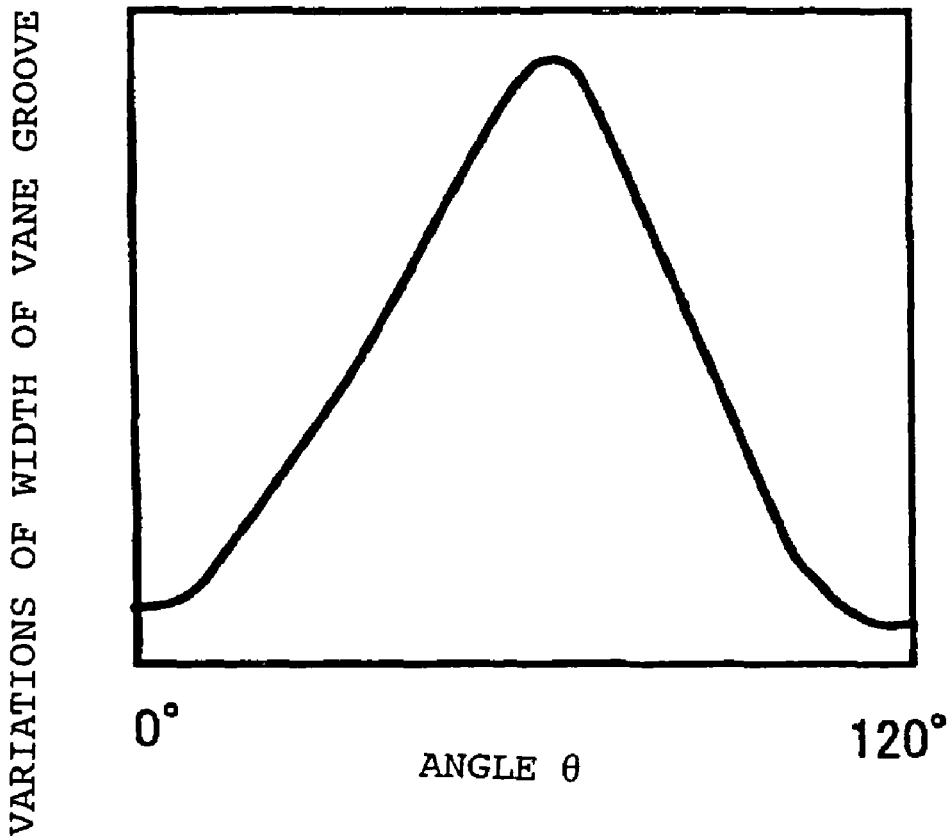
FIG. 14 is a graph showing variations of width of a cylinder vane groove caused when a phase of the caulking section is changed.
Figure 15:
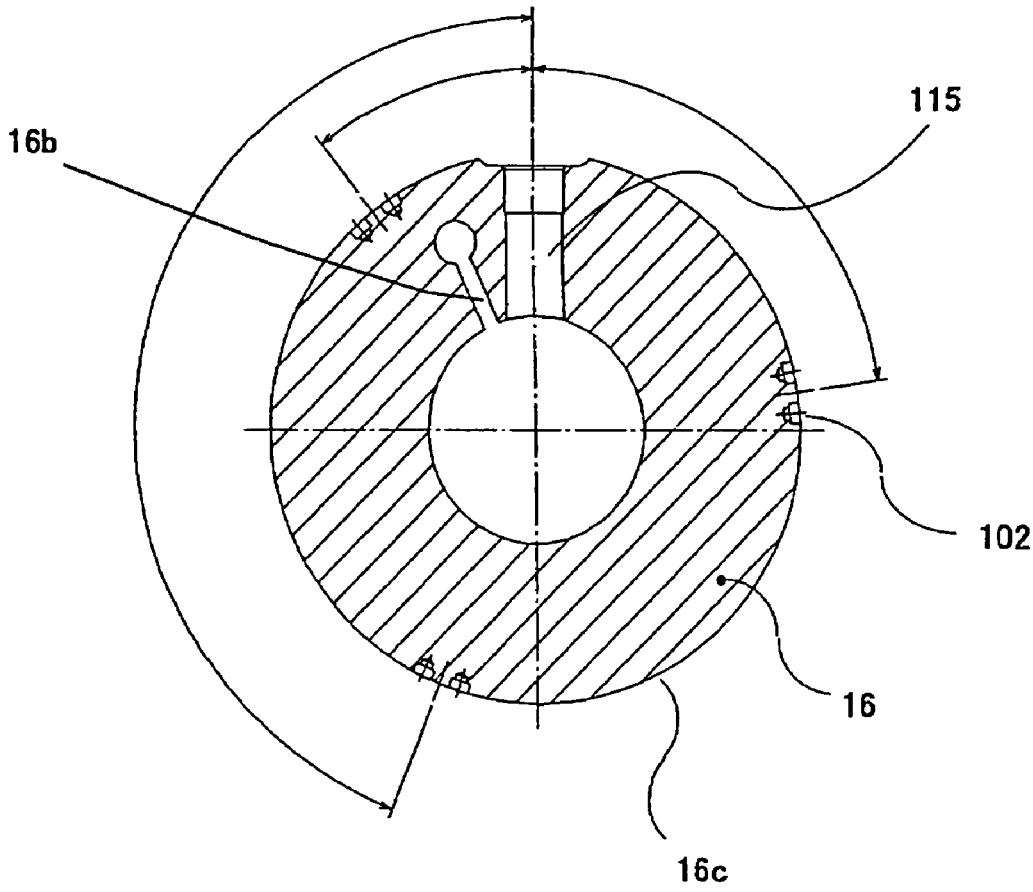
FIG. 15 is a pictorial diagram for explaining a process for making prepared holes based on an inlet hole of the cylinder.

FIG. 10 is a schematic illustration showing a caulking punch for forming the convex portion 107 on the closed container 1, FIG. 11 is a longitudinal cross-sectional view for explaining the caulking section shown in FIG. 1, FIG. 12 is a schematic illustration showing devices for forming the caulking sections, FIG. 13 is a transverse cross-sectional view of the cylinder part for explaining phases of a plurality of caulking sections, FIG. 14 is a graph showing variations of width of a cylinder vane groove caused when a phase of the caulking section is changed, and FIG. 15 is a cross-sectional view for explaining a process for making prepared holes based on an inlet hole of the cylinder.

In FIG. 10, the pressing jig 111 has the flat end. Then, it becomes possible to form the convex portion 107 by a small pressing force by plastically deforming the container wall 1*a* by sandwiching the container wall 1*a* of the closed container 1 between corner sections of the end face of the pressing jig 111 and outer edge corners of the aperture of the prepared hole 102 on the compressor mechanism section 101, reducing strain to be otherwise generated in the compressor mechanism section 101.

It is preferable to use one in which the plurality of pressing jigs 111 is fixed to a base portion 110 because pressing needs to be simultaneously applied to the plurality of caulking points in one caulking section. When two neighboring points are to be caulked simultaneously for example, it becomes possible to form two caulking points simultaneously by one time of pressing by fixing two pressing jigs 111 to one base portion as shown in FIG. 10. When there are three prepared holes in the fixing section, it becomes possible to form three caulking points by one time of pressing by fixing three pressing jigs 111 to one base portion 110.

The whole device in which the pressing jigs 111 are fixed to the base portion 110 will be referred to as a 'caulking punch' hereinafter. It is possible to suppress a maintenance cost of the caulking punch by arranging such that the pressing jig 111 may be fixed to the base portion 110 by a bolt or the like and that only the pressing jig 111 is removable.

It is noted that wear and deterioration of the corners of the end of the pressing jig 111 may be suppressed and maintenanceability of the caulking punch may be improved by using a heat resistance material such as a hot forging tool steel, a cold forging tool steel or ceramics.

As described above, while the invention generates the force for claming the fixing section 120 (between the plurality of neighboring prepared holes 102) by the convex portions 107 by the thermal contraction of the closed container 1 to fix the compressor mechanism section 101, i.e., the built-in part, to the closed container 1, it is possible to adjust the clamping force generated between the plurality of prepared holes 102 of the built-in part by changing a degree of thermal contraction of the closed container 1 by adjusting the distance between the plurality of prepared holes 102.

When the distance between the plurality of prepared holes 102 of the fixing section 120 is wide, the degree of thermal contraction becomes large after simultaneously caulking the plurality of points and the force of the convex portions 107 for clamping the fixing section 120 becomes strong, increasing the power for fixing and holding the compressor mechanism section 101. However, because the heating region 108 must be widened, there arise drawbacks that the closed container 1 causes thermal strain, worsening roundness of its inner diameter, and that the compressor mechanism section 101 causes strain because part of the compressor mechanism section 101 other than the caulking points is pressed, thus reducing the performance of the compressor.

When the distance between the plurality of neighboring prepared holes 102 of the fixing section 120 is narrow on the other hand, it is possible to prevent the compressor mechanism section 101 from causing strain by the thermal strain of the closed container 1 because the heating region 108 may be small. However, the clamping force of the convex portions 107 of the closed container 1 becomes small.

A shortest distance between the center of heating 109 and a center 121 of the prepared hole 102 will be denoted by P as shown in FIG. 11. Here, the center of heating 109 refers also to a center between the plurality of prepared holes 102 arranged in close proximity.

As for an allowable upper limit of P, the roundness changes largely when the heating region 108 is widened such that P/D1 is 2 or more ($2 \geqq P/D1$) from a measured result of the roundness of the inner diameter of the closed container 1 before and after heating when the diameter of the prepared hole 102 is denoted as $\phi D1$ as described above.

As for an allowable lower limit of P on the other hand, no problem of noise and vibration caused by ricketiness occurred when P/D1 was 0.6 or more ($0.6 \leqq P/D1$) from the results of noise and vibration test in the specification in which three or four caulking sections, each composed of two to four caulking points, were provided at almost equal pitches in the circumferential direction.

Accordingly, it is preferable to set the distance between the neighboring prepared holes 102 so as to satisfy a relationship of "$0.6 \leqq P/D1 < 2$". A strong fixation that sustains normal and excessive force generated during operation of the compressor and causes no ricketiness in a long-term use of the compressor by satisfying this relationship. It is noted that even when the distance between the plurality of prepared holes 102 is constant, it is possible to adjust the clamping force generated between of prepared holes 102 of the built-in part by changing a degree of thermal contraction of the closed container 1 by adjusting the capacity of heating power source, i.e., a heating capacity.

The degree of push H that is a depth of the convex portion 107 entering the prepared hole 102 shown in FIG. 4 must at least be a degree that prevents the convex portion 107 from being pulled out of the prepared hole 102 when pressure is applied to the inside of the closed container 1 during operation of the compressor and the closed container 1 expands in the radial direction by the internal pressure.

When an internal pressure of 42 $kgf/cm^2$ is applied to a closed container having a plate thickness of 2 mm and an internal diameter of 100 mm for example, the closed container expands by about 20 μm on one side in the radial direction toward the outside. Therefore, the degree of push H must be at least 0.02 mm or more. However, because hertz stress caused by the clamping force acting on the convex portion 107 becomes large when the degree of push H is so small, it is preferable to assure 0.1 mm or more.

By the way, when the degree of push H increases, a thickness K of a least thickness portion of the container wall 1*a* of the closed container 1 decreases. Here, the thickness K of the least thickness portion refers to a distance between an outer peripheral base of the convex portion 107 formed on the container wall 1*a* of the closed container 1 and an inner peripheral bottom base of the concave portion 106 (see FIG. 4). A depth G of the concave portion 106 is basically equal to a length of a protrusion of the convex portion 107 of the closed container 1 from the inner peripheral face of the container (see FIG. 5). Then, as the depth of the concave portion 106 increases, the degree of push H increases.

Then, the thickness K of the least thickness portion is determined by the depth G of the concave portion 106. The concave portion 106 is always formed in order to assure the degree of push H and the thickness K of the least thickness portion is reduced to a value smaller than the thickness of the container wall 1*a* of the closed container 1 by an amount almost equal to the depth G of the concave portion 106.

When the depth G of the concave portion 106 is increased to increase the degree of push H, the thickness K of the least thickness portion of the closed container 1 becomes thin, causing a possibility that a leak occurs from the least thickness part when the internal pressure acts on the closed-type compressor. Accordingly, the maximum allowance of the depth G of the concave portion 106 is determined within a range satisfying a pressure resistant strength required to the closed container.

Normally, the pressure resistant strength of the closed container may be fully satisfied when the thickness K of the least thickness portion is equal to or more than 0.5 times of the thickness of the closed container 1. When the thickness of the container wall 1*a* of the closed container 1 is 2 mm for example, the depth G of the concave portion 106 may set to be 1 mm or less. Thus, the depth G of the concave portion 106 is set to be equal to or less than 0.5 times of the thickness of the closed container 1. Accordingly, the degree of push H is equal to or less than 0.5 times of the thickness of the container wall 1*a* of the closed container 1.

However, a closed-type compressor used in a cycle using carbon dioxide that have come to be seen lately in a market by being utilized for a hot water supplier or the like has a closed container whose thickness is so high as 6 mm or 8 mm because carbon dioxide is extremely high pressure refrigerant. Although a depth G of a concave portion 106 may be allowed to be 0.5 times of the thickness in the closed container whose thickness is so high, a considerable pressing force is required to press the container wall 1*a* to 3 mm to 4 mm of depth. Then, the compressor mechanism section may cause strain due to the pressure. Therefore, it is enough if a degree of push equal to or less than 0.5 times of the thickness of the container wall 1*a* of the closed container 1 or of around 1 mm is assured as an actual product even when it is the closed-type compressor using the extremely high-pressure refrigerant such as carbon dioxide.

Although the caulking sections are formed at three points of the outer periphery of the compressor mechanism section 101, preferably the caulking sections are arranged at the three points at equal pitches of 120°. FIG. 12 is a schematic illustration showing devices and states for forming the caulking sections. In FIG. 12, three pressing machines 112 are arranged around the closed container 1. The caulking punch is attached to an end of each pressing machine 112 and the pressing jig 111 plastically deforms the closed container 1 by directly contacting the container wall 1*a* of the closed container 1.

Because the caulking sections, each forming the two caulking points at one point, are formed at three points in the circumferential direction at this time, six caulking points are formed in total. The pressing force 113 of the pressing jigs 111 given to the closed container by each of the pressing machine 112 acts toward the center of the closed container 1 and strength of each of the three pressing force 113 is equal from each other.

When the three pressing machines 112 are arranged at the equal pitches of 120°, the three caulking sections are arranged at equal pitches of 120° and the three points are pressed in the same time, the three pressing forces 113 balance from each other. Accordingly, the closed container 1 will not move or rotate due to a moment acting on it without preparing jigs for receiving the pressing forces 113. Therefore, the devices for forming the caulking sections may be simplified.

It is noted that caulking sections are formed at four points around the compressor mechanism section 101, it is preferable to provide them at equal pitches of 90°. The pressing forces are balanced from each other by arranging the caulking sections so that each pitch between the caulking sections becomes equal and in its turn, the devices for forming the caulking sections may be simplified.

Actually, although there may be a case when each pitch between the caulking sections is not strictly equal due to variations of facilities and products, basically the caulking sections are designed and produced so as to achieve the equal pitch. Furthermore, although it is most desirable to have the equal pitch, there is no problem and the same effect may be obtained even if each pitch differs more or less if the closed container 1 does not move or rotate, because the pressing force is exerted in plane by the flat end of the pressing jig 111.

In case when the closed-type compressor is a rotary compressor, there is a case of forming prepared holes on an outer peripheral face of a cylinder that is a part forming an outer peripheral wall of a compressing chamber among a plurality of parts composing the compressor mechanism section 101 and of carrying out caulking between the outer periphery of the cylinder and the closed container. FIG. 13 is a transverse cross-sectional view for explaining phases of caulking sections with respect to the cylinder.

In FIG. 13, the cylinder 16 that is one of parts composing compressor means has an inner diameter 16*a* forming the compressing chamber, a vane groove 16*b* whose one end communicates with the inner diameter 16*a* and an outer peripheral face 16*c* on which the fixing sections are formed at three points. It is noted that although not shown, a cylindrical rolling piston eccentric to the inner diameter 16*a* rotates within the cylinder 16, a plate-like vane is fitted into the vane groove 16*b* and an end of the vane always contacts with the outer peripheral face of the rolling piston to form the compressing chamber.

In FIG. 13, an angle θ is an angle indicating a phase of a first caulking section position 114*a* located around the vane groove 16*b* from a reference point of a center line of the vane groove 16*b* when the three caulking sections are arranged at the equal pitches of 120°. A clockwise direction is normal in the figure. Accordingly, the phase of the first caulking section position 114*a* is "θ°", a phase of a second caulking section position 114*b* is "θ+120°" and a phase of a third caulking section position 114*c* is "θ+240°", respectively. Although the caulking sections are described as the first, second and third caulking sections for convenience of the explanation, those three caulking sections are pressed almost in the same time.

Although the invention reduces the strain generated in the compressor mechanism section 101 as compared to the conventional caulking methods involving welding and press fit, it is difficult to totally zero the strain as far as the compressor mechanism section 101 is fixed to the closed container 1.

FIG. 14 is a graph showing variations of width (strain) of the vane groove 16*b* when the phase θ of the first caulking section position 114*a* is changed. while it shows a degree of strain with respect to the changes of the phase θ of the first caulking section, the caulking sections are formed not only one point but at three points at almost equal pitches.

The left end of the graph in FIG. 14 represents when θ=0°, where the phase of the first caulking section position 114*a* is located right above the center line of the vane groove 16*b*, the phase of the second caulking section position 114*b* is located at 120° (in the plus direction of θ) clockwise from the reference point of the vane groove 16*b* and the phase of the third caulking section position 114*c* is located at 120° (in the minus direction of θ) counterclockwise from the reference point of the vane groove 16*b*.

The right end of the graph in FIG. 14 represents when θ=120°, where the phase of the third caulking section position 114*c* is located right above the center line of the vane groove 16*b*. This is substantially the same state with the case when θ=0°.

It can be seen that the variation of the width of the vane groove is smallest when the first caulking section position 114*a* is located on the center line of the vane groove 16*b*, i.e., when θ=0° (substantially the same when θ=120°). Here, the width of vane groove is an average value of widths of four points located on two diagonal lines and the variation is changes of dimension of the groove width from that before the caulking sections are formed to that after formation of the caulking sections.

The variation of the vane groove width is smallest when θ=0° (θ=120°) because the extension of the vane groove 16*b* may be suppressed as a result of caulking the second and third points at the equal pitches of 120° so as to restrict the extension even though a vicinity of an open end of the inner diameter 16*a* of the vane groove 16*b* extends by pressing right above the vane groove 16*b*.

Its effect appears remarkably when $-25° \leqq \theta \leqq 25°$ as seen from FIG. 14. Therefore, in the rotary compressor in which the three caulking sections are arranged on the outer peripheral face 16*c* of the cylinder 16 at the equal pitches of 120°, the variation of the vane groove may be reduced further and the performance of the rotary compressor may be improved by disposing one caulking section position within ±25° from the reference point of the center line of the vane groove.

Many rotary compressors have a vane spring for pressing the vane to the rolling piston as a measure to counter a jump of the vane in starting the compressor and is provided with a hole section, for inserting the vane spring, whose one end opens to the outer peripheral face and the other end communicates with the vane groove in the radial direction of the cylinder in the same phase with the vane groove on the outer peripheral face of the cylinder on the vane groove. Therefore, in such a case, the prepared holes cannot be formed without avoiding the hole section and the caulking section cannot be provided on the center line of the vane groove.

In case of a swing vane rotary compressor in which a vane is integrated with the rolling piston, one caulking section may be provided on a center line of a vane groove of a cylinder.

There is also a normal rotary compressor having no hole section for inserting a vane spring and one caulking section may be provided on the center line of the vane groove. In case of a twin rotary compressor in which two cylinders are disposed in an axial direction thereof for example, compression is effected in both compressing chambers if a vane spring is inserted into either one compressing chamber because an internal pressure of a closed container increases by compression of the side having the vane spring and a vane in the compressing chamber on the side having no vane spring is also pressed against the rolling piston by its internal pressure.

Furthermore, because the compressor holds as a compressor even if one vane spring is missed, the caulking sections are provided so as to fix the cylinder having no vane spring. Then, one caulking section may be provided on the center-line of the vane groove and the other two caulking sections are provided at the locations of ±120° from the center line on the circumference of the cylinder.

While the case of the rotary compressor in which the three caulking sections are provided at the equal pitches of 120° has been described above, it is effective to dispose one caulking section in the vicinity of the center line of the vane groove to suppress the variation of the vane groove even in a rotary compressor in which four caulking sections are arranged at the equal pitches of 90°. Furthermore, it is desirable to dispose the caulking section on the center-line of the vane groove if it is possible having no obstacle such as the hole section.

It is noted that although the strain of the cylinder 16 that affects the performance of the rotary compressor includes not only the vane groove 16*b* but also strain of the inner diameter 16*a*, the strain caused by the vane groove is greater in the changes of the strain with respect to the phase-wise disposition of the caulking sections. Therefore, although the disposition is determined by noticing on this point, the invention is not limited to such determination.

FIG. 15 is a cross-sectional view for explaining a process in making the prepared holes 102 on the outer peripheral face 16*c* of the cylinder 16. In FIG. 15, the cylinder 16 is provided with an inlet port 115 for taking in compression gas to the compressing chamber. While the caulking sections, each having the two neighboring prepared holes 102, are formed at three points on the outer peripheral face 16*c* in the circumferential direction with the equal pitches of 120°, i.e., six prepared holes are formed in total, the reference of the phase of each prepared hole 102 is matched with the center of the inlet port 115.

Then, when the closed container 1 is caulked to the cylinder 16 by the pressing machines 112 (see FIG. 12), the prepared hole 102 may be matched with the phase of the pressing jig 111 with very high precision when the phase of the cylinder 16 with respect to the three pressing machines 112 provided at the equal pitches is determined based on the inlet port 115 (the same with the reference in making the prepared holes 102).

The height and position of the prepared hole 102 may be matched with the pressing jig 111 with very high precision in the same manner with the phases by forming the prepared hole 102 based on the center of the inlet port 115 and by positioning the pressing machine 112 in the axial direction based on the inlet port 115 (the same with the reference in making the prepared hole 102) in carrying out caulking.

Because the reference in machining the prepared hole 102 is the inlet port 115, the prepared hole 102 is machined continuously after machining the inlet port 115 while maintaining a state in which the cylinder 16 is held during machining of the inlet port 115 in machining the cylinder 16.

For instance, the inner diameter of the cylinder 16 is fixed and held so as to paste and chuck to the outer periphery and machining of the inlet port 115 and the prepared hole 102 is carried out without releasing the chuck. Thereby, the positional precision of the prepared hole 102 to the inlet port 115 may be improved. At this time, although it is difficult to machine the plurality of neighboring prepared holes 102 at one fixing section in the same time because a driving motor of blades interferes and the plurality of blades cannot be rotated in close proximity in the same time, one prepared hole 102 in each fixing section which is disposed in a plurality of points on the outer peripheral face may be machined at the plurality of points in the same time and a machining time may be shortened as compared to forming all of the prepared holes one by one.

Furthermore, no chamfering process is carried out to the inner peripheral edge of opening of the prepared hole 102 or even if it is carried out, chamfering of a small scale of removing only burr and returns in the machining is carried out to prevent the substantial degree of push H from dropping and to increase contact of the prepared hole 102 with the convex portion 107 to prevent ricketiness from occurring. When no chamfering process is carried out, buffing may be carried out around the opening of the prepared hole 102 to remove the burr and returns.

Thus, the prepared hole 102 may be matched with the position of the pressing jig 111 with high precision by matching the reference in machining the prepared hole of the built-in part with the positioning reference in forming the caulking section. Still more, the caulking section may be formed with the small pressing force, reducing the force applied to the built-in part in caulking and reducing strain otherwise generated in the built-in part.

When the rotary compressor is to be fabricated by forming the caulking sections on the outer peripheral face of the cylinder by utilizing the invention, the cylinder may be fixed to the closed container without lowering its performance even when the inner diameter of the cylinder is enlarged while keeping the same outer diameter and the rigidity of the ringed cylinder is lowered because the inventive method can lower the strain of the vane groove and the inner diameter of the cylinder as compared to the conventional caulking methods that involve welding and press fit.

Therefore, it becomes possible to enlarge the capacity of the compressor (stroke capacity) by enlarging the inner diameter of the cylinder while keeping the same diameter of the closed container. It means that it is possible to say that the existing compressor may be downsized to a compressor having a closed container whose diameter is smaller than that of the existing one while keeping the same capacity.

While the rotary compressor has been explained as the compressor and the cylinder 16 of the compressor mechanism section 101 has been explained as the built-in part in the embodiment described above, the invention is not limited to them and the inventive method for fixing the built-in part may be utilized practically in any types of compressor.

That is, the inventive method may be applied not only to the closed-type compressor but also to semi-closed type and open type compressors and not only to the compressors but also to any machines that are required to fix a part to a container and brings about the same effect. The remarkable effect of reducing strain may be obtained in the closed-type compressor in particular by using the invention because the compressor mechanism section may generate strain in fixing the compressor mechanism section to the closed container.

The built-in part fixed to the closed container 1 is not specifically limited. For example, it may be another part other than the cylinder 16 described above and may be one of bearing parts existing upper and lower parts of the cylinder, as far as it is the compressor mechanism section 101 of the rotary compressor. Furthermore, in case of the two rotary compressor, it may be a component (where the caulking sections are formed) such as a partition that exists between the two cylinders arrayed in the axial direction for parting the two compressing chambers. The inventive method brings about the same effect in any case. Still more, when the inventive method is practiced to a cylinder other than that whose rigidity is relatively weak, it can reduce strain of the cylinder further and contributes in improving the performance of the compressor.

In case of a scroll compressor, the inventive method is applicable in fixing a fixed scroll forming a compressing chamber, a main bearing part (frame) for supporting the fixed scroll, a rocking scroll or a rotary shaft in a radial direction and a container, disposed in the main bearing part while interposing an electric motor, for supporting the rotary shaft in the radial direction and brings about the same effect. The inventive method may be utilized in fixing a stator of the electric motor to the closed container.

Figure 16:
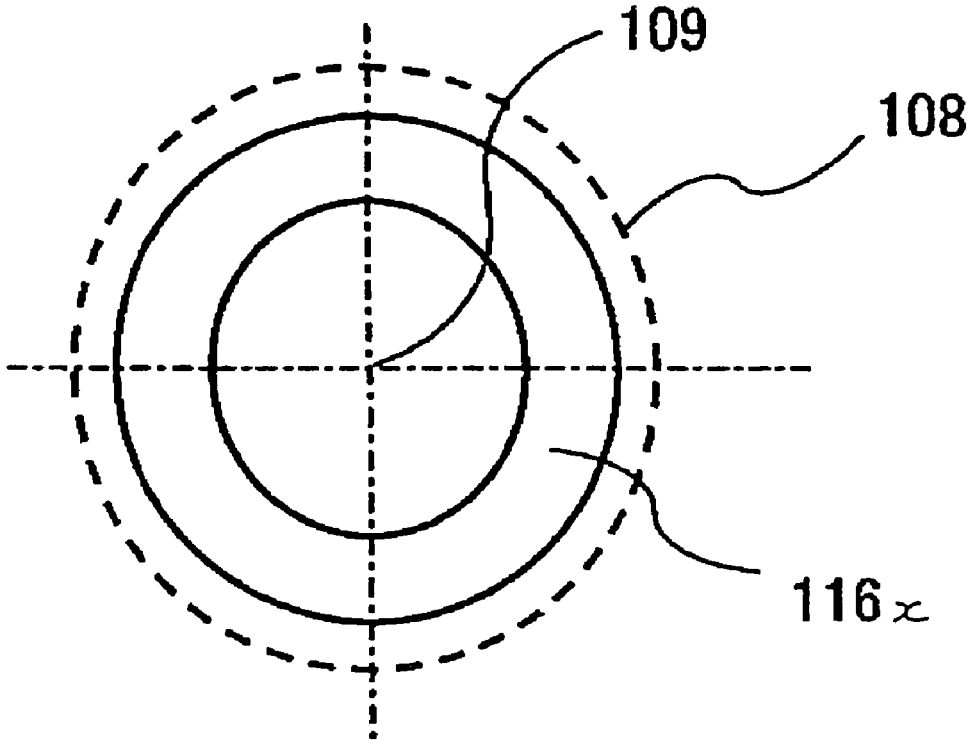
FIG. 16 is a pictorial diagram of a case, seen from the outside of the closed container, when a ringed caulking section is formed.

It is noted that while the convex portions 107 formed on the closed container 1 have been locally heated to caulk to the plurality of neighboring prepared holes 102 and the fixation of the compressor mechanism section 101 has been achieved by the thermal contraction of the closed container 1 after cooling in the embodiment described above, the invention is not limited to them. That is, the fixation of the compressor mechanism section 101 may be achieved by forming not the plurality of neighboring prepared holes 102 but a fixing section composed of a ringed groove on the outer peripheral face of the compressor mechanism section 101, by locally heating a ringed concave band 116*x* formed on the closed container to caulk the ringed groove and by causing a ringed convex band of the closed container 1 to clamp the ringed groove on the outer peripheral face of the compressor mechanism section 101 toward the center of the circle by thermal contraction of the closed container 1 after cooling. FIG. 16 is a pictorial diagram of the case when such ringed caulking section is formed and when the compressor is seen from the outside of the closed container 1 in the radial direction. As shown in the figure, the ringed concave band 116*x* is formed on the outer peripheral face of the closed container 1.

A pressing jig in forming the ringed caulking section may be a cylinder having an inner diameter that is equal to or slightly larger than an inner diameter of the ringed groove and an outer diameter that is equal to or slightly smaller than an outer diameter of the ringed groove. Then, although an end face of the cylindrical pressing jig may be flat, the ringed caulking section may be formed efficiently with a pressing force smaller than the case of using the flat face by forming the end face so as to be curved along the outer peripheral face of the closed container 1 or to be curved with a curvature smaller than the radius of the outer peripheral face of the closed container 1.

It is noted that the groove on the outer peripheral face of the compressor mechanism section 101 and the convex band on the inner periphery of the closed container 1 may not be a complete ring of 360°. It may be a ring of 180° or more that generates a clamping force by thermal contraction of the closed container or a polygonal groove or convex portion, not the ringed groove or convex band, can also generate the clamping force. Furthermore, a plurality of convex portions, not a convex band, may be caulked to a ringed groove by using a plurality of columnar pressing jigs so that the convex portions clamp an inner diameter of the ringed groove by thermal contraction of the closed container by generating the fixing force.

When the inner diameter of the ringed groove is large in forming a ringed caulking section, it is possible to increase a holding force for fixing the compressor mechanism section, i.e., a built-in part, because thermal contraction after caulking becomes large, increasing a clamping force of the convex band of the closed container. However, because a heating region of the closed container must be enlarged, the closed container causes thermal strain and aggravates its roundness of the inner diameter, causing strain in the compressor mechanism section by pressing the compressor mechanism section partially by a part other than the caulking section and reducing the performance of the compressor.

When the inner diameter of the ringed groove 55 is small on the other hand, it becomes possible to prevent the compressor mechanism section from causing strain due to thermal strain of the closed container because the heating region may be reduced. However, the clamping force of the convex band of the closed container becomes small. Therefore, when an average value of an inner radius $R_I$ and outer diameter radius $R_O$ of the ringed groove is defined as a radius of center of the ringed groove and a value obtained by subtracting the inner radius $R_I$ from the outer radius $R_O$ of the ringed groove is defined as a groove width T of the ringed groove, variation of the roundness becomes large when the heating region of the closed container is expanded such that a ratio of the radius R of the center to the groove width (R/T) exceeds two (R/T>2) from a measured result of the roundness of the inner diameter of the closed container before and after heating as for an allowable upper limit of R.

As for an allowable lower limit of R, no problem of noise and vibration caused by ricketiness occurred when '$0.6 \leqq R/T$' from a result of a noise and vibration test in the specification in which the caulking sections are arranged in the circumferential direction at three or four points at almost equal pitches.

Accordingly, it is preferable to set the radius of center and the groove width of the ringed groove so as to satisfy a relationship '$0.6 \leqq R/T < 2$'.

It is possible to obtain the strong fixation that sustains normal and excessive forces generated during operation of the compressor and that causes no ricketiness even if the compressor is used for a long period of time by satisfying this relationship. It is noted that even if the inner diameter of the ringed groove is constant, it becomes possible to change the thermal contraction of the closed container 1 and to adjust the force for clamping the built-in part by adjusting the capacity of heating power source, i.e., the heating capacity.

According to the embodiment of the invention as described above, it becomes possible to obtain the high performance and highly reliable compressor that sustains normal and excessive forces generated during operation of the compressor and that causes no trouble such as increase of noise and vibration caused by ricketiness of the built-in part even if the compressor is used for a long period of time by reducing the force received by the compressor mechanism section when the compressor mechanism section, i.e., the built-in part, is fixed to the container, reducing the strain otherwise generated in the compressor mechanism section, and fixing the built-in part steadily and strongly to the container.

Second Embodiment

Figure 17:
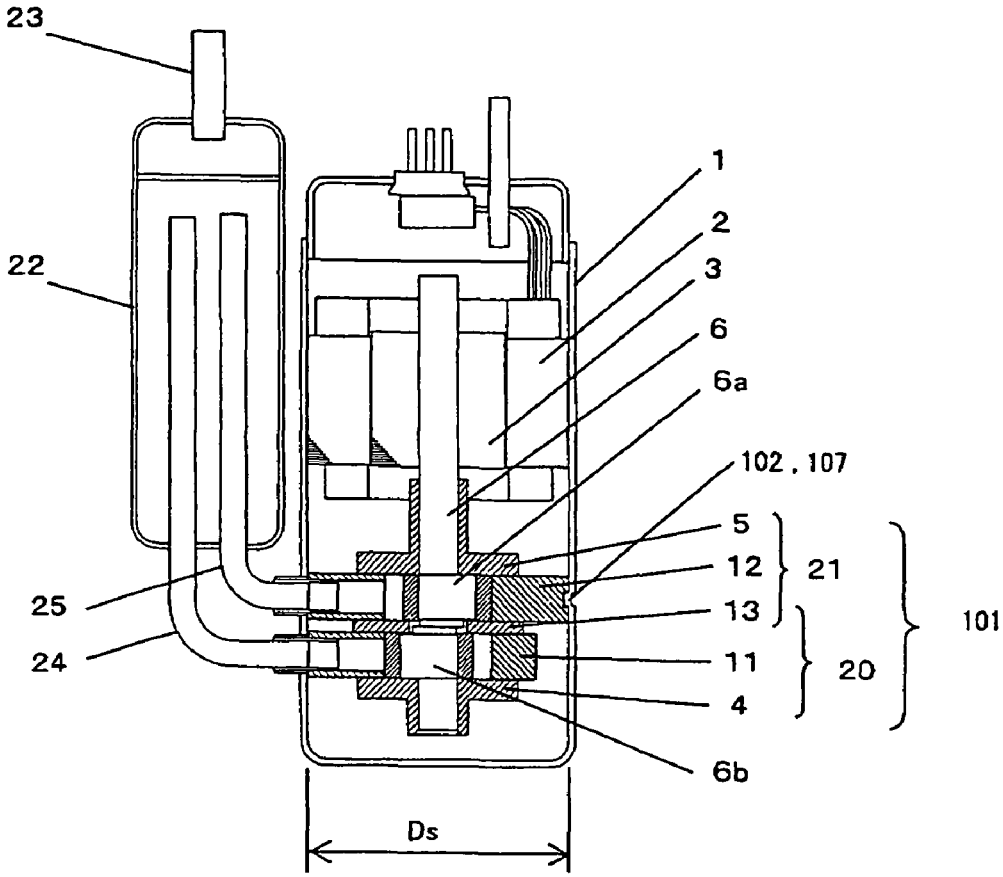
FIG. 17 is a cross-sectional view schematically showing a compressor according to a second embodiment of the invention.

FIG. 17 is a cross-sectional view schematically showing a compressor according to a second embodiment of the invention.

Figure 19:
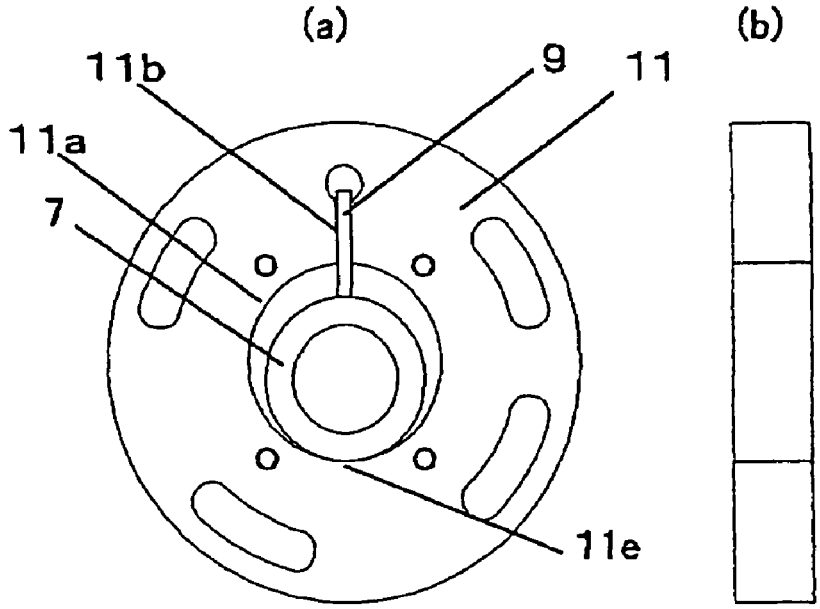
Figure 20:
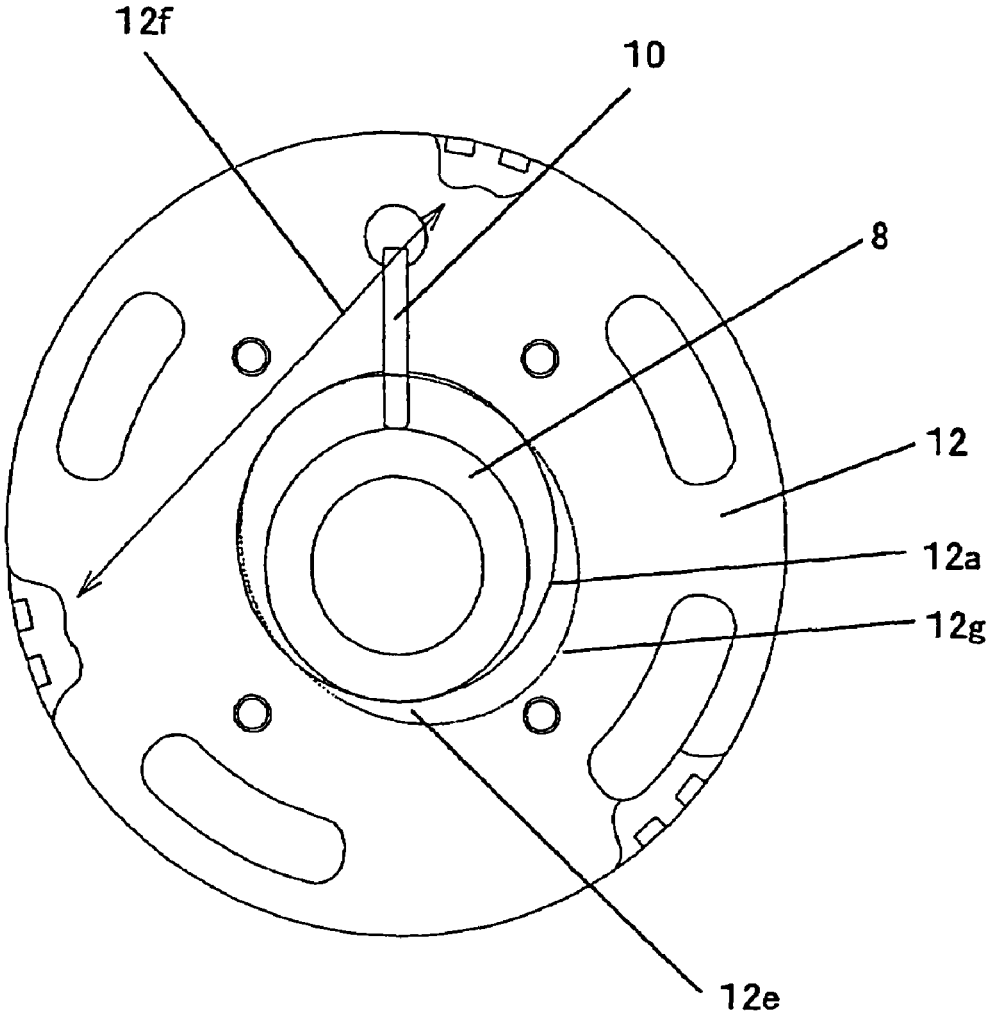
FIG. 20 is a pictorial diagram for explaining strain of the upper cylinder part caused by stress of caulking of the compressor shown in FIG. 17.
Figure 21:
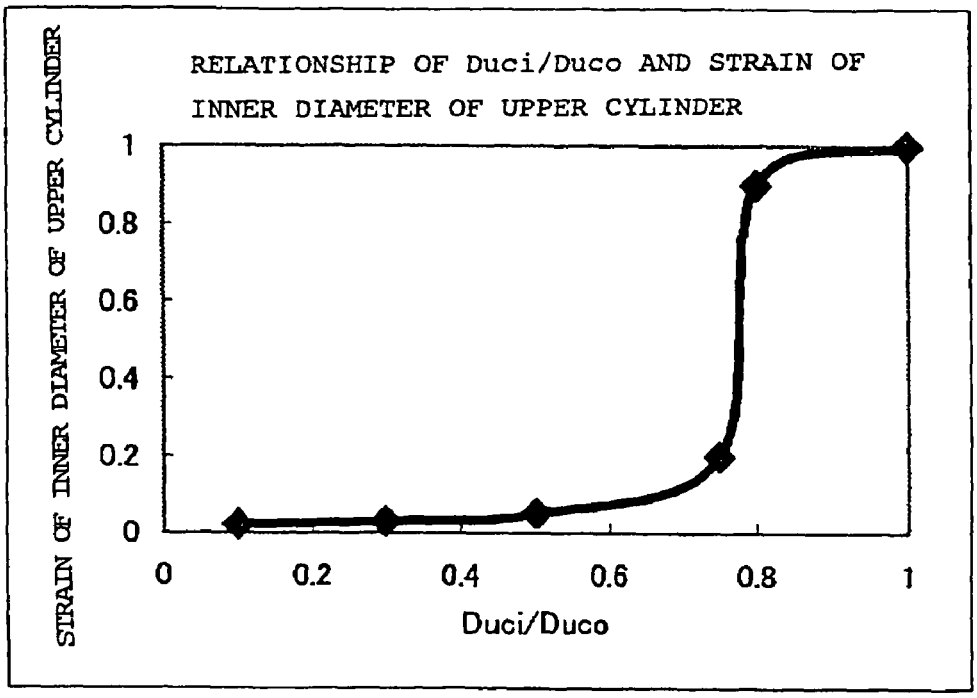
FIG. 21 is a graph of dimensionless strain of the upper cylinder part caused by the stress of caulking of the compressor shown in FIG. 17.

FIGS. 18A and 18B show an upper cylinder part of the compressor shown in FIG. 17, wherein FIG. 18A is a broken plan view of a prepared hole part and FIG. 18B is a longitudinal cross-sectional view, FIGS. 19A and 19B show a lower cylinder part of the compressor shown in FIG. 17, wherein FIG. 19A is a plan view and FIG. 19B is a longitudinal cross-sectional view, FIG. 20 is a pictorial diagram for explaining strain of the upper cylinder part caused by stress of caulking of the compressor shown in FIG. 17 and FIG. 21 is a graph of dimensionless strain of the upper cylinder part caused by the stress of caulking of the compressor shown in FIG. 17.

In FIGS. 17 to 21, a stator 2 of a revolving electric machine, a rotor 3 to which revolution is given by the stator 2 and an upper cylinder 12 are provided within a closed container 1 that is a container of the closed-type compressor. Then, a crank-shaft 6 is disposed within the upper cylinder 12 and is rotated by the rotor 3 and an upper rolling piston 8 that eccentrically rotates is fitted into a crank-shaft upper eccentric section 6*a* of the crank-shaft 6. Furthermore, an upper vane 10 that parts an upper compressing chamber 21 into high and low pressure sides is fitted into a vane groove 12*b* of the upper cylinder 12 together with the upper rolling piston 8 within the upper cylinder 12.

A partition 13 is fixed to a lower face of the upper cylinder 12 by means of bolts (not shown) and a frame 5 is fixed to an upper face of the upper cylinder 12 by means of bolts (not shown). Then, an upper compressing chamber 21 is composed of the upper cylinder 12, the partition 13 and the frame 5.

In order to prevent cooling ability of the compressor from dropping due to a leakage of refrigerant gas from the high-pressure side to the low-pressure side in a process of compressing refrigerant gas, a sealing section 12*e* that seals an inner diameter of the upper cylinder 12 and the upper rolling piston 8 in the radial direction by refrigerating machine oil (not shown) within the upper compressing chamber 21 such that the upper rolling piston 8 within the upper cylinder 12 is disposed by keeping a very small clearance to the inner diameter 12*a* of the upper cylinder 12. A very small clearance is kept also between the upper and lower faces of the upper rolling piston 8 and the partition 13 and the frame 5 from the same reason.

Furthermore, the upper vane 10 is disposed in the vane groove 12*b* of the upper cylinder 12 while keeping a very small clearance in order to prevent the cooling ability of the compressor from dropping due to a leakage of high pressure gas within the closed container 1 to the inlet side in a process of compressing the refrigerant gas.

A lower cylinder 11 is fixed to a lower end face of the partition 13 and the crank-shaft 6 rotates by the rotor 3 disposed within the lower cylinder 11. A lower rolling piston 7 that eccentrically rotates is fitted into a crank-shaft lower eccentric section 6*b* of the crank-shaft 6.

Furthermore, a lower vane 9 that is fitted into a vane groove 11*b* of the lower cylinder 11 parts the lower cylinder 11 into high and low pressure sides together with the lower vane 9.

A cylinder head 4 is fixed to a lower face of the lower cylinder 11 by means of bolts (not shown) and composes the lower compressing chamber 20 together with the lower cylinder 11 and the partition 13 that is fixed to an upper face of the lower cylinder 11.

In order to prevent cooling ability of the compressor from dropping due to a leakage of refrigerant gas from the high-pressure side to the low-pressure side in a process of compressing the refrigerant gas, a sealing section 11*e* that seals an inner diameter of the lower cylinder 11 and the lower rolling piston 7 in the radial direction by refrigerating machine oil (not shown) within the lower compressing chamber 20 such that the lower rolling piston 7 within the lower cylinder 11 is disposed by keeping a very small clearance to the inner diameter 11*a* of the lower cylinder 11. A very small clearance is kept also between the lower rolling piston 7 and the partition 13 and the cylinder head 4 from the same reason.

Furthermore, the lower vane 9 is disposed in the vane groove 11*b* of the lower cylinder 11 while keeping a very small clearance in order to prevent the cooling ability of the compressor from dropping due to a leakage of high pressure gas within the closed container 1 to the inlet side in a process of compressing the refrigerant gas.

Thus, according to the second embodiment, the compressor mechanism section 101 that is a built-in part composing the compressor means stored within the closed container 1 and covers around the compressing chamber to effect compression is composed of the lower cylinder 11, the upper cylinder 12, the frame 5, the partition 13, the cylinder head 4 and others.

There is also provided an inlet muffler 22 that intakes the refrigerant gas from a refrigerating circuit (not shown) via an inlet pipe 23 fixed at an upper part of the outside of the closed container 1 and supplies the intake gas to the lower compressing chamber 20 via a lower connector pipe 24 provided at a lower end thereof and to the upper compressing chamber 21 via an upper connector pipe 25 provided at the lower end thereof.

Figure 18:
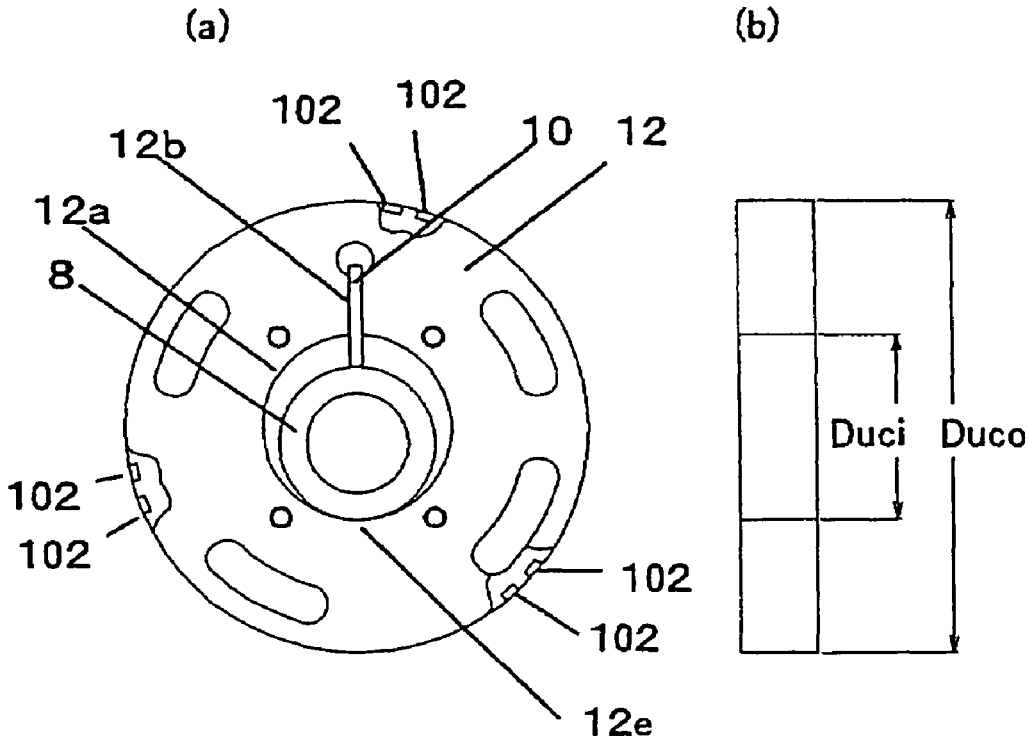

Then, when an inner diametric dimension of the closed container 1 is denoted as Ds and an outer diametric dimension of the upper cylinder 12 is denoted as Duco as shown in FIGS. 17 and 18, the upper cylinder 12 is fixed to the closed container 1 by having a dimensional relationship of "Ds>Duco" i.e., "clearance fit" of having a clearance, as explained in the same manner with the first embodiment. A pair of prepared holes 102 for caulking as explained above in the first embodiment are arranged in close proximity on an outer peripheral face of the upper cylinder 12 and a plurality (three in this case) of pairs of prepared holes 102, i.e., fixing sections, are disposed in the circumferential direction.

Then, positions of the closed container 1 facing to the prepared holes are heated and pressed by the pressing jigs 111 to form the convex portions on the inner peripheral face of the closed container 1 of the closed container 1. Then, the convex portions 107 are caused to enter the prepared holes 102 provided on the outer peripheral face of the upper cylinder 12. When the closed container 1 cools down, the neighboring convex portions 107 clamp a part between the prepared holes 102 as the container wall 1*a* of the closed container 1 contracts. That is, the upper cylinder 12 is fixed to the closed container 1 by the caulking sections by the devices and method similar to the first embodiment.

Then, in this case, when the outer diametric dimension of the upper cylinder 12 is denoted as Duco and an inner diametric dimension of the upper cylinder 12 where the upper rolling piston 8 is stored is denoted as Duci, their relationship of dimension is "Duci/Duco<0.75".

Next, operations of the compressor will be explained. The refrigerant gas taken in from the refrigerating circuit is taken into the inside of the inlet muffler 22 via the inlet pipe 23 and is supplied to the upper cylinder 12 via the upper connector pipe 25. The refrigerant gas taken into the low-pressure side of the upper cylinder 12 is compressed by the upper rolling piston 8 that eccentrically rotates within the upper cylinder 12 by eccentric rotation of the crank-shaft upper eccentric section 6*a* of the crank-shaft 6 caused by rotation of the rotor 3 and the upper vane 10 fitted into the vane groove 12*b* of the upper cylinder 12 and is discharged to the closed container 1. The compressed refrigerant gas repeats a cycle of being discharged out of the closed container 1 to a refrigerant circuit (not shown) and of being taken into the compressor to be compressed again, undergoing condensation, decompression and evaporation.

When the position of the convex portion 107 on the inner peripheral face of the closed container 1 and the position of the prepared hole 102 provided on the outer peripheral face of the upper cylinder are position within a designed allowable range in fixing the upper cylinder 12 to the closed container 1 by the set of prepared holes 102 provided on the outer peripheral face of the upper cylinder 12 and the set of convex portions 107 provided on the inner peripheral face of the closed container 1, the set of neighboring convex portions 107 on the inner peripheral face of the closed container 1 generates only local stress to a part between the set of prepared holes 102 neighboring in a direction facing to each other on the outer peripheral face of the upper cylinder 12 and generates no strain in the inner diameter 12*a* of the upper cylinder 12.

However, when the position of the convex portion 107 on the inner peripheral face of the closed container 1 and the position of the fixing section of the prepared holes 102 on the outer peripheral face of the upper cylinder 12 are misaligned from the designed position due to dispersion or the like in manufacturing parts, the position of the convex portion 107 on the inner peripheral face of the closed container 1 is misaligned from the position of the prepared hole 102 on the outer peripheral face of the upper cylinder 12 in a next point to be fixed based on the first fixed caulking section due to dispersion of cooling speed (delay of cooling speed). Therefore, the convex portion 107 on the inner peripheral face of the closed container 1 generates stress in a direction other than that between the neighboring prepared holes 102 facing to each other when the closed container 1 thermally contracts. For example, the convex portion 107 generates stress between the caulking sections as indicated by a line of arrow 12*f* in FIG. 20, possibly causing stress in the whole upper cylinder 12 and distorting the inner diameter 12*a* of the upper cylinder 12.

Although the inner diameter 12*a* of the upper cylinder 12 and the upper rolling piston 8 are disposed while interposing a very small clearance to prevent the performance of the compressor from dropping due to a leakage of refrigerant gas from the high-pressure side to the low-pressure side, the very small clearance expands and the leakage of refrigerant gas from the high-pressure side to the low-pressure side may occur in the sealing section 12*e* if the inner diameter 12*a* of the upper cylinder 12 distorts due to the caulking stress (indicated by an arrow 12*g* of the upper cylinder in FIG. 20). Then, a circulation amount of the refrigerant gas discharged from the compressor to the refrigerant circuit (not shown) decreases, inviting a drop of the cooling ability. Furthermore, the leakage of the refrigerant gas from the high-pressure side to the low-pressure side causes recompression of the refrigerant, increasing an input to the compressor and inviting a drop of efficiency of the compressor.

FIG. 21 is a graph showing a dimensionless degree of strain of the inner diameter 12*a* of the upper cylinder 12 when the outer diametric dimension Duco of the upper cylinder 12 and the inner diametric dimension Duci are changed.

According to FIG. 21, when a ratio of Duci/Duco is lower than 0.75 (=75%) in the upper cylinder 12 (one of the built-in parts composing the compressor means that covers around the upper compressing chamber 21 and effects compression) stored within the closed container 1, i.e., when the inner diameter 12*a* of the upper cylinder 12 is smaller than a predetermined value with respect to the outer diameter of the upper cylinder 12, it becomes possible to provide a high performance and efficient compressor whose amount of strain is little.

That is, because the thickness of the upper cylinder 12 in the radial direction becomes thick, rigidity at this part becomes high, reducing an influence of stress caused by the fixation of the outer diametric part of the upper cylinder 12 to the closed container 1 by means of caulking and the strain of the inner diameter 12*a* of the upper cylinder 12. It thus allows prevention of the leakage of refrigerant gas and provides the high performance and efficient compressor.

Conventionally, the upper cylinder 12 has been fixed to the closed container 1 by making holes through the closed container 1 and by welding them from the outside. Therefore, there has been a possibility that airtightness cannot be kept by making a hole through this welding part due to welding mistake or the like because the hole is made through the closed container 1.

Still more, it has been impossible to weld the upper cylinder 12 with the closed container 1 again in dismantling the compressor to reuse parts thereof by making mistakes during its manufacturing process such as welding because a compatible part of welding section of the upper cylinder 12 integrated with the closed container 1 by welding peels off in separating the closed container 1 from the upper cylinder 12, making a large indent on the outer peripheral face of the upper cylinder 12.

Furthermore, because the compressor has the compatible section as described above, it has been cumbersome to separate the upper cylinder 12 from the closed container 1 in decomposing a product containing the compressor for recycling when it is to be disposed.

Because no hole is made through the closed container 1 in the second embodiment in which "the compressor mechanism section 101 is fixed to the closed container 1 by the caulking sections", there is no possibility of loosing the airtightness and a production yield is improved.

Furthermore, it is possible to return the upper cylinder 12 in the initial state and to use it again by removing the closed container 1 by cut-opening the closed container 1 in the axial direction in dismantling the compressor to reuse the parts even if the fixation fails due to manufacturing mistakes or the like because there is no compatible section between the closed container 1 and the upper cylinder 12, though welding is used for the fixation.

Still more, the upper cylinder 12 may be separated readily by cut-opening only the closed container 1 in the axial direction while avoiding the prepared holes 102 part in decomposing the compressor for recycling when the product is to be disposed. The decomposed parts may be also readily separated per material of the parts, reducing a load to the environment and facilitating the recycling.

It is noted that it is preferable to avoid the part of the prepared holes 102 on the outer peripheral face of the upper cylinder 12 in removing the upper cylinder 12 out of the closed container 1 by cut-opening the closed container 1 in the axial direction for recycling because it cannot be used again if this part is damaged in cut-opening the closed container 1.

Next, one exemplary dismantling procedure for recycling will be explained.

(i) Upper and lower caps of the compressor are cut at first by a lathe.

(ii) Next, a shell (closed container 1) between a mechanical part (compressor mechanical section 101) and a motor part having the stator 2 and the rotor 3 is cut by the lathe.

(iii) Then, the shell (closed container) attached to the mechanical part (compressor mechanism section) is cut in the axial direction by means of a saw, a sanding machine, melting or the like. Thereby, the mechanical part is removed out of the shell.

(iv) Next, the shell the shell attached to the motor is cut in the axial direction in the same manner. Thereby, the stator 2 may be taken out and when bolts of the mechanical part are unscrewed, the mechanical parts (Parts of the compressor mechanism section) may be taken out.

(v) Then, the crank-shaft 6 and the rotor 3 are removed by press. It is noted that the rotor 3 may be thus taken out, it cannot be used again because it is distorted. Dismantling of the compressor may be carried out through such procedure.

Next, another example of the second embodiment will be explained with reference to FIGS. 22 and 23.

Figure 22:
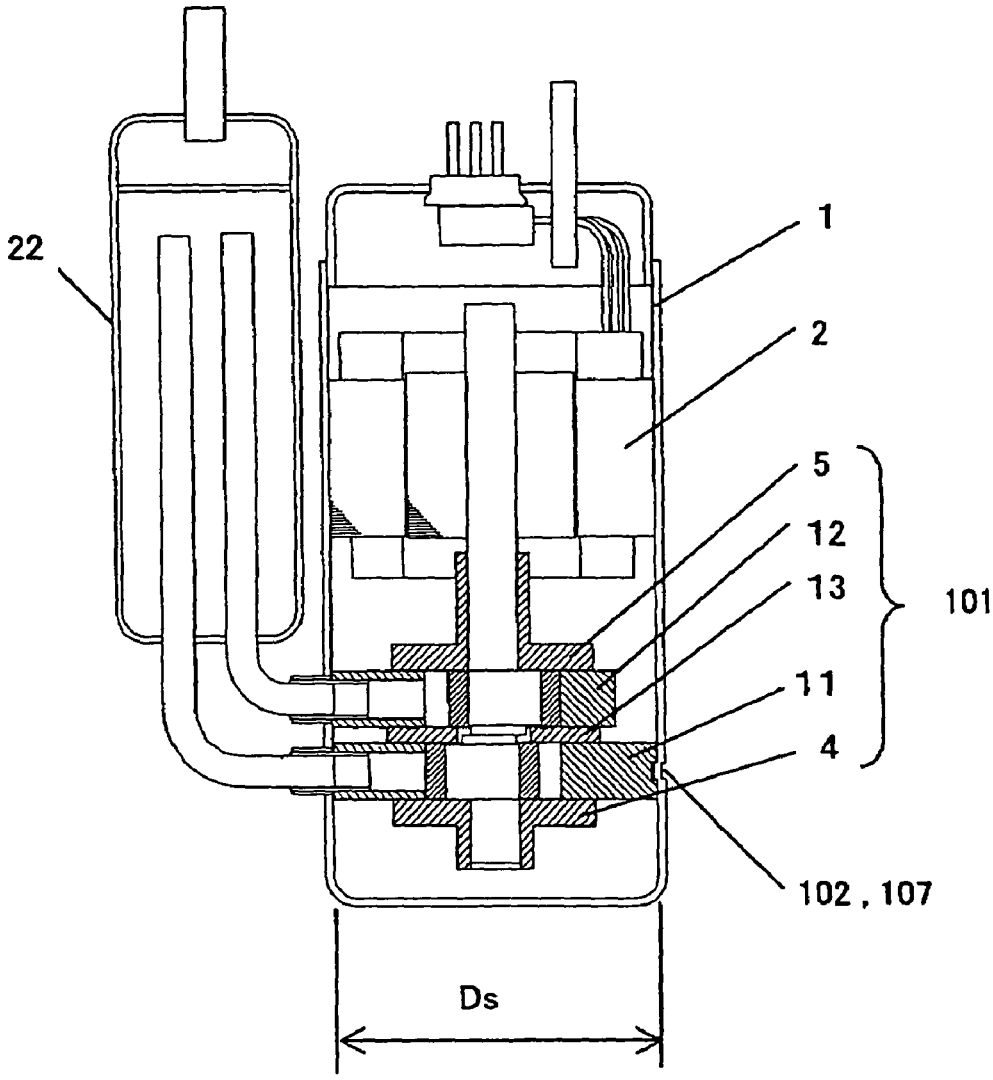
FIG. 22 is a longitudinal cross-sectional view schematically showing a compressor according to another example of the second embodiment of the invention.

FIG. 22 is a longitudinal cross-sectional view schematically showing a compressor according to the other example of the second embodiment of the invention. FIGS. 23A and 23B show a lower cylinder part of the compressor shown in FIG. 22, wherein FIG. 23A is a broken plan view of a prepared hole part and FIG. 23B is a longitudinal cross-sectional view.

Figure 23:
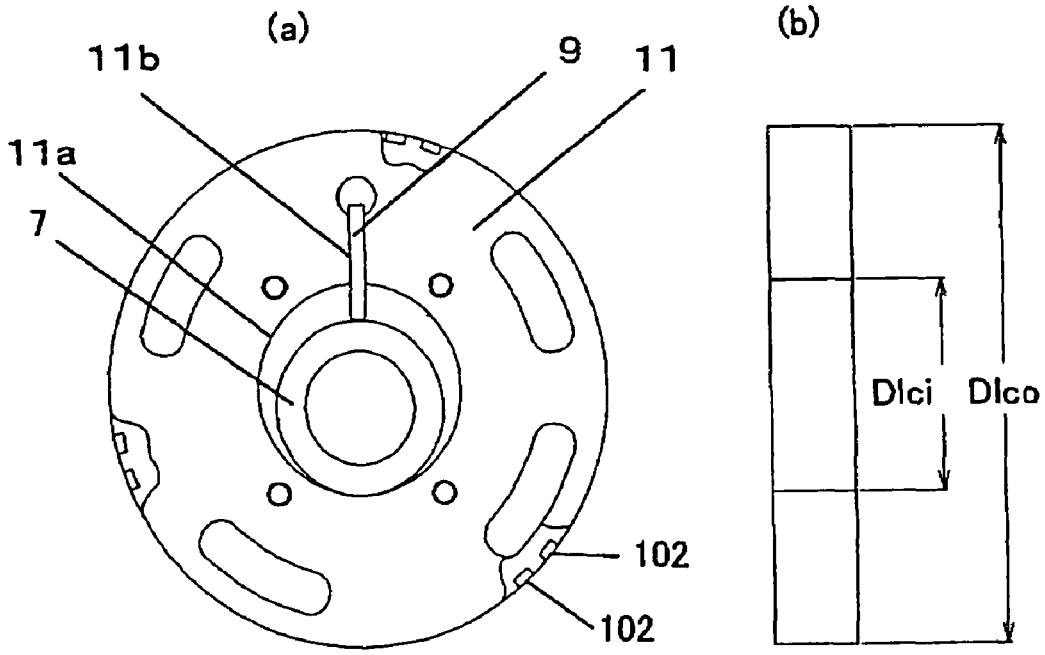

While the upper cylinder 12 among the built-in parts has been caulked and fixed to the closed container 1 in the example described above, the lower cylinder 11 among the built-in parts composing the compressor means is caulked and fixed to the closed container 1 in an example shown in FIGS. 22 and 23. That is, the fixing sections composed of the prepared holes 102 are disposed around the lower cylinder 11 to caulk and fix with the closed container 1 in the same manner with the previous example. It is noted that configurations and operations other than that are the same with those of the example shown in FIGS. 17 to 21.

Then, dimensions of the lower cylinder 11 are set such that "Dlci/Dlco<0.75" to suppress deformation in fixing the lower cylinder 11 to the closed container 1, where Dlco denotes an outer diameter of the lower cylinder 11 and Dlci denotes an inner diameter of the lower cylinder 11.

When "Dlci/Dlco is lower than 0.75 similarly to the example in which the upper cylinder 12 is fixed in FIGS. 17 to 21, i.e., when the inner diameter 11*a* of the lower cylinder 11 is smaller than a predetermined value with respect to the outer diameter of the lower cylinder 11 like it is lower than 75%, a thickness of the lower cylinder 11 in the radial direction becomes thick and rigidity at this part becomes high. Accordingly, such increase of the rigidity reduces an influence of stress caused by the caulking at the outer diametric part of the lower cylinder 11 to the closed container 1 and the strain of the inner diameter 11*a* of the lower cylinder 11. It thus provides the high performance and efficient compressor.

Thus, according to the example described above, the compressor has the built-in part that forms the compressor means that is stored within the container 1 and that covers around the compressing chamber to effect compression, the outer peripheral face of the built-in part, on the outer diameter side of the built-in part, having the predetermined width and facing to the container 1 while interposing the clearance, the fixing sections having the plurality of prepared holes 102 arranged in close proximity on the outer peripheral face and the convex portions 107 of the container wall corresponding to the fixing sections that are pressed from the outside of the container 1 and enter the plurality of prepared holes 102 to fix the closed container 1 with the built-in part, and the inner diameter of the built-in part is reduced to be smaller than the predetermined value so as to suppress deformation in fixing the built-in part to the container to reduce the strain of the built-in part. Thereby, it becomes possible to prevent a leakage of the refrigerant gas in the sealing section of the compressing chamber and to provide the high performance and highly efficient compressor.

Still more, because the inner diameter of the cylinders 11 and 12, i.e., the built-in part of the compressor means for fixing to the closed container 1, is reduced to be smaller than 75% of the outer diameter, it becomes possible to reduce the strain of the built-in part and thereby to provide the high performance and highly efficient compressor.

It is noted that when the upper cylinder 12 is fixed to the closed container 1 as described above, there is almost no influence, naturally, to the lower cylinder 11 and when the lower cylinder 11 is fixed to the closed container 1, there is almost no influence to the upper cylinder 12.

Next, a different example of the second embodiment will be explained with reference to FIGS. 24 to 26.

Figure 24:
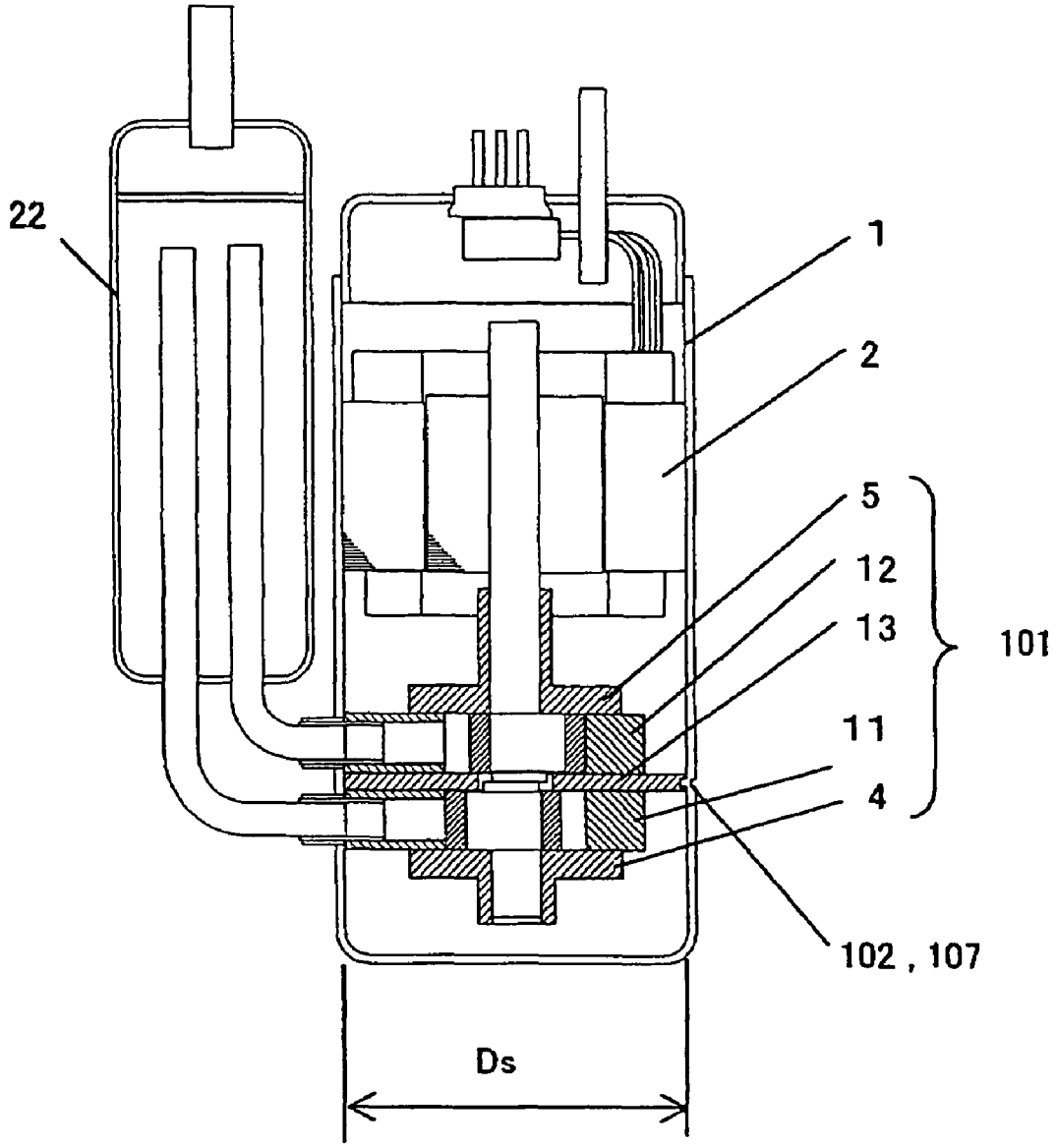
FIG. 24 is a longitudinal cross-sectional view schematically showing a compressor according to a different example of the second embodiment of the invention.

FIG. 24 is a longitudinal cross-sectional view schematically showing a compressor according to the different example of the second embodiment of the invention. FIGS. 25A and 25B show a partition part of the compressor shown in FIG. 24, wherein FIG. 25A is a broken plan view of a prepared hole part and FIG. 25B is a longitudinal cross-sectional view. FIG. 26 is a graph of dimensionless strain of the partition part of the compressor shown in FIG. 24.

Figure 25:
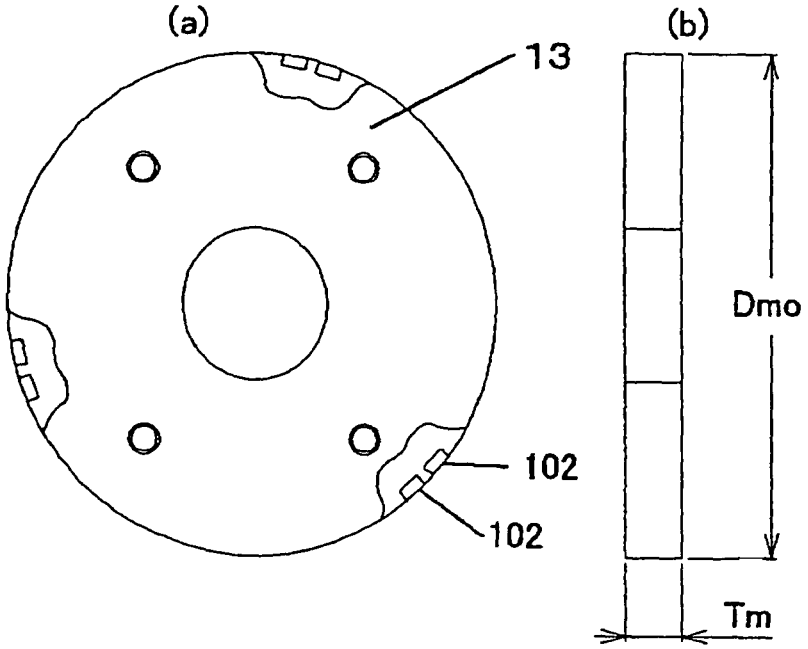

While the upper cylinder 12 and the lower cylinder 11 have been caulked and fixed to the closed container 1 in the examples described above, the partition 13 is fixed to the closed container 1 in an example shown in FIGS. 24 and 25. The configurations and operations other than that the prepared holes 102 are disposed on an outer periphery of the partition 13 to fix to the closed container 1 are the same with those of the example shown in FIG. 17.

Then, dimensions of the partition 13 are set such that "Tm/Dmo<0.01", where Dmo denotes an outer diameter of the partition 13 and Tm denotes a thickness of the partition 13.

That is, the width Tm of the outer peripheral face of the partition 13 (one of built-in parts, for covering the compressing chambers 20 and 21, whose thickness in the axial direction is thinner than the upper cylinder 12 and the lower cylinder 11) is increased by one percent or more of the outer diameter Dmo.

The upper cylinder 12 and the upper rolling piston 8 are disposed so as to keep a very small clearance in a height direction in order to prevent the drop of performance of the compressor due to a leakage of refrigerant gas from the high-pressure side to the low-pressure side in the upper cylinder 12. The upper compressing chamber 21 composed of the upper cylinder 12 fixed on an upper end face of the partition 13 and the frame 5 fixed on the upper cylinder 12.

However, if the caulking section is misaligned due to dispersion in manufacturing the parts similarly to the upper cylinder 12 and the lower cylinder 11, the upper end face of the partition 13 distorts by stress in caulking the outer periphery of the partition 13 caused by the misalignment. Then, the very small clearance expands, increasing the leakage of the refrigerant gas and inviting the drop of performance of the compressor.

Figure 26:
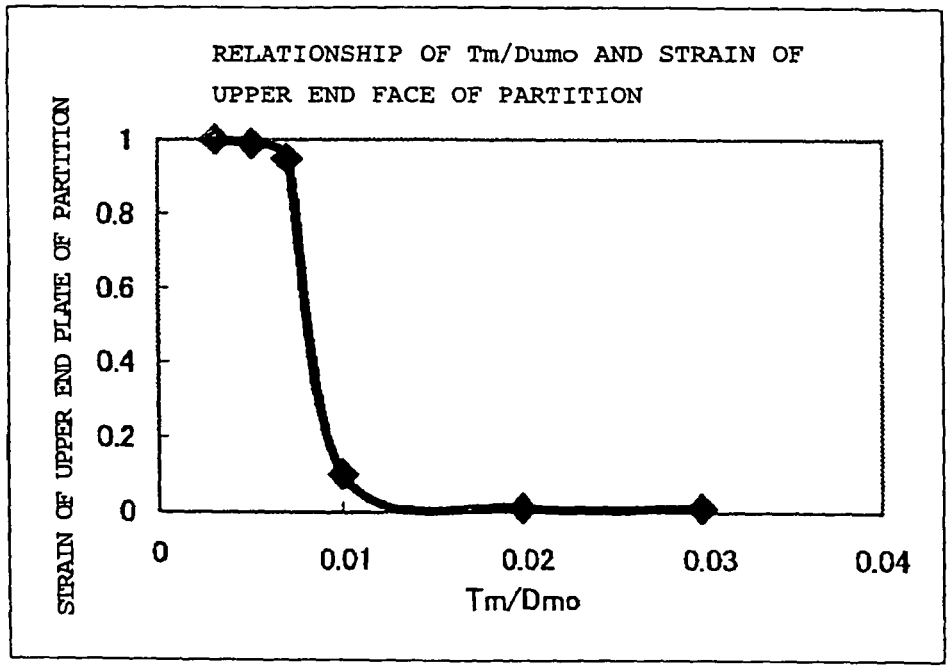
FIG. 26 is a graph of dimensionless strain of the partition part of the compressor shown in FIG. 24.

FIG. 26 is a graph showing a dimensionless degree of strain of the upper end face of the partition 13 when the outer diameter Dmo of the partition 13 and the thickness Tm that is a width of the partition 13 are changed. According to the result of FIG. 26, when a ratio of Tm/Dmo exceeds 0.01, i.e., one percent, the thickness of the partition 13 in the thickness direction becomes thick and rigidity of this part becomes strong. Then, because it becomes possible to reduce an influence of stress otherwise caused by caulking at the outer diametric part of the partition 13 and to reduce the strain on the upper end face of the partition 13, it becomes possible to provide the high performance and efficient compressor.

Next, a different example of the second embodiment will be explained with reference to FIGS. 27 and 28.

Figure 27:
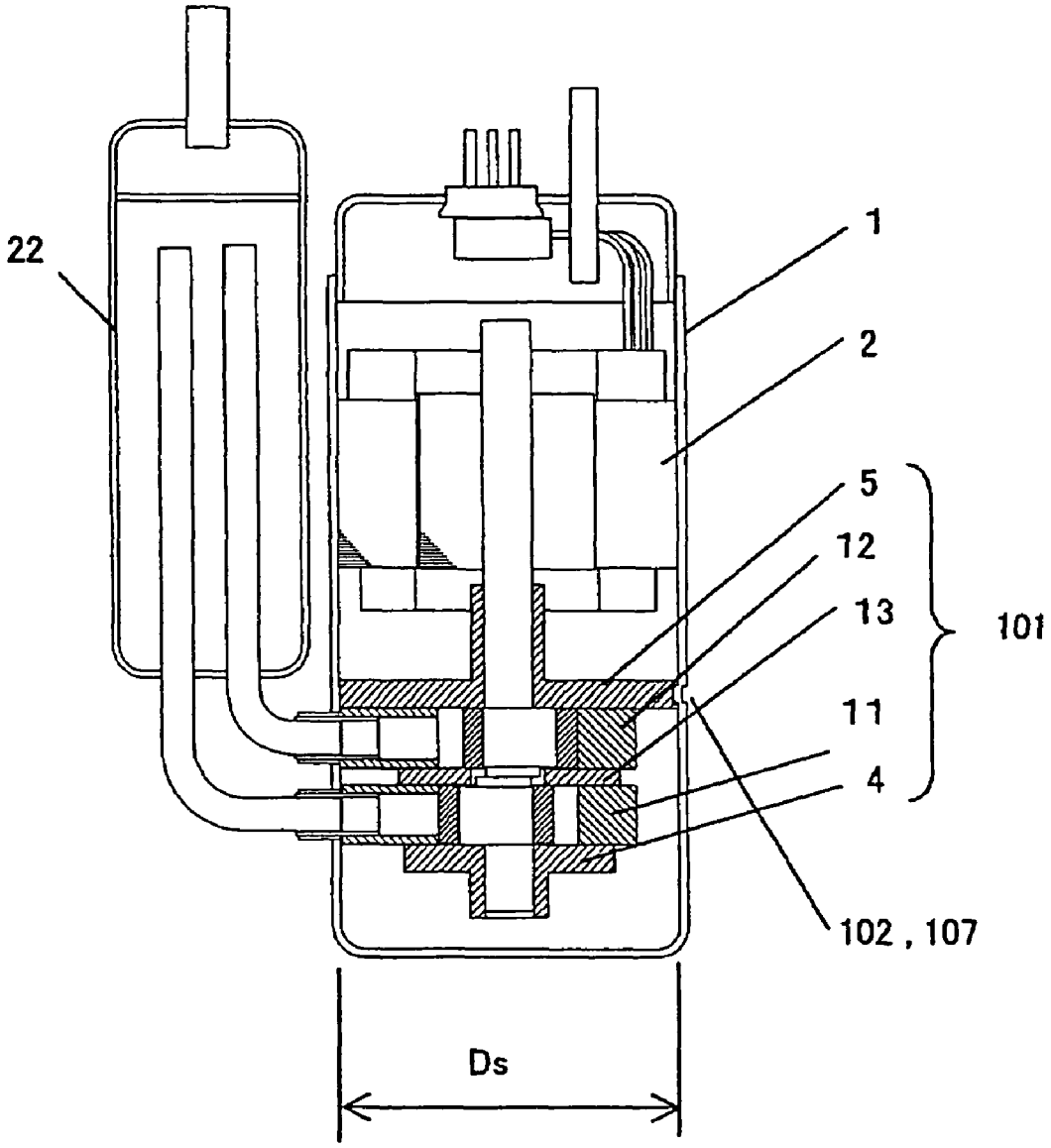
FIG. 27 is a longitudinal cross-sectional view schematically showing a compressor according to a still different example of the second embodiment of the invention.

FIG. 27 is a longitudinal cross-sectional view schematically showing a compressor according to the different example of the second embodiment of the invention. FIGS. 28A and 28B show a frame part of the compressor shown in FIG. 27, wherein FIG. 28A is a broken plan view of a prepared hole part and FIG. 28B is a longitudinal cross-sectional view.

Figure 28:
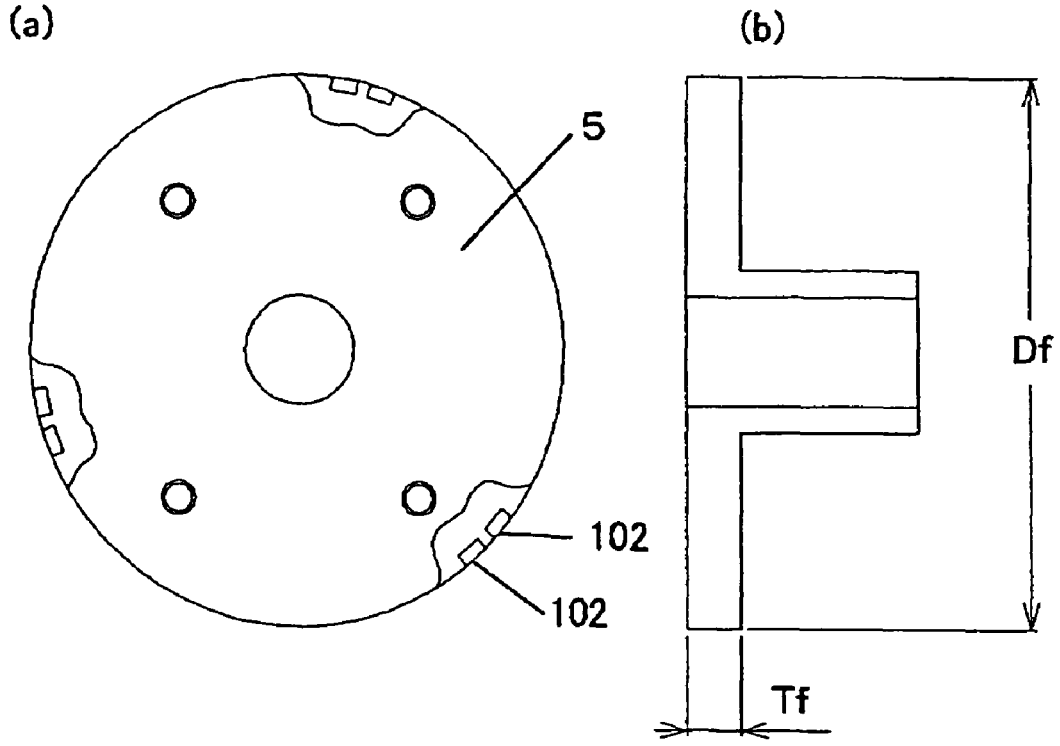

While the cylinder and partition have been caulked and fixed to the closed container 1 in the example described above, the frame 5 is caulked and fixed to the closed container 1 in an example shown in FIGS. 27 and 28. The configurations and operations other than that the fixing sections of the prepared holes 102 are disposed on the outer periphery of the frame 5 to fix to the closed container 1 are the same with those of the example shown in FIG. 17. It is noted that the same or corresponding components with those shown in FIG. 17 are denoted by the same reference numerals and their partial explanation will be omitted here.

Then, a relationship between an outer diameter Df of the frame 5 and a thickness Tf of a flange of the frame 5 is set as "Tf/Df>0.01". That is, the width Tf of the outer peripheral face of the frame 5 (one of the built-in parts, for covering the upper compressing chamber 21, whose thickness in the axial direction is thinner than the upper cylinder 12) to be caulked and fixed to the closed container 1 is set to be larger than one percent of the outer diameter Df.

The upper cylinder 12 and the upper rolling piston 8 are disposed so as to keep a very small clearance in a height direction in order to prevent the drop of performance of the compressor due to a leakage of refrigerant gas from the high-pressure side to the low-pressure side in the upper cylinder 12. That is, the upper compressing chamber 21 is composed of the upper cylinder 12 fixed below the lower end face of the frame 5 and the partition 13 fixed below the upper cylinder 12.

However, if the caulking section is misaligned due to dispersion in manufacturing the parts similarly to the upper cylinder 12 and the lower cylinder 11, the lower end face of the frame 5 distorts by stress in caulking the outer periphery of the frame 5 caused by the misalignment. Then, the very small clearance expands, increasing the leakage of the refrigerant gas and inviting the drop of performance of the compressor.

However, when a ratio of Tf/Df exceeds one percent similarly to the case of the partition in FIGS. 24 to 26 described above, the thickness of the frame 5 in the thickness direction becomes thick and rigidity of this part becomes strong. Then, because it becomes possible to reduce an influence of stress otherwise caused by caulking at the outer diametric part of the frame 5 and to reduce the strain on the end face of the frame 5, it becomes possible to prevent the leakage of the refrigerant gas and to provide the high performance and efficient compressor.

Next, a different example of the second embodiment will be explained with reference to FIGS. 29 and 30.

Figure 29:
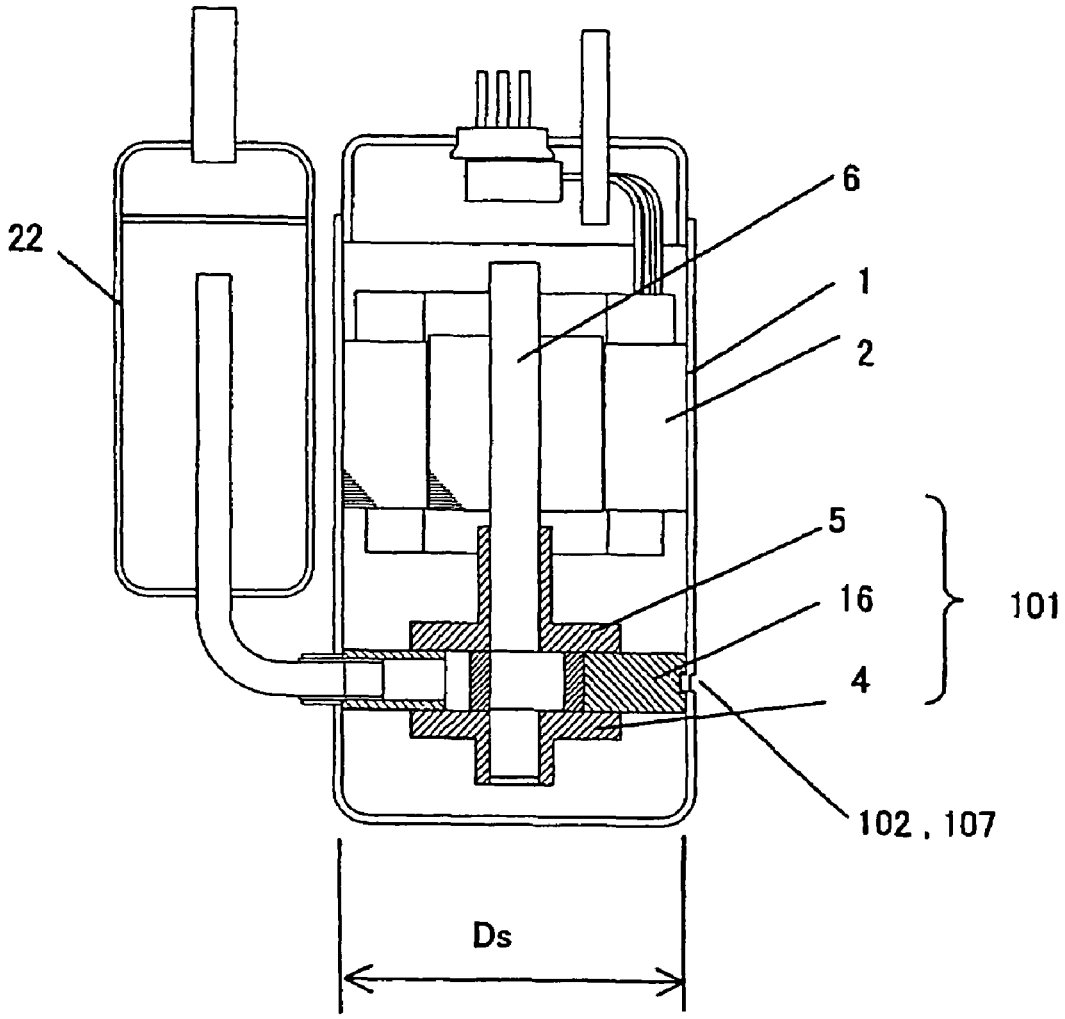
FIG. 29 is a longitudinal cross-sectional view schematically showing a compressor according to a further different example of the second embodiment of the invention.
Figure 30:
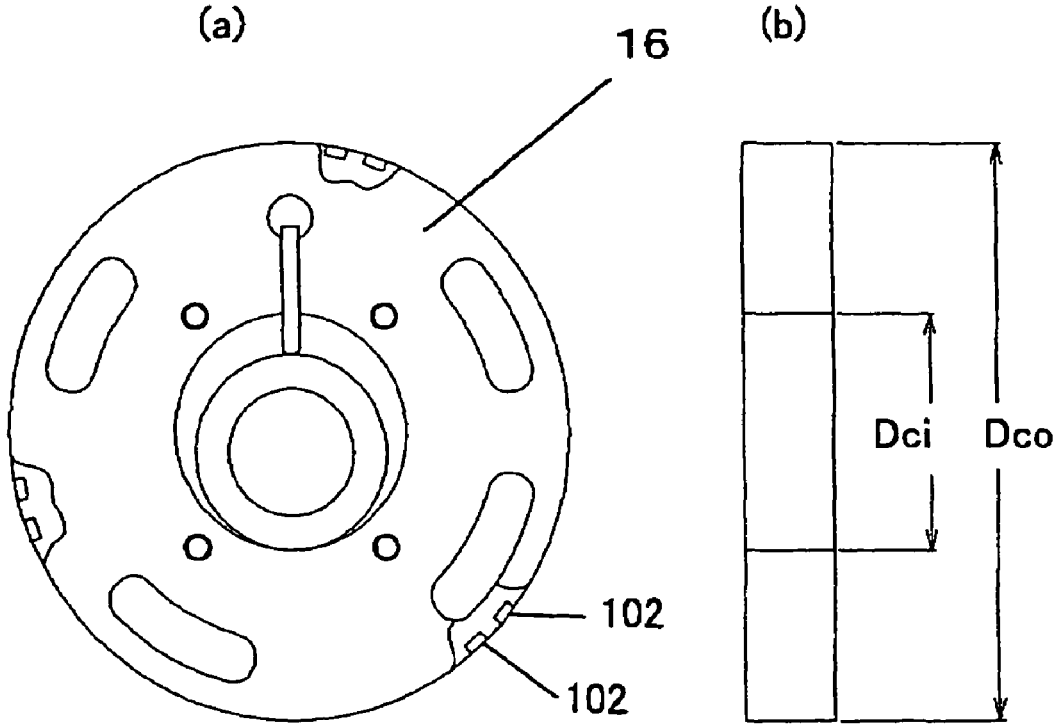

FIG. 29 is a longitudinal cross-sectional view schematically showing a compressor according to the different example of the second embodiment of the invention. FIGS. 30A and 30B show a cylinder part of the compressor shown in FIG. 29, wherein FIG. 30A is a broken plan view of a prepared hole part and FIG. 30B is a longitudinal cross-sectional view.

While the so-called two rotary compressor having two compressor means by having two cylinders has been explained above, a so-called single rotary compressor having one cylinder will be described in this example. As shown in FIGS. 29 and 30, there is one cylinder and no partition, fixing sections composed of the prepared holes 102 are disposed on an outer peripheral face of the cylinder 16 to caulk and fix the cylinder 16 to the closed container 1 in this example. The other configurations and operations other than that fixation are the same with those of the example shown in FIG. 17 and others.

Then, dimensions of the cylinder 16 are set such that "Dci/Dco<0.75", where Dco denotes an outer diameter of the cylinder 16 and Dci denotes an inner diameter of the cylinder 16. That is, the inner diameter Dci of the cylinder 16 (compressor means that is one of the built-in parts stored in the closed container 1) is set to be smaller than 75% of the outer diameter Dco.

When the ratio of Dci/Dco is lower than 0.75 similarly to the case in FIGS. 17 to 21 described above, i.e., the inner diameter of the cylinder 16 is smaller than a predetermined value with respect to the outer diameter of the cylinder 16, the thickness of the cylinder 16 in the thickness direction becomes thick and rigidity of this part becomes strong. Then, because it becomes possible to reduce an influence of stress otherwise caused by caulking at the outer diametric part of the cylinder 16 and to reduce the strain of the inner diameter 16*a* of the cylinder 16, it becomes possible to provide the high performance and efficient compressor.

Next, another example of the second embodiment will be explained with reference to FIGS. 31 to 32.

Figure 31:
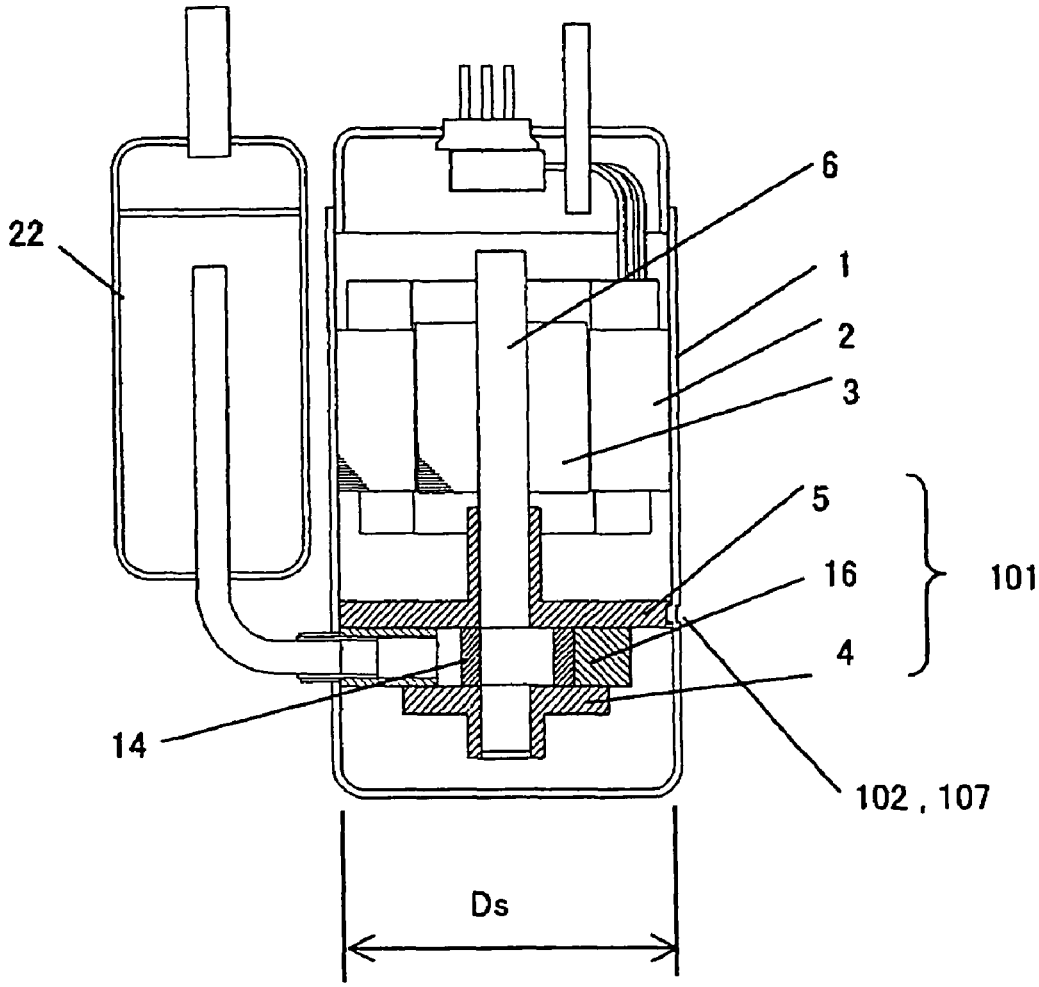
FIG. 31 is a longitudinal cross-sectional view schematically showing a compressor according to a still different example of the second embodiment of the invention.
Figure 32:
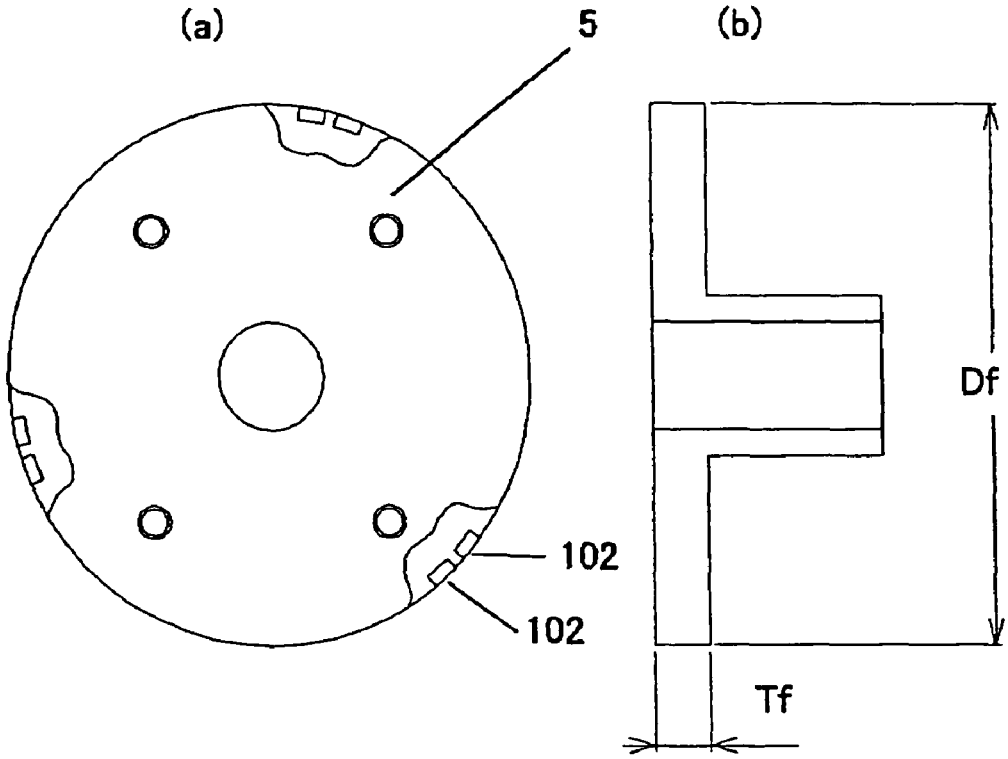

FIG. 31 is a longitudinal cross-sectional view schematically showing a compressor according to the other example of the second embodiment of the invention. FIGS. 32A and 32B show a frame part of the compressor shown in FIG. 31, wherein FIG. 32A is a broken plan view of a prepared hole part and FIG. 32B is a longitudinal cross-sectional view.

While the cylinder 16 has been fixed to the closed container 1 in the examples in FIG. 29 described above, the frame 5 may be fixed to the closed container 1. The prepared holes 102 are disposed around the frame 5 to fix to the closed container 1 in FIGS. 31 and 32. The configurations and operations other than such fixation are the same with those of the example shown in FIG. 29.

Then, a relationship of dimension between an outer diameter Df of the frame 5 and a thickness Tf of a flange of the frame 5 is set as "Tf/Df>0.01". That is, the width Tf of the outer peripheral face of the frame 5 (one of the built-in parts, for covering around the compressing chamber, which is thinner than the cylinder 16) to be caulked and fixed to the closed container 1 is set to be larger than one percent of the outer diameter Df.

The cylinder 16 and the closed container 14 are disposed so as to keep a very small clearance in a height direction in order to prevent the drop of performance of the compressor due to a leakage of refrigerant gas from the high-pressure side to the low-pressure side in the cylinder 16.

However, if the end face of the frame 5 distorts by stress in caulking the outer periphery of the frame 5, the very small clearance expands, increasing the leakage of the refrigerant gas and inviting the drop of performance of the compressor.

However, when a ratio of Tf/Df exceeds one percent similarly to the case in FIGS. 27 and 28 described above, the thickness of the frame 5 in the thickness direction becomes thick and rigidity of this part becomes strong. Then, because it becomes possible to reduce an influence of stress otherwise caused by caulking at the outer diametric part of the frame 5 and to reduce the strain on the end face of the frame 5, it becomes possible to provide the high performance and efficient compressor.

Next, another different example of the second embodiment will be explained with reference to FIGS. 33 to 36.

Figure 33:
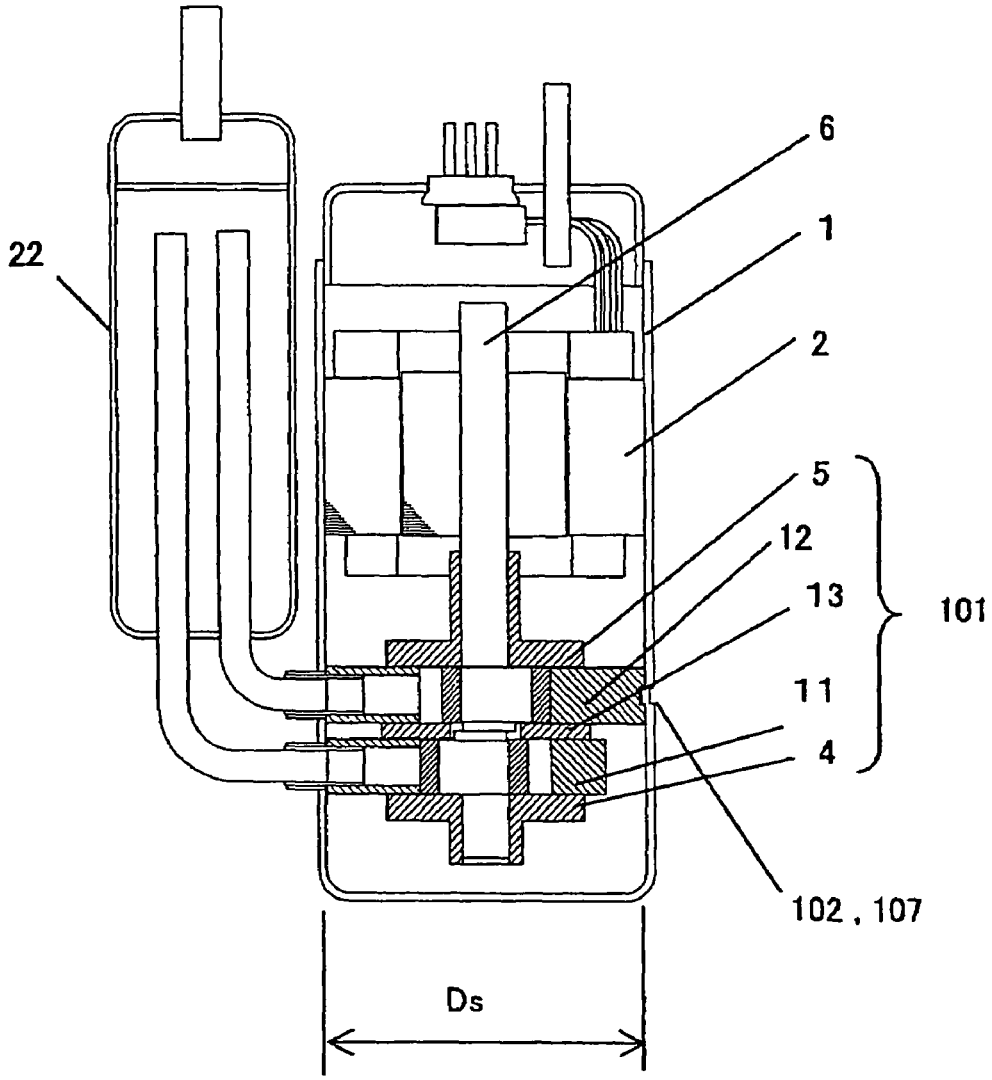
FIG. 33 is a longitudinal cross-sectional view schematically showing a compressor according to a different other example of the second embodiment of the invention.
Figure 34:
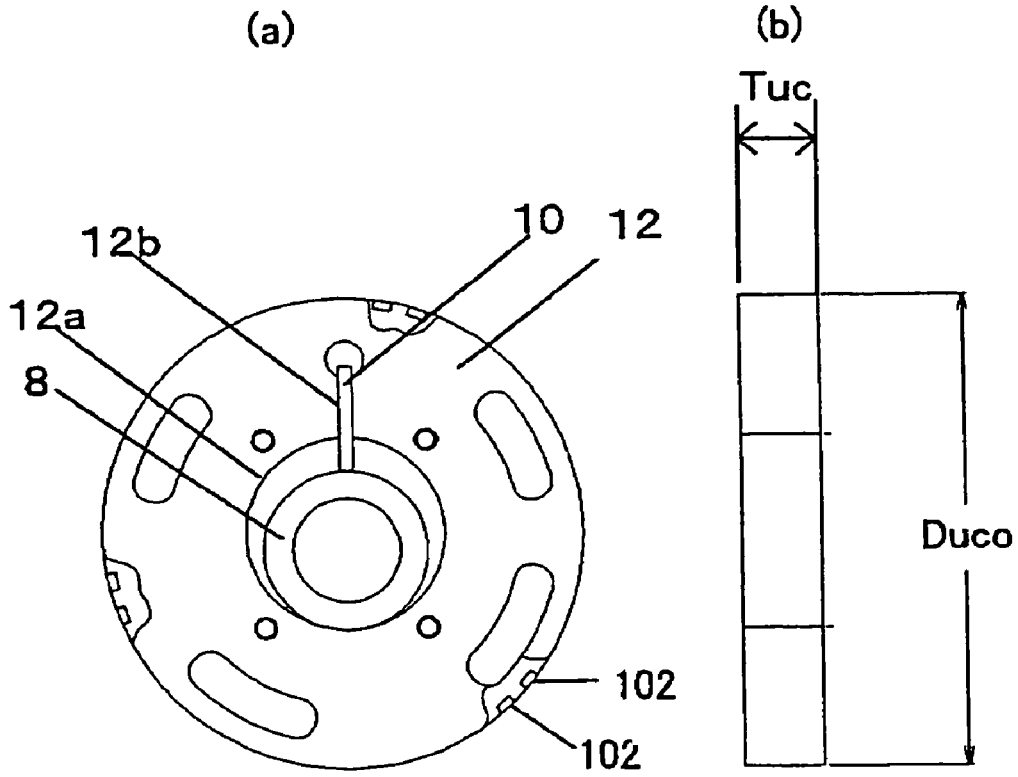
Figure 35:
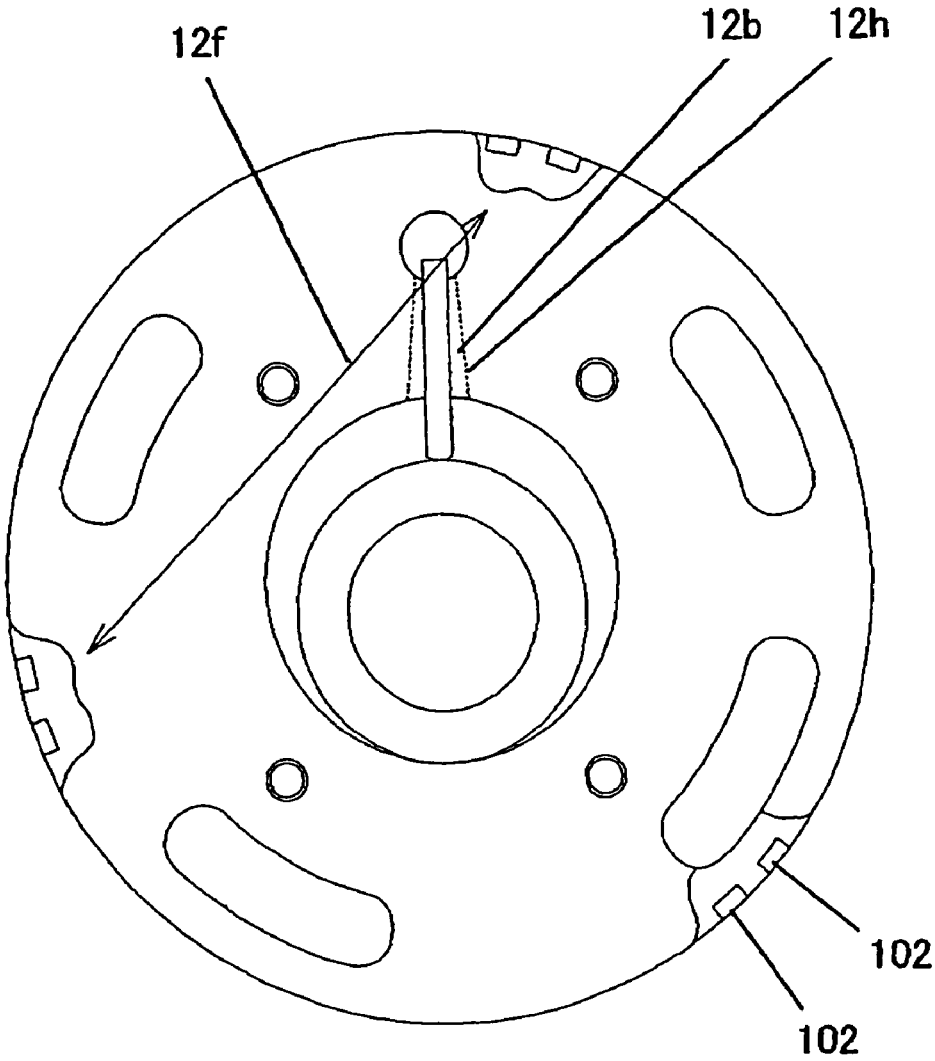
FIG. 35 is a pictorial diagram for explaining strain of the upper cylinder part caused by stress of caulking of the compressor shown in FIG. 33.
Figure 36:
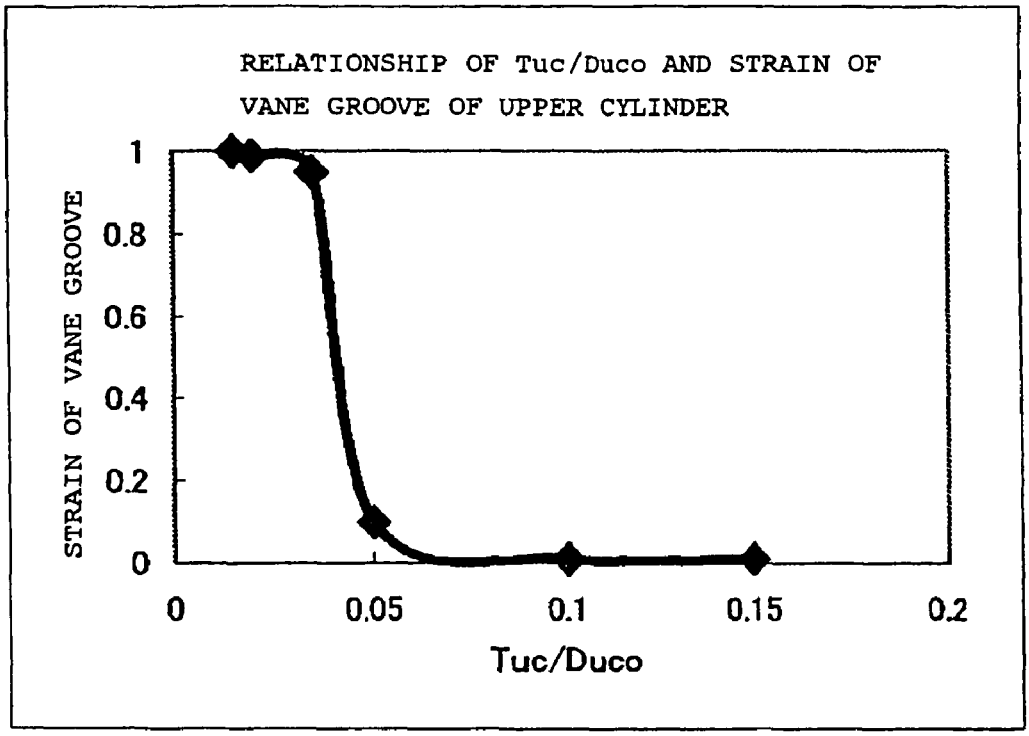
FIG. 36 is a graph of dimensionless strain of the upper cylinder part caused by the stress of caulking of the compressor shown in FIG. 33.

FIG. 33 is a longitudinal cross-sectional view schematically showing a compressor according to the other different example of the second embodiment of the invention. FIGS. 34A and 34B show an upper cylinder part of the compressor shown in FIG. 33, wherein FIG. 34A is a broken plan view of a prepared hole part and FIG. 34B is a longitudinal cross-sectional view. FIG. 35 is a pictorial diagram for explaining strain of the upper cylinder part caused by stress of caulking of the compressor shown in FIG. 33. FIG. 36 is a graph of dimensionless strain of the upper cylinder part caused by the stress of caulking of the compressor shown in FIG. 33.

The closed container 1 is caulked and fixed with the upper cylinder 12 similarly to the case in FIGS. 17 to 21 in this example. The upper vane 10 (parts the upper compressing chamber 21 to the high-pressure side and the low-pressure side) is disposed in the vane groove 12*b* of the upper cylinder 12 while keeping a very small clearance in order to prevent the performance of the compressor from dropping due to a leakage of high pressure refrigerant gas within the closed container 1 to the low-pressure side within the upper compressing chamber 21 during its operation.

A dimensional relationship of an outer diameter Duco of the upper cylinder 12 and a thickness Tuc that is a width of the upper cylinder 12 is set as "Tuc/Duco>0.05" in this example.

That is, the width Tuc of an outer peripheral face of the upper cylinder 12 (compressor means that is the built-in part to be fixed to the closed container 1 by caulking sections) is set to be larger than 5% of its outer diameter Duco.

When the position of the convex portion 107 on the inner peripheral face of the closed container 1 and the position of the prepared hole 102 provided on the outer peripheral face of the upper cylinder are those as designed in fixing the upper cylinder 12 to the closed container 1 by caulking the set of convex portions 197 provided on the closed container 1 to the set of prepared holes 102 provided on the outer peripheral face of the upper cylinder 12, the set of neighboring convex portions 107 on the inner peripheral face of the closed container 1 generates only local stress to a part between the set of prepared holes 102 neighboring in a direction facing to each other and generates no strain in the inner diameter 12*a* of the upper cylinder 12.

However, when the position of the convex portion 107 on the inner peripheral face of the closed container 1 and the position of the fixing section of the prepared holes 102 on the outer peripheral face of the upper cylinder 12 are misaligned from the designed position due to dispersion or the like in manufacturing parts, the position of the convex portion 107 on the inner peripheral face of the closed container 1 is misaligned from the position of the prepared hole 102 on the outer peripheral face of the upper cylinder 12 in a next point to be fixed based on the first fixed caulking section due to dispersion of cooling speed (delay of cooling speed). Therefore, the convex portion 107 on the inner peripheral face of the closed container 1 generates stress in a direction other than that between the neighboring prepared holes 102 facing to each other when the closed container 1 thermally contracts. For example, the convex portion 107 generates stress between the caulking sections as indicated by the line of arrow 12*f* in FIG. 20, possibly causing stress in the whole upper cylinder 12 and distorting the inner diameter 12*a* of the upper cylinder 12.

The vane groove 12*b* of the upper cylinder 12 and the upper vane 10 are disposed while interposing the very small clearance as described above to prevent drop of the performance due to the leakage of the refrigerant gas within the high pressure closed container 1 to the low-pressure side of the upper compressing chamber 21.

However, the very small clearance expands and the leakage of refrigerant gas may occur if the vane groove 12*b* of the upper cylinder 12 distorts due to the caulking stress as indicated by an arrow 12*f* in FIG. 35. Thereby, a circulation amount of the refrigerant gas discharged out of the compressor to the refrigerant circuit (not shown) decreases, inviting a drop of the cooling ability. Furthermore, the leakage of the refrigerant gas from the high-pressure side to the low-pressure side within the upper compressing chamber 21 causes recompression of the refrigerant, increasing an input to the compressor and inviting a drop of efficiency of the compressor.

FIG. 36 is a graph showing a dimensionless degree of strain of the vane groove 12*b* of the upper cylinder 12 when the outer diametric dimension Duco of the upper cylinder 12 and the inner diametric dimension Duci are changed.

According to FIG. 36, when a ratio of Tuc/Duco is higher than 5% (Tuc/Duco>0.05, i.e., when the thickness of the upper cylinder 12 is thicker than 5% of the outer diameter of the upper cylinder 12, it becomes possible to increase the rigidity of the upper cylinder 12, to reduce an influence of the stress caused by caulking at the outer diametric part of the upper cylinder 12 and to reduce strain of the vane groove 12*b* of the upper cylinder 12. Then, it becomes possible to prevent the leakage of refrigerant gas and the occurrence of recompression and to provide the high performance and efficient compressor.

Thus, the width of the outer peripheral face of the built-in part is set to be larger than the predetermined value to suppress deformation in caulking and fixing the built-in parts such as the cylinder, frame and partition to the closed container 1 by the caulking section of the prepared hole 102 and the convex portion 107, so that it brings about the effects that the influence of stress to the built-in part, caused in fixing the caulking section, is minimized and that the high performance and efficient compressor may be provided.

Next, a different example of the second embodiment will be explained with reference to FIGS. 37 and 38.

Figure 37:
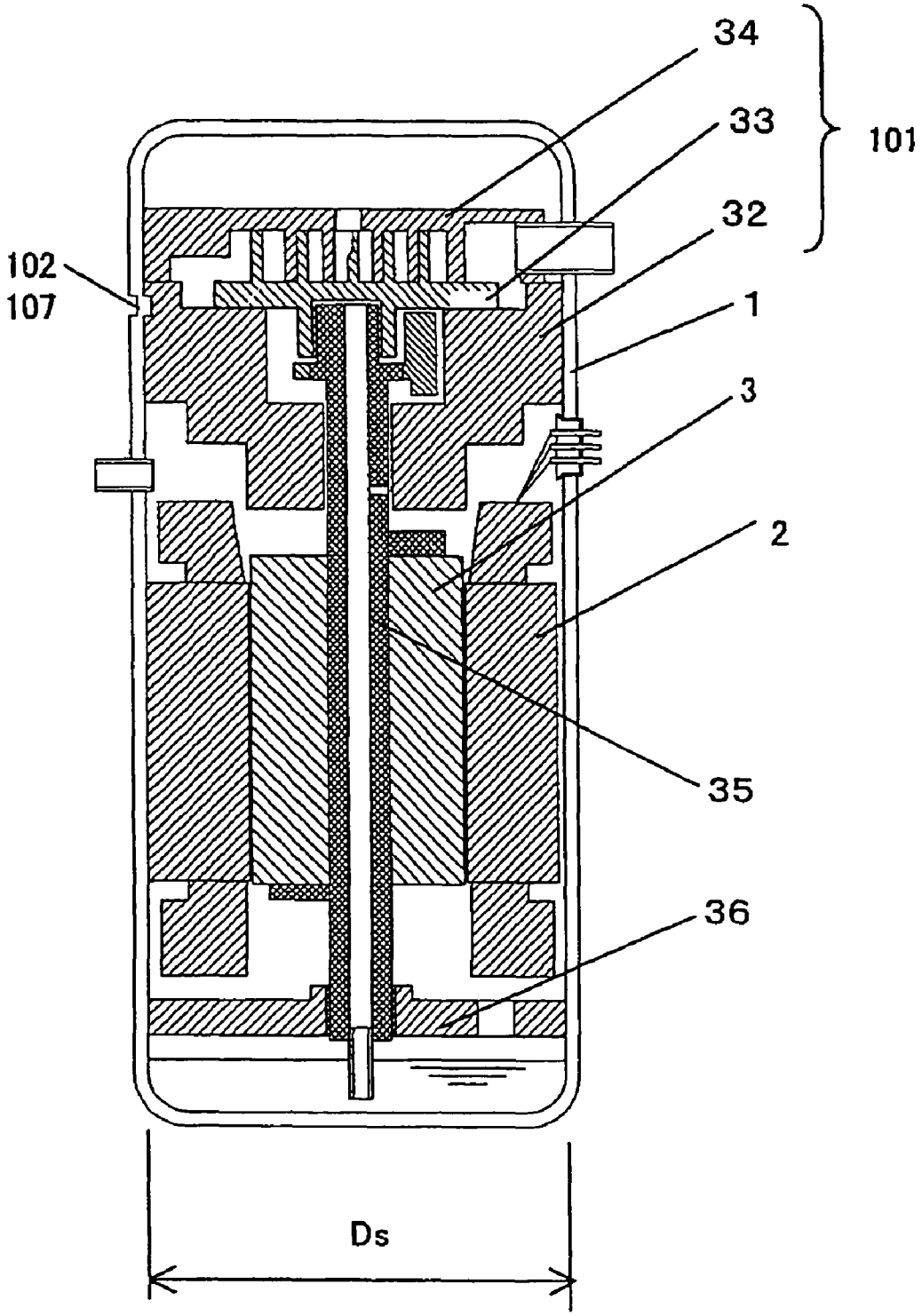
FIG. 37 is a longitudinal cross-sectional view schematically showing a compressor according to a still other example of the second embodiment of the invention.

FIG. 37 is a longitudinal cross-sectional view schematically showing a compressor according to the different example of the second embodiment of the invention. FIGS. 38A and 38B show a frame part of the compressor shown in FIG. 37, wherein FIG. 38A is a broken plan view of a prepared hole part and FIG. 38B is a longitudinal cross-sectional view.

The compressor of this example is a typical scroll compressor employed in refrigerators and air-conditioners and its mechanism and configuration are the same with known caulking sections except of the caulking sections. In FIGS. 37 and 38, a frame 32 that is one of second built-in parts to be stored in the closed container 1 is fixed to the closed container 1 and an oscillating scroll 33 is slidably stored on an inner bottom face of the frame 32.

Then, a dimensional relationship between an inner diameter Ds of the closed container 1 and an outer diameter Dsf of the frame 32 is "Ds>Dsf" and a clearance is created in fixing the frame 32 to the closed container 1. That is, "clearance fit" is carried out.

The fixing sections composed of two neighboring prepared holes 102 are disposed on the outer peripheral face of the frame 32. The frame 32 is fixed to the closed container 1 by heating the position facing to the prepared holes (center of heating), forming convex portions 107 on an inner peripheral face of the container wall 1*a* of the closed container 1 by applying pressure by pressing jigs, inserting the convex portion 107 to the prepared hole 102 provided on the outer peripheral face of the frame 32 and by clamping a part between the neighboring prepared holes 102 by the neighboring convex portions 107 in the caulking section as the closed container 1 contracts when it cools down.

A lower part of a crank-shaft 35 that oscillates the oscillating scroll 33 is rotably and slidably held by a sub-frame 36, whose outer diameter is fixed to the inner peripheral face of the closed container 1. Then, the sub-frame 36 is assembled while keeping a certain standard of coaxiality with the frame 32 in order to assure smooth rotation of the crank-shaft 35. The stator 2 that gives rotational force to the rotor 3 fixed to the crank-shaft 35 is fixed to the closed container 1. Then, a dimensional relationship between an outer diameter Dsf of the frame 32 and a thickness Tsf of a flange thereof is set to be "Tsf/Dsf>0.01".

Next, operations of the compressor will be explained. The refrigerant gas repeats a cycle of being compressed in a compressing chamber, i.e., a compressor mechanism section 101, formed by a fixed scroll 34 as the oscillating scroll 33 oscillates, being discharged to a refrigerant circuit (not shown) and of being taken into the compressor to be compressed again, undergoing condensation, decompression and evaporation.

When the position of the convex portion 107 on the inner peripheral face of the closed container 1 and the position of the prepared hole 102 provided on the outer peripheral face of the frame 32 are those as designed in caulking and fixing the frame 32 to the closed container 1 by the set of prepared holes 102 provided on the outer peripheral face of the frame 32 and the set of convex portions 107 provided on the inner peripheral face of the closed container 1, the set of convex portions 107 on the inner peripheral face of the closed container 1 generates only local stress to a part between the set of prepared holes 102 neighboring in a direction facing to each other on the outer peripheral face of the frame 32 and generates no strain in the frame 32.

However, when the position of the convex portion 107 on the inner peripheral face of the closed container 1 and the position of the fixing section of the prepared holes 102 on the outer peripheral face of the upper cylinder 12 are misaligned from the designed position due to dispersion or the like in manufacturing parts, the position of the convex portion 107 on the inner peripheral face of the closed container 1 is misaligned from the position of the prepared hole 102 on the outer peripheral face of the upper cylinder 12 in a next point to be fixed based on the first fixed caulking section due to dispersion of cooling speed (delay of cooling speed). Therefore, the convex portion 107 on the inner peripheral face of the closed container 1 generates stress in a direction other than that between the neighboring prepared holes 102 facing to each other when the closed container 1 thermally contracts. Then, the convex portion 107 may generate stress between the caulking sections, possibly causing stress in the whole frame 32 and distorting the frame 32.

Then, because the oscillating scroll 33 is slidably provided on the inner bottom face of the frame 32 as described above, sliding performance of the scroll drops, inviting a drop of product quality such as seizure.

Furthermore, because the frame 32 is assembled while keeping the certain standard of coaxiality with the sub-frame 36 in order to assure smooth rotation of the crank-shaft 35, the coaxiality drops when the frame 32 distorts due to the stress caused by caulking. Then, it becomes unable to keep the smooth rotation of the crank-shaft 35, inviting the drop of product quality such as seizure. Furthermore, the crank-shaft 35 may be inclined when the coaxiality drops and the rotor 3 fixed to the crank-shaft 35 may be inclined from the stator 2, causing electromagnetic noise and vibration by an unbalanced magnetic field.

Still more, because the frame 32 is fixed with the fixed scroll 34 while keeping airtightness as described above, a leakage of refrigerant gas may occur, inviting the drop of the performance, if this part distorts.

However, Tsf/Dsf is set to exceed one percent (Tsf/Dsf>0.01) in this case similarly to the case in FIGS. 24 to 26 described above. That is, the thickness of the frame 32 in the thickness direction that is the width of the outer peripheral face of the frame 32 is made thick so as to increase the rigidity of this part and to reduce an influence of the stress caused by caulking at the outer diametric part of the frame 32. Therefore, it becomes possible to reduce strain of the frame 32 and to provide the high performance and efficient compressor.

Next, another example of the second embodiment will be explained with reference to FIGS. 39 and 40.

Figure 39:
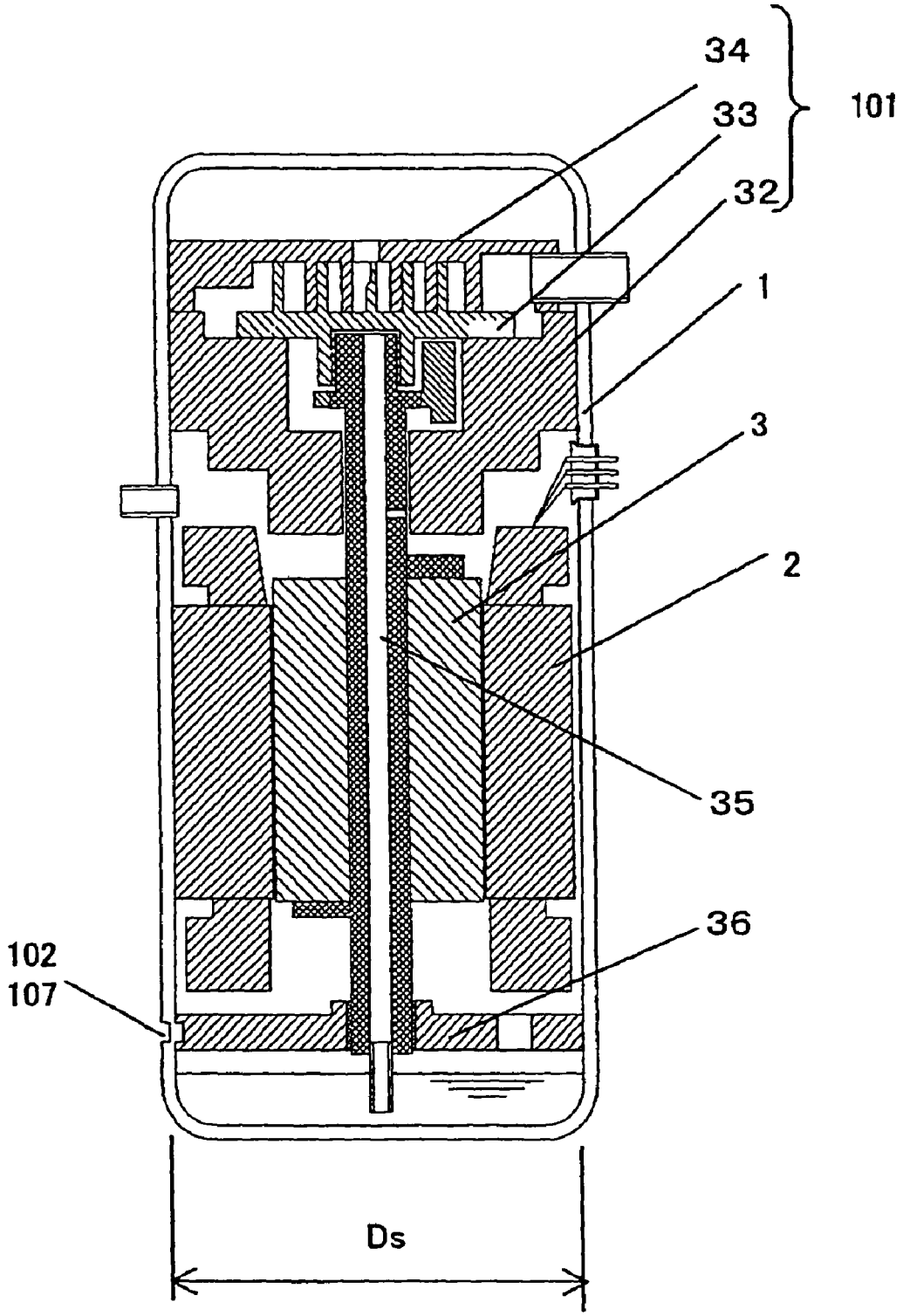
FIG. 39 is a longitudinal cross-sectional view schematically showing a compressor according to another different example of the second embodiment of the invention.

FIG. 39 is a longitudinal cross-sectional view schematically showing a compressor according to the different example of the second embodiment of the invention. FIGS. 40A and 40B show a sub-frame part of the compressor shown in FIG. 39, wherein FIG. 40A is a broken plan view of a prepared hole part and FIG. 40B is a longitudinal cross-sectional view.

Figure 38:
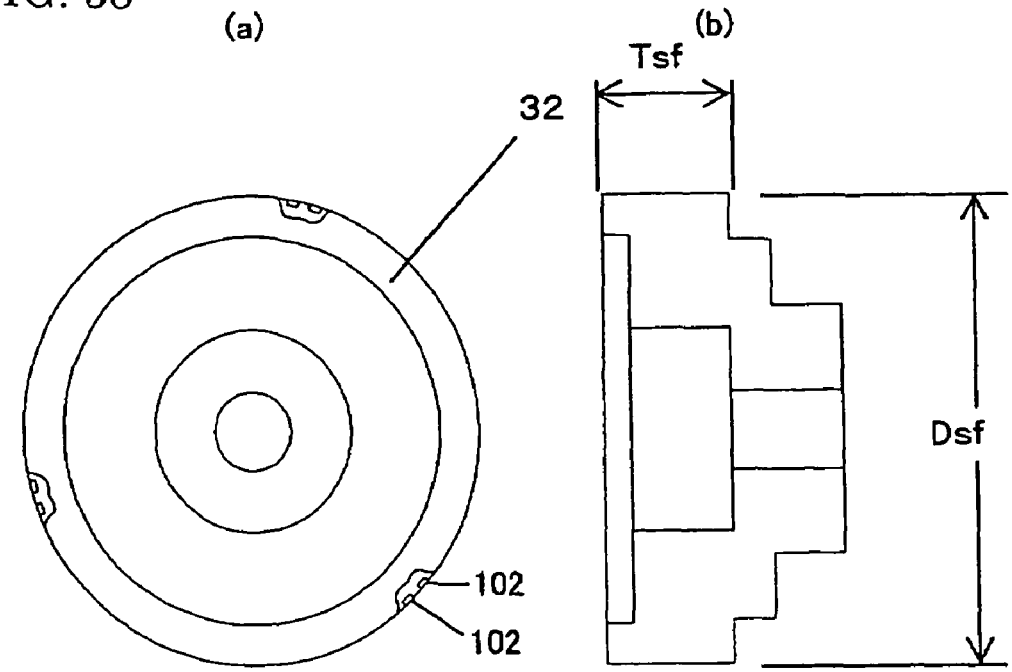
Figure 40:
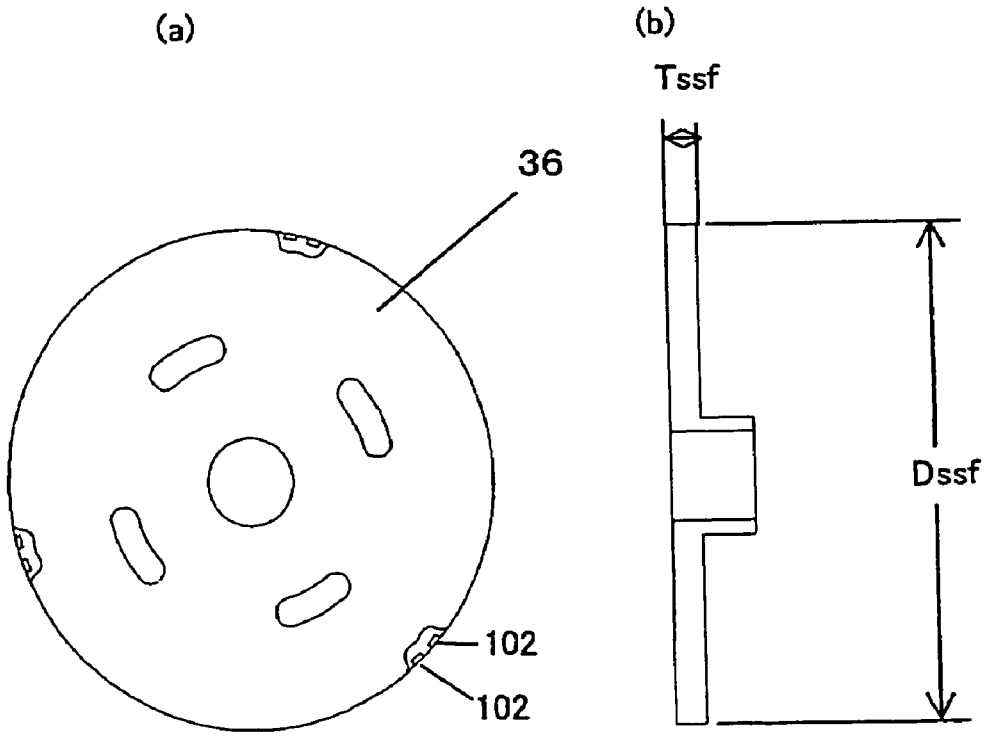

While the closed container 1 and the frame 32 has been fixed in the example shown in FIGS. 37 and 38 described above, prepared holes 102 are disposed on an outer peripheral face of the sub-frame 36 (that rotably supports the compressor means that is stored within the closed container 1 and effects compression) as one of the second built-in parts to caulk and fix it with the closed container 1 in the example shown in FIGS. 39 and 40.

The other configurations and operations thereof are the same with the case in FIGS. 37 and 38 except of that the prepared hole 102 is disposed on the outer peripheral face of the sub-frame 36 to fix the sub-frame 36 with the closed container 1. Then, an outer diameter Dssf of the sub-frame 36 has a dimensional relationship with an inner diameter Ds of the closed container 1 of "Ds>Dssf" and a "clearance fit" is carried out on them.

Then, the dimensional relationship between the outer diameter Dssf of the sub-frame 36 and a thickness Tssf of a flange thereof is set to be "Tssf/Dssf>0.01". That is, the width Tssf of the sub-frame 36, i.e., the second built-in part, is larger than one percent of the outer diameter Dssf thereof.

Furthermore, because the sub-frame 36 is assembled while keeping the certain standard of coaxiality with the frame 32 in order to assure smooth rotation of the crank-shaft 35, the coaxiality drops when the sub-frame 36 distorts due to the stress caused in fixing the caulking section similarly to the case in FIGS. 37 and 38 described above. Then, it becomes unable to keep the smooth rotation of the crank-shaft 35, inviting the drop of product quality such as seizure.

Furthermore, the crank-shaft 35 may be inclined when the coaxiality drops and the rotor 3 fixed to the crank-shaft 35 may be inclined from the stator 2, causing electromagnetic noise and vibration by an unbalanced magnetic field.

However, Tssf/Dssf is set to exceed one percent (Tssf/Dssf>0.01) in this case similarly to the cases in FIGS. 24 to 26 and FIGS. 37 and 38 described above. That is, the thickness of the sub-frame 36 in the thickness direction that is the width of the outer peripheral face of the sub-frame 36 is made thick so as to increase the rigidity of this part and to reduce an influence of the stress caused by caulking at the outer diametric part of the sub-frame 36. Therefore, it becomes possible to reduce strain of the sub-frame 36 and to provide the high performance and efficient compressor having a good quality and less vibration and noise.

Next, another different example of the second embodiment will be explained with reference to FIGS. 41 and 42.

Figure 41:
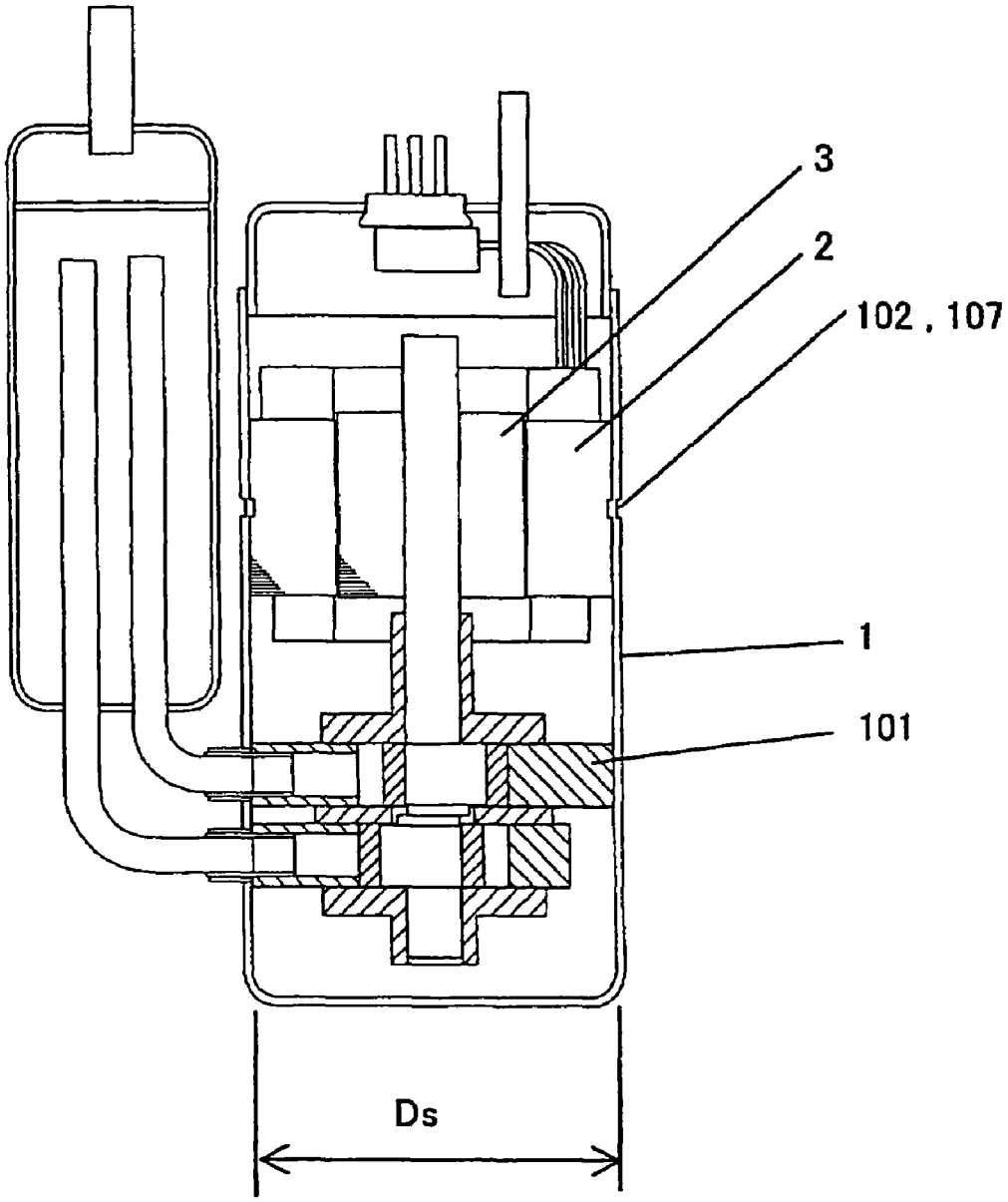
FIG. 41 is a longitudinal cross-sectional view schematically showing a compressor according to a still another different example of the second embodiment of the invention.
Figure 42:
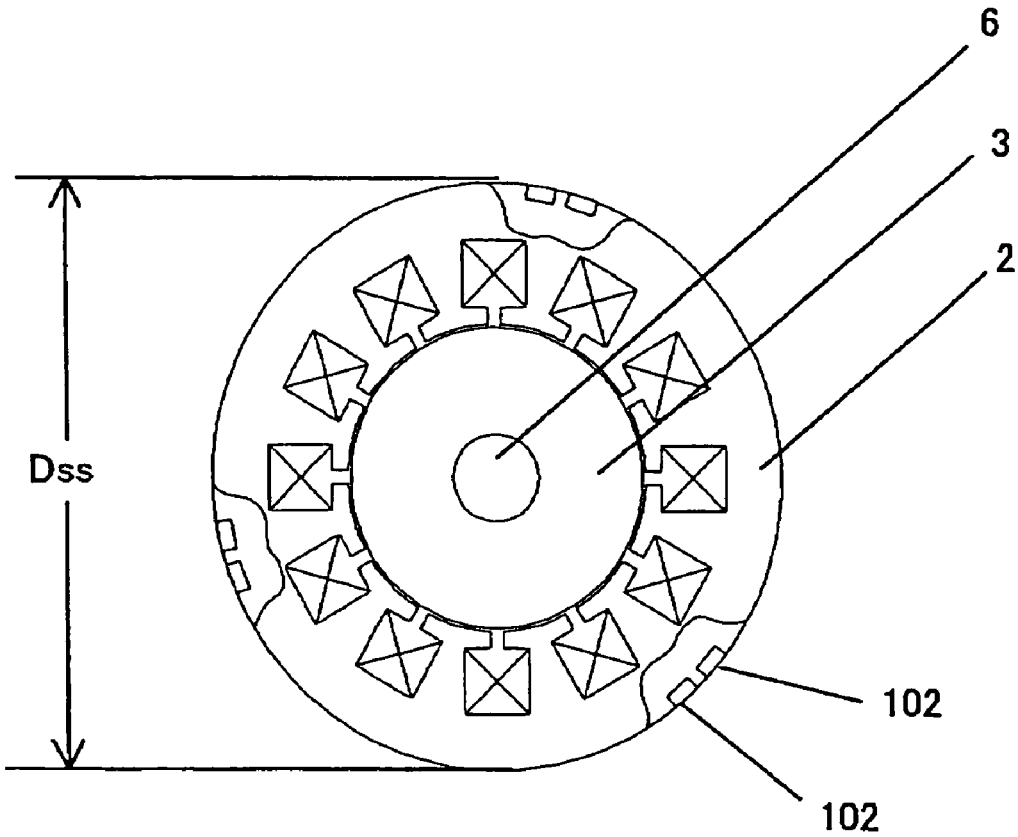
FIG. 42 is a broken plan of a prepared hole part of a revolving electric machine of the compressor.
Figure 43:
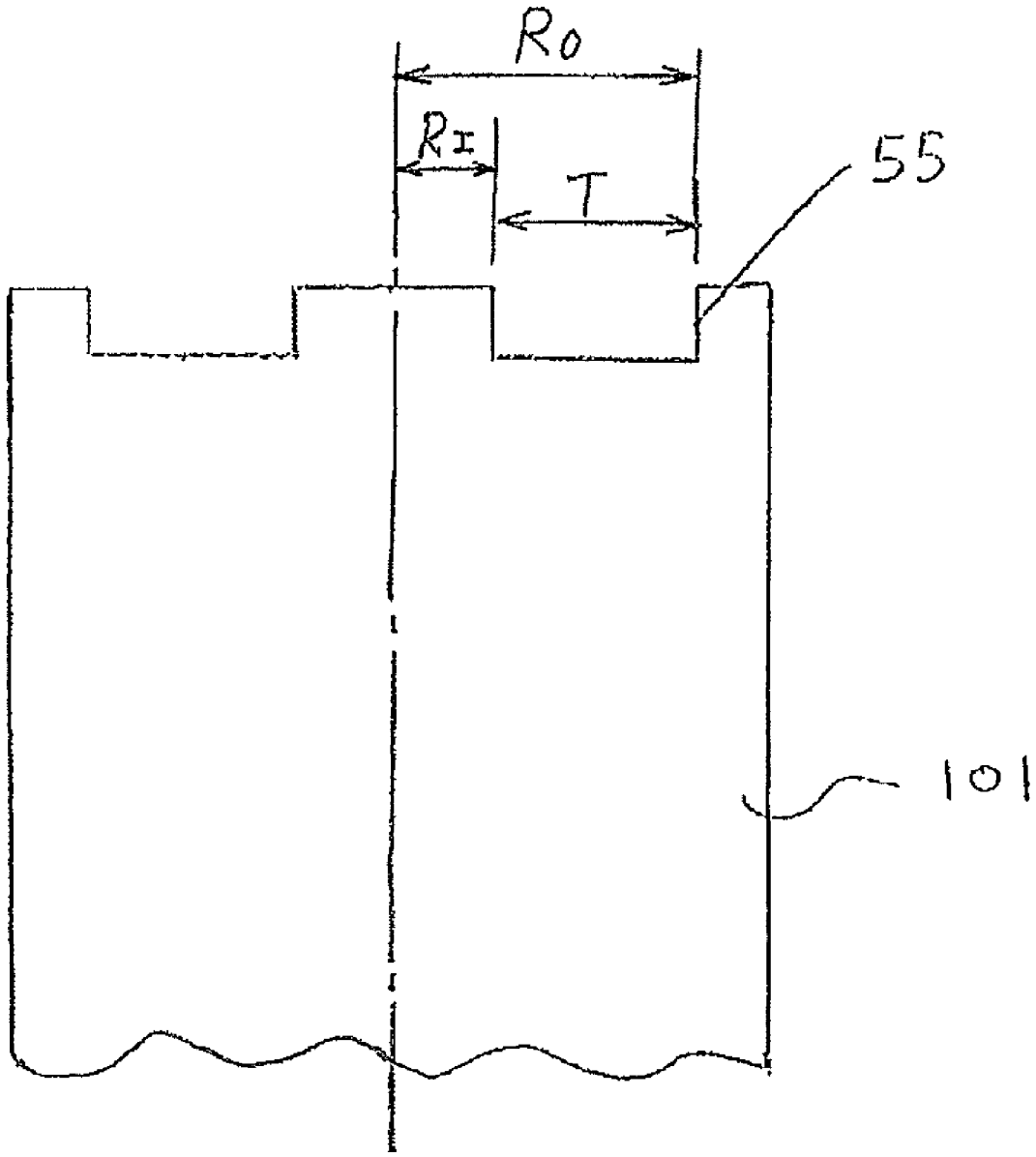
FIG. 43 is a cross-sectional view of the ringed groove.

FIG. 41 is a longitudinal cross-sectional view schematically showing a compressor according to the other different example of the second embodiment of the invention. FIG. 42 is a plan view of a revolving electric machine part of the compressor shown in FIG. 41 by breaking up a prepared hole part.

While the fixation of the cylinder, frame and partition with the closed container 1 has been explained in the examples in the embodiment described above, a case of fixing the stator 2 of the revolving electric machine to the closed container 1 by applying the inventive caulking will be explained in this example. It is noted that the conventional compressor has generated stress in the whole stator 2 by an interference because the stator 2 is fixed to the closed container 1 by way of "interference fit" such as shrinkage fit.

Generally, electromagnetic steel plates composing the stator 2 has a characteristic that its electromagnetic characteristic drops and iron loss increases when it receives stress, and an input to the compressor has increased, lowering its efficiency, by fixing the stator 2 to the closed container 1 by the conventional fixing method. In FIGS. 41 and 42, a dimensional relationship between an internal diameter Ds of the closed container 1 and an outer diameter Dss of the stator 2 is set to be "Ds>Dss" and a "clearance" is formed in fixing the stator 2 to the closed container 1.

Further, a plurality of fixing sections each composed of set of neighboring prepared holes 102 is disposed on an outer peripheral face of the stator 2 in a circumferential direction. In this example, the caulking sections are disposed at three points of the outer peripheral face of the stator 2 in the circumferential direction at almost equal pitches as shown in FIG. 42. Then, position (heating region) of the closed container 1 facing to the prepared holes 102 is heated and is pressed by the pressing jigs to form the convex portions 107 on an inner peripheral face of the closed container 1 and to insert them to the prepared holes 102 provided on the outer peripheral face of the stator 2. Then, the stator 2 is caulked and fixed to the closed container 1 by clamping a part between the prepared holes 102 by the convex portions 107 as the closed container 1 contracts when it cools down.

Because the set of convex portions 107 of the closed container 1 clamp the part between the set of the prepared holes 102 of the stator 2 in the same manner with those in the embodiments described above, stress occurs only in this fixing section and will not extend to the whole stator 2. Accordingly, a region where the characteristic of the electromagnetic steel plates composing the stator 2 drops is localized. Then, it becomes possible to suppress the whole electromagnetic characteristic from dropping and to provide the efficient compressor having the efficient revolving electric machine and not increasing an input to the compressor.

That is, the revolving electric machine has the stator 2 that is stored within the closed container 1 while interposing a clearance, disposed so as to face to the rotor 3 and composed of the laminated electromagnetic steel plates, the outer peripheral face of the stator facing to the closed container 1 on the side of the outer diameter of the stator 2, the fixing sections each having the plurality of prepared holes 102 provided on the outer peripheral face in close proximity from each other and the convex portions 107 of the closed container 1 corresponding to the fixing sections that are pressed from the outside of the closed container 1 to enter the plurality of prepared holes 102 to fix the stator 2 to the closed container 1, and is configured so that the prepared holes 102 straddle the plurality of laminated electromagnetic steel plates, so that the high performance and highly efficient revolving electric machine having less strain may be provided.

The compressor of the second embodiment described above may be manufactured through the same processes with those of the first embodiment.

For example, the method may include;

(i) a step of storing the built-in part, composing compressor means that is stored within the closed container 1 and effects compression or the built-in part for supporting the compressor means and having the plurality of prepared holes 102 arranged in close proximity, to the closed container 1 while interposing the clearance, (ii) steps of heating while suppressing the heating region to the positions facing to the plurality of prepared holes from the outside of the closed container 1 in the temperature range between the softening temperature of the material of the container and the melting temperature thereof and of pressing the container wall 1*a* of the closed container 1 by the pressing jigs whose diameter is smaller than the inner diameter of the prepared hole so that the container wall enters the prepared holes, and (iii) a step of clamping the built-in part by the closed container 1 (the convex portions 107) that has entered the plurality of prepared holes arranged in the circumferential direction to fix the built-in part to the closed container 1.

Thereby, it becomes possible to suppress the strain of the built-in part and to manufacture the high performance and highly efficient compressor. Furthermore, it also becomes possible to suppress the strain of the built-in part more and to manufacture the higher performance and highly efficient compressor by minimizing the strain of the built-in part by pressing the plurality of points from the outside of the closed container 1 at almost equal pitches in pressing the closed container 1 by the pressing jigs 111.

It is noted that the refrigerant used in the refrigerant cycle of the compressors explained in the above-mentioned embodiments 1 and 2 may be CFC refrigerant, HCFC refrigerant, HFC refrigerant, natural refrigerant such as $CO_2$, HC, air and water, refrigerant containing 1,1,1,2 tetrafluoropropene and their mixture. Even when the expansion of the closed container 1 is apt to become large by using refrigerant whose pressure is high such as carbon dioxide, HFC410 and others that generates a supercritical state, the inventive configuration can suppress deformation of the compressor means such as the cylinder due to pressure, so that it can provide an apparatus having the highly efficient compressor.

As the refrigerating machine oil of the compressors explained in the embodiments described above, polyalkylene glucose, esther, ether, alkylbenzene, mineral oil and their mixture may be used. Because the seal section that parts the high-pressure side and the low-pressure side of the compressor mechanism section may be steadily held by the inventive structure which causes less deformation of the built-in parts even when oil is used when its viscosity is low, an apparatus that has the highly efficient compressor may be obtained. For example, it is preferable to set to be 10 cSt or less in case of alkylbenzene or the like at 40° C. where it is not compatible with refrigerant or to be 32 cSt or less in case of compatible oil to HFC refrigerant at 40° C.

Furthermore, one in which coils are wound to the stator 2 by distributed winding or one wound by concentrated winding may be used for the motor of the compressor that is one type of the revolving electric machine. While the coils are wound concentratedly to each magnetic pole in case of the concentrated winding, a revolving electric machine that is an electric motor having good characteristics may be obtained by providing a plurality of prepared holes on an outer peripheral side at position of the center of magnetic pole.

It is more effective to use a rare earth magnet that can increase magnetic fluxes to the revolving electric machine. The laminated electromagnetic steel plate is a thin plate in a range of 0.35 to 2 mm.

One using a ferrite magnet or the rare earth magnet for the rotor 3 may be used as the motor (revolving electric motor) of the compressors explained above in the first and second embodiments. One using the rare earth magnetic in particular brings about effects that it can downsize the motor due to its strong magnetic force and that it provides the small and efficient compressor.

Although the closed-type compressors have been explained in the first and second embodiments described above, the fixation of the built-in part of the invention by means of the caulking sections may be applied not only to the closed-type compressors but also to a container of a semi-closed type compressor.

The closed container 1 of the compressor may be formed by a cold rolled steel plate, hot rolled steel plate or aluminum alloy.

Although the rotary and scroll compressor mechanisms of the compressors have been explained in the first and second embodiments, the inventive caulking and fixing method may be applied to other mechanisms such as swash plate type, sliding vane type, swing type, vibration type and screw type compression mechanisms. Furthermore, although the container has been represented as the closed container 1 in the embodiments described above, the inventive caulking configuration of the prepared hole 102 and the convex portion 107 may be applied to a semi-closed container and an opened container in the same manner and brings about the same effects.

The compressor of the embodiments of the invention has;

the built-in part such as the compressor mechanism section stored within the container while interposing the clearance between the container, fixing sections having the plurality of prepared holes arranged in close proximity on the outer peripheral face of the built-in part so as to face to the container, and convex portions of the container wall facing to the fixing sections that are pressed from the outside of the container and enter the prepared holes of the outer peripheral face of the built-in part to fix the container with the built-in part, wherein the distance between the center of the prepared holes disposed in close proximity from each other and the center of the prepared hole is kept to be within a range of predetermined value to suppress the heating region for heating the vicinity of the convex portions of the container; and the distance between the center of the prepared holes disposed in close proximity from each other and the center of the prepared holes is set to be equal to or less than twice the diameter of the prepared hole and to be 0.6 times or more.

Furthermore, the force for fixing the built-in part to the container is made to be adjustable by adjusting at least either the distance between the neighboring prepared holes and the center of prepared hole or the heating capacity for heating the vicinity of the convex portions of the container.

In the compressor of the embodiments of the invention, the degree of push of the convex portion of the container entering the prepared hole is equal to or less than 0.5 times of the thickness of the container wall or is around 1 mm. The pressing jigs for forming the convex portion entering the prepared hole are fixed by the number of the plurality of prepared holes disposed in close proximity from each other and have the outer diameter that is smaller than the prepared hole of the built-in part and larger than 0.5 times of the diameter of the prepared hole.

The compressor of the embodiments of the invention has the built-in part such as the compressor mechanism section stored within the container while interposing the clearance between the container, fixing sections having the plurality of prepared holes arranged in close proximity on the outer peripheral face of the built-in part so as to face to the container, convex portions of the container wall facing to the fixing sections that are pressed from the outside of the container and enter the prepared holes of the outer peripheral face of the built-in part to fix the container with the built-in part, wherein the part between the prepared holes is fixed by the convex portions of the contained plastically processed the temperature range of temperature that softens a material forming the container and a melting point of the material, and the container wall (near the convex portions) facing to the prepared holes of the built-in part is heated in the range of 600° C. to 1500° C. or more preferably, in the range of 800° C. to 1100° C. for several seconds.

Furthermore, it may have a continuous or interrupted ringed groove of 180° or more as the fixing section, instead of the plurality of prepared holes.

In the compressor of the embodiments of the invention, the plurality of fixing sections, each having the plurality of prepared holes and is a component of the cylinder that covers the compressing chamber of the compressor mechanism section in which the built-in part effects compression or a component of the frame, partition, bearing supporting member or the like for forming the compressing chamber or rotably supporting the compressor mechanism section, is provided on the outer peripheral face of the built-in part.

The compressor of the embodiments of the invention has the built-in part such as the compressor mechanism section stored within the container while interposing the clearance between the container, fixing sections that are ringed grooves of 180° or more provided on the outer peripheral face of the built-in part so as to face to the container, convex portions of the container wall facing to the fixing sections that are pressed from the outside of the container and enter the ringed grooves to fix the container with the built-in part, wherein the center of radius of the ringed groove is set to be equal to or less than twice the groove width of the ringed groove and to be 0.6 times or more in order to suppress the heating region for heating the vicinity of the convex portions of the container.

Further, the force for fixing the built-in part to the container is made adjustable by adjusting the heating capacity for heating the vicinity of the convex portions of the container and the plurality of fixing sections that are ringed grooves of 180° or more is provided on the outer peripheral face of the built-in part.

The compressor of the embodiments of the invention is manufactured by the manufacturing method comprising;

the steps of making the plurality of prepared holes arranged in close proximity on the outer peripheral face of the built-in part such as the compressor mechanism section and of storing it within the container while interposing the clearance between the container, the steps of heating the container by suppressing the heating region to the positions facing to the plurality of prepared holes of the built-in part from the outside of the container in the temperature range between the softening temperature of the material of the container and the melting temperature thereof, and of pressing the container wall by the pressing jigs whose diameter is smaller than the inner diameter of the prepared hole so that the container wall enters the prepared holes, and the step of clamping the built-in part by the container wall that has entered the plurality of prepared holes arranged in the circumferential direction on the outer peripheral face of the built-in part to fix the built-in part to the container, wherein the force for clamping the built-in part to fix to the container is adjusted by adjusting at least one of the distance between the center between the prepared holes arranged in close proximity and the center of the prepared hole and the heating capacity for heating the container.

The compressor of the embodiments of the invention has the built-in part that forms the compressor means that is stored within the container and that covers around the compressing chamber to effect compression, the outer peripheral face of the built-in part, on the outer diameter side of the built-in part, having the predetermined width and facing to the container while interposing the clearance, fixing sections having the plurality of prepared holes arranged in close proximity on the outer peripheral face, and convex portions of the container wall corresponding to the fixing sections that are pressed from the outside of the container and enter the plurality of prepared holes of the outer peripheral face of the built-in part to fix the container with the built-in part, wherein the inner diameter of the built-in part is reduced to be smaller than the predetermined value so as to suppress deformation in fixing the built-in part to the container and the inner diameter of the built-in part that is the cylinder of the compressor means is reduced to be equal to or less than 75% of the outer diameter.

The compressor of the embodiments of the invention has the built-in part that forms the compressor means that is stored within the container and that covers around the compressing chamber to effect compression, the outer peripheral face of the built-in part, on the outer diameter side of the built-in part, having the predetermined width and facing to the container while interposing the clearance, fixing sections having the plurality of prepared holes arranged in close proximity on the outer peripheral face, and convex portions of the container wall corresponding to the fixing sections that are pressed from the outside of the container and enter the plurality of prepared holes of the outer peripheral face of the built-in part to fix the container with the built-in part, wherein the width of the outer peripheral face of the built-in part is increased to be more than the predetermined value to suppress deformation in fixing the built-in part to the container and the width of the outer peripheral face of the built-in part that is the cylinder of the compressor means is increased to be more than 5% of the outer diameter or the width of the outer peripheral face of the built-in part that covers around the compressing chamber that is thinner than the cylinder is increased to be more than 1% of the outer diameter.

The compressor of the embodiments of the invention has the second built-in part that is stored within the container and rotably supports the compressor means that effects compression, the outer peripheral face of the second built-in part, on the outer diameter side of the second built-in part, having the predetermined width and facing to the container while interposing the clearance, fixing sections having the plurality of prepared holes arranged in close proximity on the outer peripheral face of the built-in part so as to face to the container, and convex portions of the container wall facing to the fixing sections that are pressed from the outside of the container and enter the prepared holes of the outer peripheral face of the built-in part to fix the container with the built-in part, the width of the outer peripheral face of the second built-in part is set to be larger than a predetermined value and the width of the outer peripheral face of the second built-in part is set to be larger than one percent of the outer diameter to suppress deformation in fixing the second built-in part to the container.

The compressor of this embodiment of the invention has a plurality of compressor means and the fixing sections to be provided on the outer peripheral face of the compressor means are provided at least on one compressor means.

The compressor of this embodiment of the invention has the plurality of fixing sections provided on the built-in part or on the second built-in part in the circumferential direction at almost equal pitches.

The compressor of this embodiment of the invention has one of plurality of fixing sections that is provided in the vicinity of the groove for storing the vane for parting the compressing chamber of the compressor means.

The compressors of the embodiments of the invention use such refrigerant, to be compressed by the compressor means, as natural refrigerant such as $CO_2$, air and water, HFC refrigerant and HCFC refrigerant.

Furthermore, the revolving electric machine of the embodiment of the invention has the stator that is stored within the closed container while interposing a clearance, disposed so as to face to the rotor and composed of the laminated electromagnetic steel plates, the outer peripheral face of the stator facing to the closed container on the side of the outer diameter of the stator, the fixing sections each having the plurality of prepared holes provided on the outer peripheral face in close proximity from each other and the convex portions of the closed container corresponding to the fixing sections that are pressed from the outside of the closed container to enter the plurality of prepared holes to fix the stator to the closed container, wherein the prepared holes straddle the plurality of laminated electromagnetic steel plates.

In the revolving electric machine of the embodiment of the invention, the stator is what coils are wound concentratedly around the magnetic pole.

Furthermore, in the revolving electric machine of the embodiment of the invention, the plurality of fixing sections are provided on the outer peripheral face of the stator in the circumferential direction at almost equal pitches.

The compressor of the embodiments of the invention is manufactured by the manufacturing method comprising;

the steps of making the plurality of prepared holes arranged in close proximity on the outer peripheral face of the built-in part such as the compressor mechanism section and of storing it within the container while interposing the clearance between the container, the steps of heating the container by suppressing the heating region to the positions facing to the plurality of prepared holes of the built-in part from the outside of the container in the temperature range between the softening temperature of the material of the container and the melting temperature thereof, and of pressing the container wall by the pressing jigs whose diameter is smaller than the inner diameter of the prepared hole so that the container wall enters the prepared holes, and the step of clamping the built-in part by the container wall that has entered the plurality of prepared holes arranged in the circumferential direction on the outer peripheral face of the built-in part to fix the built-in part to the container.

According to the embodiment of the invention, the manufacturing method of the compressor includes a step of pressing a plurality of points at almost equal pitches from the output of the container in pressing the container wall by the pressing jigs.

According to the embodiments of the invention, it becomes possible to reduce the force received by the built-in part and to reduce strain of the compressor mechanism section and the stator of the revolving electric machine, i.e., the built-in part, in fixing the compressor mechanism section or the stator of the revolving electric machine to the container, so that it becomes possible to improve the performance of the compressor.

Furthermore, it becomes possible to steadily and strongly fix the built-in part to the container by generating the enough clamping force between the pluralities of neighboring prepared holes of the built-in part.

Accordingly, it becomes possible to provide the highly reliable compressor that sustains normal and excessive force generated during operation of the compressor and causes no trouble such as increase of noise and vibration otherwise caused by ricketiness of the built-in part.

As described above, the compressor of the invention may be widely utilized as various types of compressor because the performance as a compressor is improved and it has high reliability in a long-term use.

What is claimed is:

1. A compressor, comprising:

a container having a cylindrical container wall; and a built-in part housed within said container and having a predetermined clearance between an inner peripheral face of said container wall and said built-in part; wherein the built-in part comprises:

pairs of prepared circular receiving portions at plural points in a circumferential direction on an outer peripheral face of said built-in part; and a clamping part between each of said pairs of prepared receiving portions;

a distance (P), which is a half of a distance (L) between centers of a pair of prepared receiving portions, is less than twice an inner diameter (D1) of the prepared receiving portions and is equal to or more than 0.6 times the inner diameter (D1) ($0.6\times D1<P<2\times D1$), and the cylindrical container wall has pairs of convex portions, each of which is formed by pushing a pair of portions on the container wall corresponding to each pair of the prepared receiving portions into the pair of prepared receiving portions under the condition that a region of the container wall including the portions corresponding to positions of the pair of prepared receiving portions is heated, and a length of each of said convex portions entering said prepared receiving portions is equal to or less than 0.5 times a thickness of said container wall or is substantially 1 mm;

a fixing section constituted by said convex portions clamping the clamping part between said pair of prepared receiving portions when said region cools down; and said pairs of prepared receiving portions are arranged on an outer surface of a cylinder that covers a compressing chamber, at equal pitches, and one of said pairs of prepared receiving portion is within ±25° from a center line of a vane groove of the cylinder.

2. The compressor according to claim 1, wherein said built-in part is any one of components among:

a cylinder that covers a compressing chamber of a compressor mechanism section that effects compression;

a frame that composes said compressing chamber or that rotatably supports said compressor mechanism section; and a bearing-supporting member.

3. The compressor according to claim 1, wherein the temperature in said region in said heated condition is in a range between temperature that softens a material forming said container wall and a melting point of said material.

4. The compressor according to claim 1, wherein the temperature in said region in said heated condition is in a temperature range of 600° C. to 1500° C.

5. The compressor according to claim 1, wherein the temperature in said region in said heated condition is in a temperature range of 800° C. to 1100° C.

6. The compressor according to claim 1, wherein said built-in part is a cylinder that composes compressor means and an inner diameter of said cylinder is equal to or less than 75% of an outer diameter thereof.

7. The compressor according to claim 1, wherein said built-in part is a cylinder that composes compressor means and a width of an outer peripheral face of said cylinder is equal to or more than 5% of an outer diameter.

8. The compressor according to claim 1, wherein a second built-in part is housed within said container by leaving a predetermined clearance between the inner peripheral face of said container wall and said second built-in part;

pairs of second prepared receiving portions are formed at plural points in a circumferential direction on an outer peripheral face of said second built-in part;

parts of said container wall being pushed into said second prepared holes receiving portions under the condition that regions of said container wall including positions corresponding to positions of said second prepared receiving portions are heated so as to form pairs of second convex portions on the inner peripheral face of said container wall at plural points in the circumferential direction; and second fixing sections being formed as each of said pairs of second convex portions clamp a second clamping part between each of said pair of second prepared receiving portions when said region cools down;

wherein a width of the outer peripheral face of said second built-in part is equal to or more than 1% of the outer diameter.

9. The compressor according to claim 1, wherein said built-in part is a stator that composes a revolving electric motor together with a rotator and is composed of a plurality of laminated electromagnetic steel plates, and said prepared receiving portions are provided so as to straddle said plurality of laminated electromagnetic steel plates.

10. The compressor according to claim 1, wherein the built-in part comprises:

an upper cylinder; and a lower cylinder wherein the circular receiving portions are arranged on an outer peripheral face of the upper cylinder.

11. A compressor, comprising:

a container having a cylindrical container wall including convex portions formed at plural points on the inner peripheral face of the container wall in a circumferential direction; and a built-in part housed within said container and having a predetermined clearance between the inner peripheral face of said container wall and said built-in part; wherein said built-in part comprises:

at least one ringed groove receiving portion in the circumferential direction on an outer peripheral face of said built-in part;

wherein said convex portions of said container wall are pushed into said at least one ringed groove under the condition that a region of said container wall including positions corresponding to positions of said at least one ringed groove is heated so as to form the convex portions; and a fixing section constituted by said convex portions when said region cools down;

wherein when an average value of an inner radius and an outer radius of the ringed groove is defined as a radius R and a groove width T is obtained by subtracting the inner radius from the outer radius, then the radius R and the groove width T are set to satisfy a relationship $0.6 \leqq R/T < 2$.

* * * * *